US005877738A

United States Patent [19]

Ito et al.

[11] Patent Number: 5,877,738

[45] Date of Patent: Mar. 2, 1999

[54] LIQUID CRYSTAL ELEMENT DRIVE METHOD, DRIVE CIRCUIT, AND DISPLAY APPARATUS

[75] Inventors: Akihiko Ito; Shoichi Iino, both of Suwa, Japan

[73] Assignee: Seiko Epson Corporation, Tokyo, Japan

[21] Appl. No.: 178,949

[22] Filed: Jan. 7, 1994

Related U.S. Application Data

[63] Continuation-in-part of Ser. No. 148,083, Nov. 4, 1993.

[30] Foreign Application Priority Data

| | | | |
|---|---|---|---|
| May 8, 1992 | [JP] | Japan | 4-143482 |
| May 15, 1992 | [JP] | Japan | 4-123623 |
| Jul. 2, 1992 | [JP] | Japan | 4-199077 |

[51] Int. Cl.[6] ..... G09G 3/36

[52] U.S. Cl. ..... 345/94; 345/89; 345/103

[58] Field of Search ..... 345/87, 88, 89, 345/90, 92, 94, 95, 96, 97, 99, 103, 6; 359/54, 56; 349/33, 34, 36, 37, 42

[56] References Cited

U.S. PATENT DOCUMENTS

| | | | |
|---|---|---|---|
| 3,668,639 | 6/1972 | Harmuth | 345/6 |
| 3,973,252 | 8/1976 | Mitomo et al. | 340/324 M |
| 4,100,579 | 7/1978 | Ernstoff . | |
| 4,683,497 | 7/1987 | Megragardt . | |
| 4,873,616 | 10/1989 | Castleberry . | |
| 5,262,881 | 11/1993 | Kuwata et al. | 359/55 |
| 5,280,280 | 1/1994 | Hotto | 345/94 |
| 5,420,604 | 5/1995 | Scheffer . | |
| 5,475,397 | 12/1995 | Saidi . | |

FOREIGN PATENT DOCUMENTS

| | | |
|---|---|---|
| 0349415 | 1/1990 | European Pat. Off. . |
| 0388976 | 9/1990 | European Pat. Off. . |
| 0479450 | 4/1992 | European Pat. Off. . |
| 507061 | 10/1992 | European Pat. Off. . |
| 0569974 | 11/1993 | European Pat. Off. . |
| 4031905 | 4/1991 | Germany . |
| 15393 | 3/1982 | Japan . |
| 262724 | 11/1986 | Japan . |
| 102230 | 5/1987 | Japan . |
| 267694 | 10/1989 | Japan . |
| 185490 | 8/1991 | Japan . |
| 645473 | 9/1984 | Switzerland . |
| 0020550 | 10/1993 | WIPO . |
| 9501628 | 1/1995 | WIPO . |

OTHER PUBLICATIONS

Scheffer, et al. "*Pulse–Height Modulation (PHM) Gray Shading for Passive Matrix LCDs*", Japan Display 92, pp. 69–72.

Ruckmongathan, "Some New Addressing Techniques for RMS Responding Matrix LCDs", A Thesis Submitted for the Degree of Doctors of Philosophy in the Faculty of Engineering, Feb. 1988.

2449 Displays vol. 14 (1993) No. 2, Jordan Hill, Oxford, GB, "Active Addressing™ of STN displays for high–performance video applications" by T.J. Scheffer, B. Clifton, D. Prince and A.R. Conner, pp. 74–85.

(List continued on next page.)

*Primary Examiner*—Chanh Nguyen
*Attorney, Agent, or Firm*—Eric B. Janofsky

[57] ABSTRACT

A multiplex driving method and driving apparatus are provided for a liquid crystal display device having a liquid crystal layer disposed between a pair of substrates, a plurality of row electrodes arranged on one of the substrates and a plurality of column electrodes arranged on the other substrate, the plurality of row electrodes being arranged in plural groups. A portion of the row electrodes are simultaneously selected a within a selection period in which the selection period is divided into a plurality of intervals. A weighted voltage is applied in accordance with desired display data in each of the plurality of intervals to achieve a gray scale display.

23 Claims, 42 Drawing Sheets

OTHER PUBLICATIONS

2320 Proceedings of the S.I.D. vol. 24 (1983) No. 3, Los Angeles, CA USA "New Addressing Techniques for Multiplexed Liquid Crystal Displays" by t.N. Ruckmongathan and N.V. Madhusudana pp. 259–262.

Proceedings Japan Display '92, Hiroshima, Japan; B. Clifton, D. Prince, In Focus Systems, Inc., Tualatin, OR, USA "Hardware Architectures for Video–Rate, Active Addressed STN Displays" pp. 503–506.

SID International Symposium 1994 Digest of Technical Papers, May 1994, *7.1: A9.4–in. Color VGA F–STN Display with Fast Response Time and High contrast Ratio by Using MLS Method* by H. Muraji, Et. Al. pp. 61–64.

SID International Symposium 1994 Digest of Technical Papers, May 1994 *7.2: An Addressing Techniqie with Reduced Hardware Complexity* by T. N. Ruckmongathan pp. 65–68.

SID International Symposium 1994 Digest of Technical Papers, May 1994 *7.3: A Study of the Active Drive Method for STN–LCDs* by Y. Fukui, Et. Al. pp. 69–72.

SID International Symposium 1992 Digest of Technical Papers, May 1992, pp. 228–231.

1988 International Display Research Conference, "A Generalized Addressing Technique For RMS Responding Matrix LCDS", by T.N. Ruckmongathan, Raman Research Institute, 1988 IEEE, pp. 80–85.

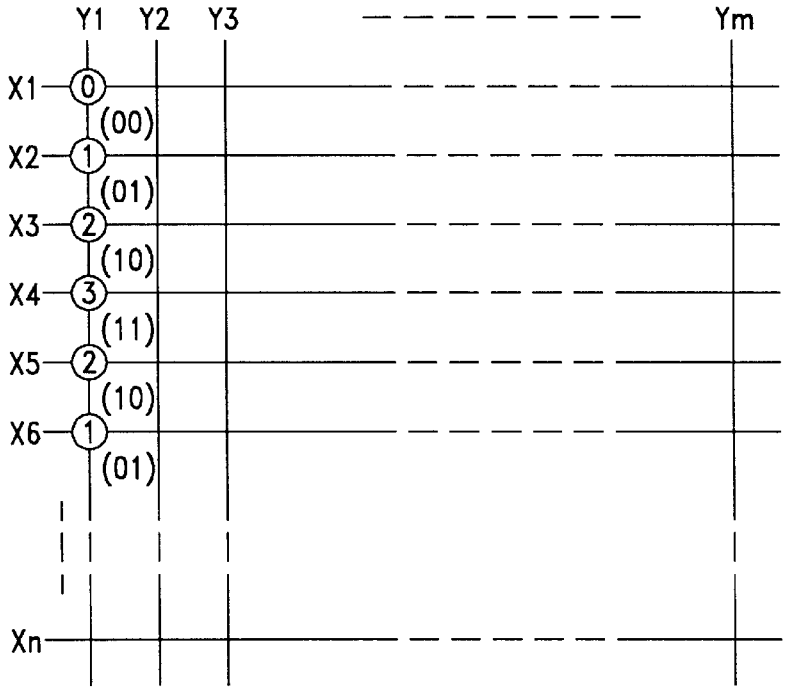
FIG.-2
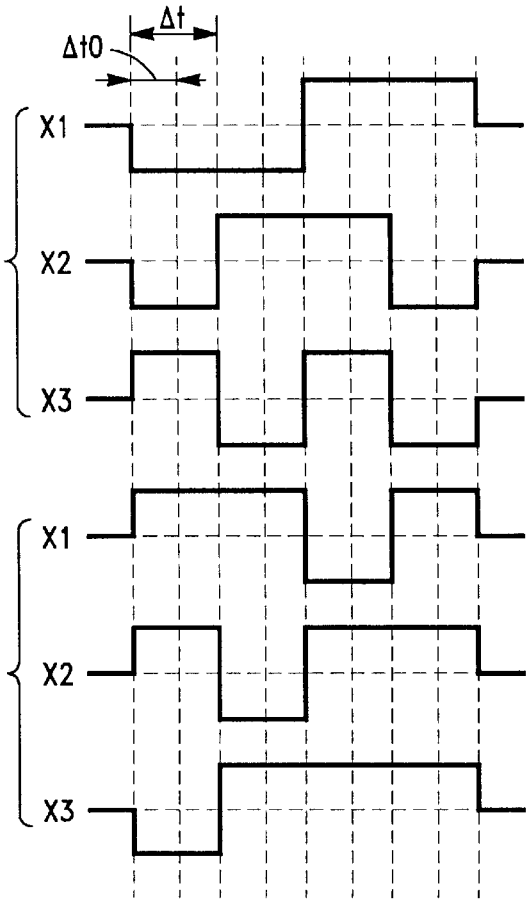
FIG.-3A
FIG.-3B

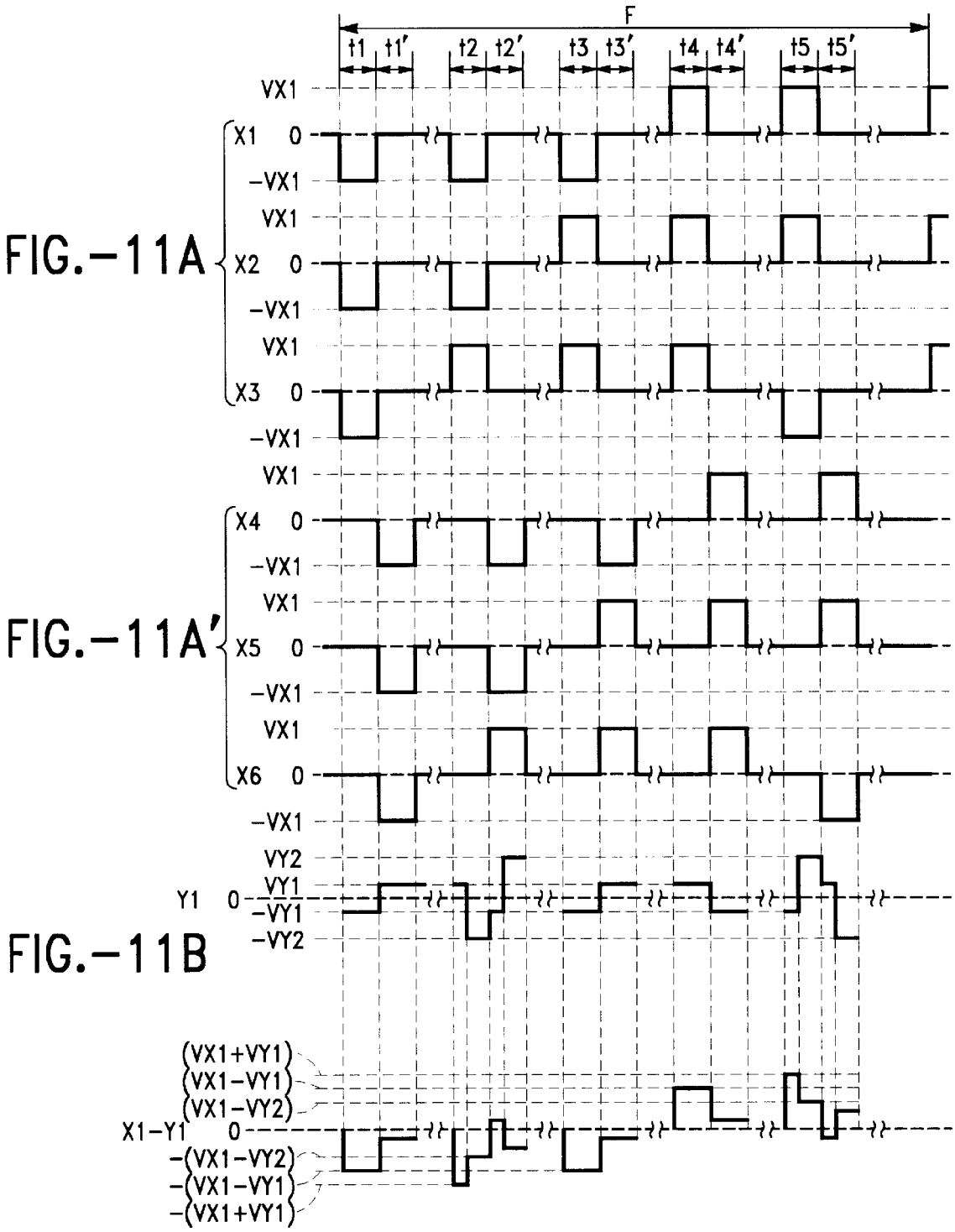
FIG.−11A
FIG.−11A′
FIG.−11B
FIG.−11C

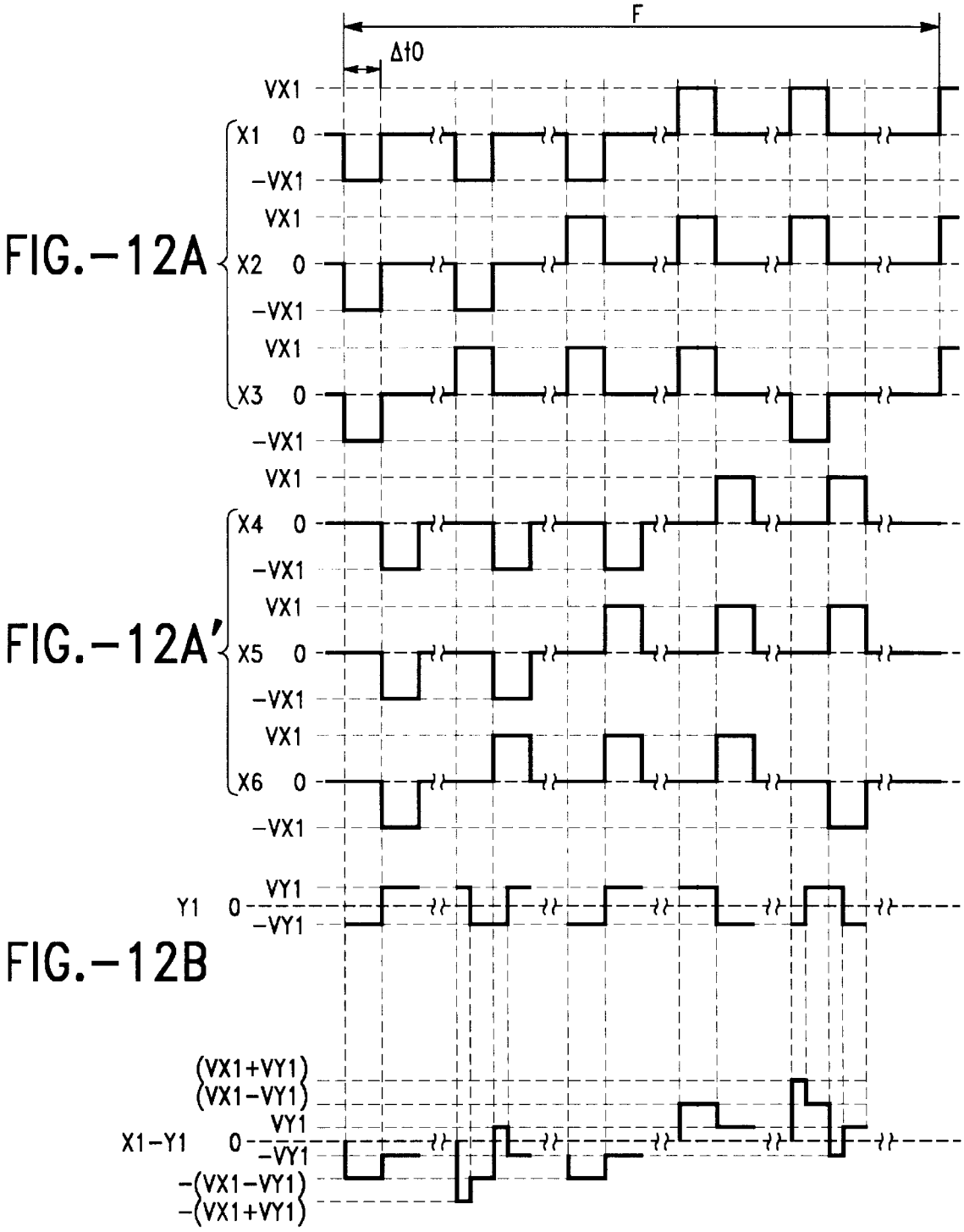
FIG.−12A
FIG.−12A′
FIG.−12B
FIG.−12C

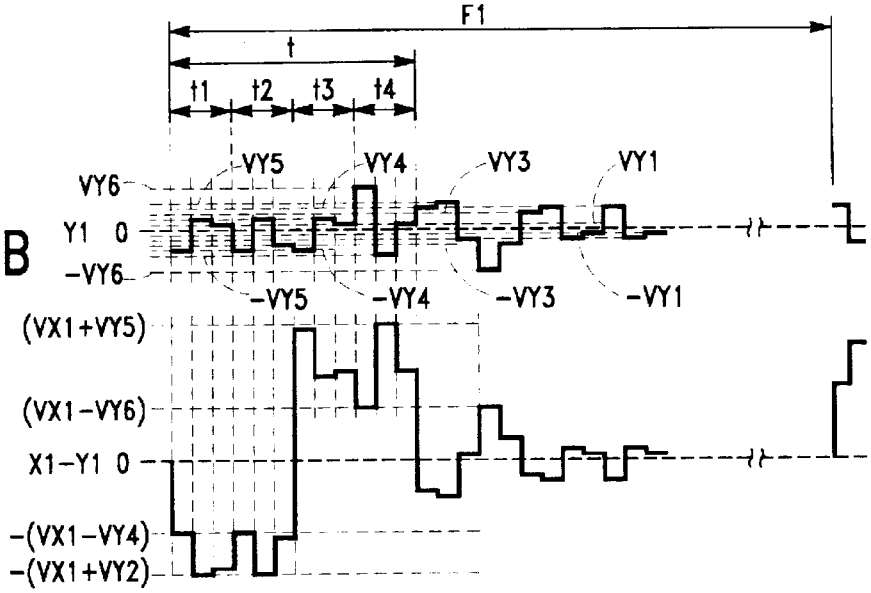
FIG.-21B
FIG.-21C
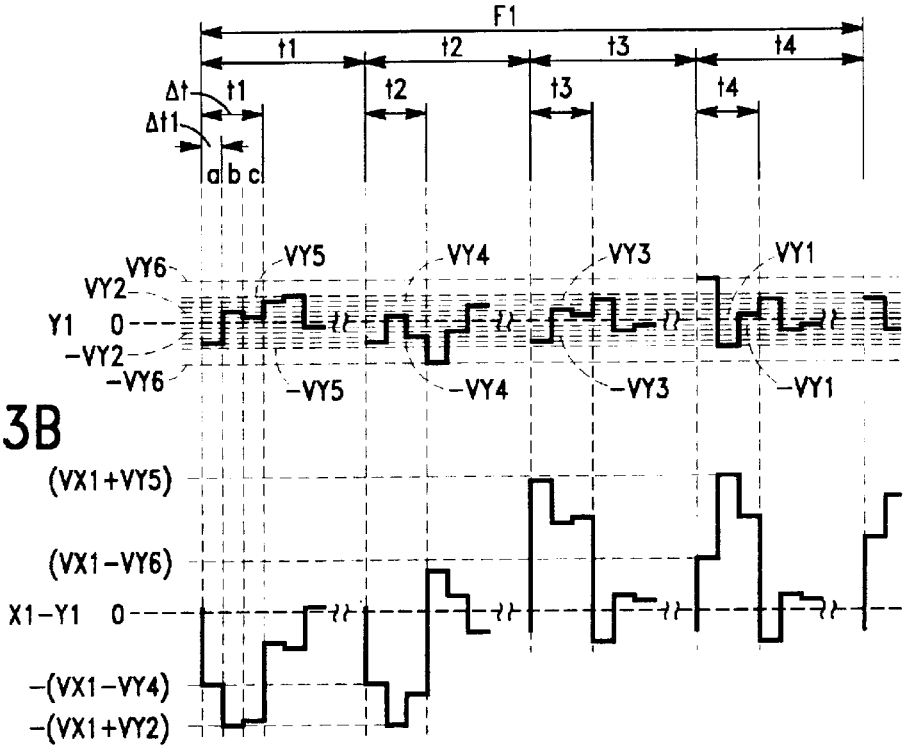
FIG.-23B
FIG.-23C

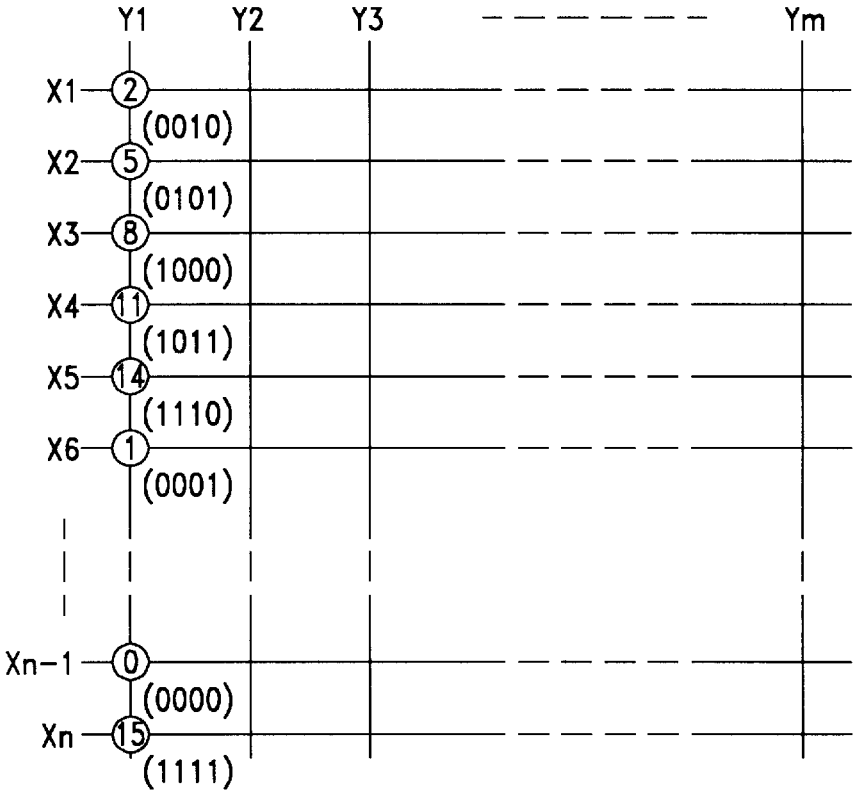
FIG.−31
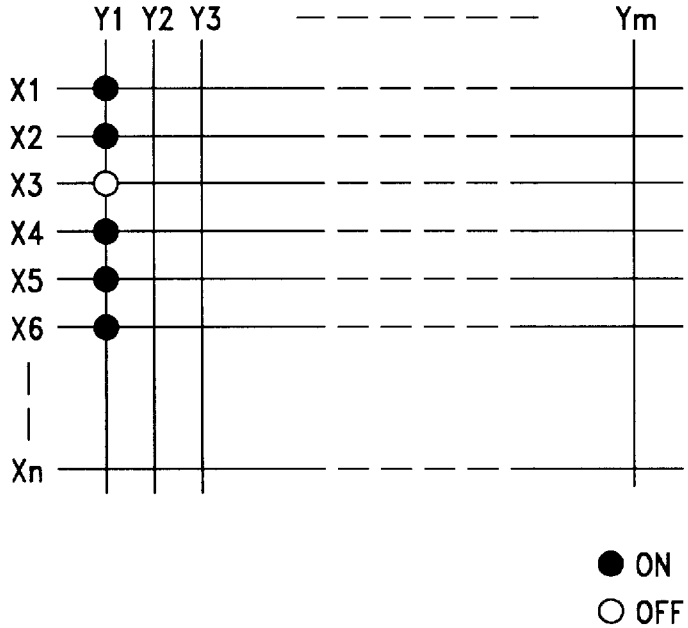
FIG.−44

LIQUID CRYSTAL ELEMENT DRIVE METHOD, DRIVE CIRCUIT, AND DISPLAY APPARATUS

CROSS-REFERENCE TO RELATED APPLICATION

This application is a continuation-in-part of International Application No. PCT/JP93/00604, filed on May 10, 1993 and a continuation-in-part of U.S. patent application Ser. No. 08/148,083, filed Nov. 4, 1993, the contents of which are incorporated herein by reference.

FIELD OF THE INVENTION

The present invention generally relates to a driving apparatus and a driving method for a liquid crystal display having a plurality of row electrodes and column electrodes. More particularly, the invention relates to such an apparatus and a method in which the row electrodes are divided into groups, each of the electrodes in each group being simultaneously selected each group being sequentially selected for achieving a gray scale display.

BACKGROUND OF THE INVENTION

Matrix liquid crystal displays such as, twisted nematic (TN) and super twisted nematic (STN), are known in the art. Reference is made to FIG. 49 in which a conventional matrix liquid crystal display is provided. A liquid crystal panel generally indicated, as 1 is composed of a liquid crystal layer 5, a first substrate 2 and a second substrate 3 for sandwiching the liquid crystal layer 5 therebetween. A group of column electrodes $Y_1$–$Y_m$ are oriented on substrate 2 in the vertical direction and a plurality of row electrodes $X_1$–$X_n$ are formed on substrate 3 in substantially the horizontal direction to form a matrix. Each intersection of column electrodes $Y_1$–$Y_m$ and row electrodes $X_1$–$X_n$ forms a display element or pixel 7. Display pixels 7 having the open circle indicate an ON state and those pixels having a blank indicate an OFF state.

A conventional multiplex driving based on the amplitude selective addressing scheme is known to one of ordinary skill in the art as one method of driving the liquid crystal panel mentioned above. In such a method, a selected voltage or non-selected voltage is sequentially applied to each of row electrodes $X_1$–$X_n$ individually. That is, a selection voltage is applied to only one row electrode at a time. In the conventional driving method, the time period required to apply the successive selected or non-selected voltage to all the row electrodes $X_{-Xn}$ is known as one frame period, indicated in FIGS. 43A–E as time period F. Typically the frame period is approximate 1/60th of a second or 16.66 milliseconds.

Simultaneously to the successive application of the selected voltage or the non-selected voltage to each of the row electrodes $X_1$–$X_n$, a data signal representing an ON or OFF voltage is applied to column electrodes $Y_1$–$Y_m$. Accordingly, to turn a pixel 7, e.g. the area in which the row electrode intersects the column electrode, to the ON state, an ON voltage is applied to a desired column electrode when the row electrode is selected.

Referring specifically to FIGS. 43A–E, a conventional multiplex drive method of a simple matrix type liquid crystal and more specifically the amplitude selective addressing scheme is shown therein. Such a conventional drive method is not intended to provide the features of achieving a gray scale display. FIGS. 43A–C show the row selection voltage waveforms that are applied in sequence to row electrodes $X_1, X_2 \ldots X_n$, respectively. More particularly, in time period $t_1$, a voltage pulse having a magnitude of $V_1$ is applied to row electrode $X_1$, and a voltage of zero is applied to electrodes $X_2$–$X_n$; in time period $t_2$, a voltage pulse having a magnitude of $V_1$ is applied to row electrode $X_2$ and a voltage of zero is applied to electrodes $X_1$ and $X_3$–$X_n$ and in time period $t_n$, $V_1$ is applied to row electrode $X_n$ and a voltage of zero is to electrodes $X_1$–$X_{n-1}$. In other words, a voltage pulse having a magnitude of $V_1$ is applied to only one row electrode $X_i$ in time $t_i$. Typically, $t_i$ is approximately 69 $\mu$seconds and $V_1$ is approximately 25 volts. As will be apparent to one who has read this description, all of the row electrodes are sequentially selected in time periods $t_1$–$t_n$ or one frame period F.

FIG. 43D shows the waveform applied to column electrode $Y_1$, and FIG. 43E shows the synthesized voltage waveform applied to the pixel $\mathbf{7}_{1,1}$ formed at the intersection of the column electrode $Y_1$ and the row electrode $X_1$. As shown therein, during time period $t_1$, a voltage pulse having a magnitude of $V_1$ is applied to row $X_1$ and a voltage pulse of $-V_2$ is applied to column electrode $Y_1$. Typically, $V_2$ is approximately 1.6 volts. The resultant voltage at pixel $\mathbf{7}_{1,1}$ is $(V_1-V_2)$. This synthesized voltage is sufficient to turn pixel $\mathbf{7}_{1,1}$ to its ON state.

As noted above this conventional driving method does not display an image having a gray scale. Furthermore, another known problem with this method is that in order to select and drive the one line of the row electrodes, a relatively high voltage is required to provide good display characteristics, such as, contrast and low distortion. These conventional displays, requiring such a high voltage, also consume relatively more energy. When such displays are used in portable devices, they are supplied with electrical energy by, for example, batteries. As a result of the higher energy consumption, the portable devices have relatively shorter times of operation before the batteries require replacement and/or recharging.

Various attempts have been made to overcome this problem. For example parent patent application Ser. No. 08/148,083, filed Nov. 4, 1993, is directed to a method driving a liquid crystal panel comprising the steps of sequentially selecting a group of a plurality of row electrodes during a selection period, simultaneously selecting the row electrodes comprising the group, and dividing and separating the selection period into a plurality of intervals within one frame period.

In another example, it has been suggested in "A Generalized Addressing Technique for RMS Responding Matrix LCDs," 1988 *International Display Research Conference*, pp. 80–85. to simultaneously apply a row selection voltage to more than one row electrode.

As shown in FIG. 45A–D, a conventional method for driving a liquid crystal display is provided by simultaneously selecting a group of more than one row electrode. As shown therein, the n row electrodes are divided in j groups of row electrodes, each group comprising, for example, two row electrodes. In this example, row electrodes $X_1$, $X_2$ and $X_3$ and $X_4$, $X_5$ and $X_6$ form first and second groups of row electrodes, respectively.

Referring again to FIG. 45A, that figure illustrates row selection voltage waveforms applied simultaneously to both row electrodes $X_1$, $X_2$ and $X_3$ in time periods $t_{11}$–$t_{18}$ and a voltage of zero is applied to row electrodes $X_1$, $X_2$ and $X_3$ in the remaining time periods of frame period F. Similarly, FIG. 45B indicates the row selection voltage waveforms applied to row electrodes $X_4$, $X_5$ and $X_6$, during time periods $t_{21}$–$t_{28}$ and a voltage of zero is applied to row electrodes $X_4$, $X_5$ and $X_6$ in the other time periods of frame period F. FIG. 45C illustrates the voltage waveform applied to column electrode $Y_1$, and FIG. 45D indicates the synthesized voltage waveform applied to the pixel $\mathbf{7}_{1,1}$. Generally, $t_{11}$, $t_{12}$, . . . $t_{j,n}$=34.5 μseconds, $V_1$ is approximately 17.6 volts and $V_2$ is approximately 2.3 volts.

As shown in the example of FIGS. 45A–D, every three row electrodes are selected in sequence. In the first selection sequence, two row electrodes, $X_1$, $X_2$ and $X_3$, are selected and row selection voltage waveforms such as that shown in FIG. 45A are applied to each row electrode. At the same time, the designated column voltage, which is described below, is applied to each column electrode, $Y_1$ to $Y_m$. Next, row electrodes $X_4$, $X_5$ and $X_6$ are simultaneously selected with substantially the same type of waveform voltages as that described above. At the same time, the column voltages $Y_1$ to $Y_m$ are applied to each column electrode. One frame period represents the selection of all row electrodes, $X_1$ to $X_n$. In other words, a complete image is displayed during one frame.

As will be explained hereinbelow, when h row electrodes are simultaneously elected, the voltage waveforms that apply the row electrodes described above use $2^h$ row-select patterns. In the example illustrated in FIGS. 45A–D, the number of row electrodes simultaneously selected is two, thus the number of row select patterns is $2^3$ or 8.

Moreover, the column voltages applied to each column electrode $Y_1$ to $Y_m$ provide the same number of pulse patterns as that of the row select pulse patterns. That is, there are $2^h$ pulse patterns. These pulse patterns are determined by comparing the states of pixels on the simultaneously selected row electrodes i.e., whether the pixels are ON or OFF, with the polarities of the voltage pulses applied to row electrode.

In this example, as shown in the previously described FIGS. 45A–D, when row electrodes $X_1$, $X_2$ and $X_3$ are selected and row voltages such as those in FIG. 45A and FIG. 46A are applied thereto and when the pixels on row electrodes $X_1$, $X_2$ and $X_3$ are ON, ON and OFF, respectively, as shown in FIG. 44, the voltage waveform applied the column electrode is voltage waveform $Y_1$ shown in FIG. 45C.

The above-mentioned column voltage waveform $Y_1$ is determined as follows. At first, each pixel simultaneously selected is defined to have a first value of 1 when the voltage applied by the row electrode to the corresponding selected pixel is positive or a first value of 0 when the row electrode is negative. In the example shown in FIGS. 45A–D, the voltage ON/OFF patterns applied to the three simultaneously selected row electrodes $X_1$, $X_2$, and $X_3$ are shown in the following table using values of 1 and 0 for ON and OFF pixel states, respectively.

TABLE A

| | | | | | | | | |
|---|---|---|---|---|---|---|---|---|
| $X_1$ | 0 | 0 | 0 | 0 | 1 | 1 | 1 | 1 |
| $X_2$ | 0 | 0 | 1 | 1 | 0 | 0 | 1 | 1 |
| $X_3$ | 0 | 1 | 0 | 1 | 0 | 1 | 0 | 1 |

Each of the selected pixels is defined to have a second value of 1 when the display state is ON or a second value of 0 when display state is OFF. The first value is compared to the second value bit-by-bit, the number of mismatches, i.e., when the first value does not equal the second value, is calculated. When the number of mismatches for the simultaneously selected rows is zero, $-V_{Y2}$ is applied; when 1, $-V_{Y1}$ is applied; when 2, $V_{Y1}$ is applied; and when 3, $V_{Y2}$ is applied. In this example the ratio of $V_{Y1}$ to $V_{Y2}$ is 1:3.

For example, when the pulse waveforms shown in FIG. 45A are applied to row electrodes $X_1$, $X_2$ and $X_3$, a column voltage having the waveform of $Y_1$ is applied. For time period $t_{11}$, the column voltage is determined as follows. The pixels formed at the intersections of column electrode $Y_1$ and rows electrodes $X_1$, $X_2$ and $X_3$ are in the ON, ON and OFF states, respectively. For the purposes of this discussion, these pixels will be referred to as the first, second and third pixels, respectively. In other words, the first pixel has a second value of 1, the second pixel has a second value of 1 and the third pixel has a second value of 0 (zero) . Those pixels assume the first values, as shown in Table A. Referring to the first pixel, since the first value is 0 and the second value is 1, there is a mismatch. With regard to the second pixel, the first value is 0 and the second value is 1, thereby also forming a mismatch. Finally, referring to the third pixel, the first value is 0 and the second value is also 0, thereby forming a match. Accordingly, the number of mismatches is determined to be 2. Therefore, a voltage of $V_{Y1}$ is applied to the column electrode in time $t_{11}$.

The row select pattern of the voltage applied to the row electrodes $X_1$, $X_2$, and $X_3$ in time $t_{12}$ is OFF-OFF-ON. The number of mismatches during this time period is three. Therefore, voltage $V_{Y2}$ is applied as the second pulse to column electrode $Y_1$. Similarly, $V_{Y1}$ is applied as the third pulse, $-V_{Y1}$ as the fourth pulse. Thus the following pulses are, in sequence, $-V_{Y2}$, $V_{Y1}$, $-V_{Y1}$, $-V_{Y1}$ are applied to the column electrode.

The next three row electrodes $X_4$–$X_6$ are then selected, and when the voltage shown in FIG. 47B is applied to these row electrodes $X_4$–$X_6$, a column voltage of the voltage level corresponding to the number of mismatches between the on/off states of the pixels at the intersections of row electrodes $X_4$–$X_6$ and the column electrode and the on/off states of the voltage row select patterns applied to the row electrodes $X_4$–$X_6$as shown in FIG. 45C is applied.

The voltage waveforms generated based on these values for application to the row electrodes are shown in FIG. 46A. The waveform shown in FIG. 46A, however, contains dispersions in the frequency component, which can result in display uniformity when applied. In other words, the applied voltage waveforms, which include the following different frequency components:

X1: 4·Δt, 4·Δt

X2: 2·Δt, 4·Δt, 2·Δt

X3: 2·Δt, 2·Δt, 2·Δt, 2·Δt

Such differences in frequency appear to cause distortion of the displayed image.

The waveforms modified by reordering the array to eliminate the bias in the frequency component is shown in FIG. 46B. The prior art example shown in FIG. 45A–D can also utilize these waveforms.

However, when a driving method, such as shown in FIG. 48A or B is used to drive a liquid crystal display panel, the pulse width of each pulse becomes narrower. That is particularly true when the number of simultaneously selected row electrodes increases. In other words, there is an exponential increase in the number of bit word patterns with each pulse width becoming narrower. The narrower pulse width leads to possible rounding when the waveform is applied to pixel and/or crosstalk may occur. These distortions are particularly apparent when a gray scale display is attempted.

In another example, values 1 and −1 are used for the positive and negative selection pulses of the row voltage waveform, and −1 and 1 are used for the ON and OFF display data states of pixel, respectively, and the column voltage waveform is set according to the difference between the number of matches and the number of mismatches, values of 1 or −1 can be used for either, and the column voltage waveform can be set using only the number of matches or the number of mismatches without calculating the difference between the number of matches or the number of mismatches.

FIGS. 47A, A', B and C depict another example of a conventional method for driving a liquid crystal display by simultaneously selecting a group of more than one row electrode. As shown therein, the n row electrodes are divided in j groups of row electrodes, each group comprising, for example, two row electrodes. In this example, row electrodes $X_1$, $X_2$; $X_3$, $X_4$; and $X_{n-1}$, $X_n$, each form a group of row electrodes.

Referring again to FIG. 47A, that figure illustrates row selection voltage waveforms applied simultaneously to both row electrodes $X_1$ and $X_2$ in time periods $t_1$ and $t_2$ and a voltage of zero is applied to row electrodes $X_1$ and $X_2$ in the remaining time periods of frame period F. Similarly, FIG. 47A'indicates the row selection voltage waveforms applied to row electrodes $X_3$ and $X_4$, during time periods $t_3$ and $t_4$ and a voltage of zero is applied to row electrodes $X_3$ and $X_4$ in the other time periods of frame period F. FIG. 47B illustrates the voltage waveform applied to column electrode $Y_1$, and FIG. 47C indicates the synthesized voltage waveform applied to the pixel $7_{1,1}$. Generally, $t_1$, $t_2$, . . . $t_n$=69 $\mu$ seconds, $V_1$ is approximately 17.6 volts and $V_2$ is approximately 2.3 volts.

As shown in the example of FIGS. 47A, A' B and C every two row electrodes are selected in sequence. In the first selection sequence, two row electrodes, $X_1$ and $X_2$, are selected and row selection voltage waveforms such as that shown in FIG. 47A are applied to each row electrode. At the same time, the designated column voltage, which is described below, is applied to each column electrode, $Y_1$ to $Y_m$. Next, row electrodes $X_3$ and $X_4$ are simultaneously selected with substantially the same type of waveform voltages as that described above. At the same time, the column voltages $Y_1$ to $Y_m$ are applied to each column electrode. As explained above, one frame period represents the selection of all row electrodes, $X_1$ to $X_n$.

As will be explained hereinbelow, when h row electrodes are simultaneously selected, the voltage waveforms that apply the row electrodes described above use $2^h$ row-select patterns. In the example illustrated in FIGS. 47A, A', B and C the number of row electrodes simultaneously selected is two, thus the number of row select patterns is $2^2$ or 4.

Moreover, the column voltages applied to each column electrode $Y_1$ to $Y_m$provide the same number of pulse patterns as that of the row select pulse patterns. That is, there are $2^h$ pulse patterns. These pulse patterns are determined by comparing the states of pixels on the simultaneously selected row electrodes i.e., whether the pixels are ON or OFF, with the polarities of the voltage pulses applied to row electrode.

In this example, as shown in the previously described FIGS. 47A, A' B and C when row electrodes $X_1$ and $X_2$ are selected and row voltages such as those in FIG. 47A and FIG. 48A are applied thereto and when the pixels on row electrodes $X_1$ and $X_2$ are ON and OFF, respectively, the voltage waveform applied the column electrode is voltage waveform $Y_a$ shown in FIG. 48B. When the pixels are OFF and ON, respectively, the column voltage waveform $Y_b$ is applied to the column electrode. In another example, when the pixels are both ON, a voltage waveform $Y_c$ is applied to the column electrode. Finally, when both pixels are OFF, the a column voltage waveform $Y_d$ is applied to the column electrode.

The above-mentioned column voltage waveforms $Y_a$–$Y_d$ are determined as follows. At first, each pixel simultaneously selected is defined to have a first value of 1 when the voltage applied by the row electrode to the corresponding selected pixel is positive or a first value of −1 when the row electrode is negative. Each of the selected pixels is defined to have a second value of −1 when the display state is ON or a second value of 1 when display state is OFF. The first value is compared to the second value bit-by-bit, the difference between the number of matches, i.e., when the first value equals the second value, and the number of mismatches, i.e., when the first value does not equal the second value, is calculated. When the difference between the number of matches and mismatches for the simultaneously selected rows is two, $V_2$ is applied; when 0, $V_0$ is applied; and when −2, $-V_2$ is applied.

For example, when the pulse waveforms shown in FIG. 47A are applied to row electrodes $X_1$ and $X_2$, a column voltage having the waveform of $Y_a$ is applied. This column voltage is determined as follows. The pixels formed at the intersections of column electrode $Y_1$ and rows electrodes $X_1$ and $X_2$ are in the ON and OFF states, respectively. For the purposes of this discussion, these pixels will be referred to as the first and second pixels, respectively. In other words, the first pixel has a second value of −1 and the second pixel has a second value of 1. During the period $t_a$, the first pixel has a first value of −1 and the second pixel has a first value of −1, since the row voltages $X_1$ and $X_2$ are both $-V_1$. Referring to the first pixel, since the first value is $-_1$and the second value is −1, there is a match. With regard to the second pixel, the first value is −1 and the second value is 1, thereby forming a mismatch. The difference between the number of mismatches and matches is 1−1 or zero. Therefore, a voltage of 0 (zero) is applied to the column electrode in time $t_a$. Next, concerning the pulse waveforms of the time interval $t_b$, the applied voltage of row electrode $X_1$ is positive and the applied voltage of row electrode pulse $X_2$ is negative. Using a similar analysis as described above, the number of matches is zero and the number of mismatches is 2. Thus, $-V_2$ volts will be applied to the second half of time interval $t_1$.

As should now be apparent, the first values in time interval $t_c$ in FIG. 47A are −1 and 1 because the applied voltage of row electrode $X_1$ is negative and the applied voltage of row electrode $X_2$ is positive. When these are compared with the second values of the first and second pixels of −1 and 1, the number of matches is two and the number of mismatches is zero. The difference between the number of matches and the number of mismatches is 2. Thus, the column voltage of $V_2$ volts will be applied in time interval $t_c$.

In time interval $t_d$, the applied voltage of row electrodes $X_1$ and $X_2$ are both positive. Thus, the first values are 1 and 1. When compared to the pixel states of −1 and 1, the number of matches is 1 and the number of mismatches is 1, thus the difference between the number of matches and the number of mismatches is zero. Accordingly, zero volts will be applied to $Y_a$ for the time interval $t_d$.

A summary of this analysis for time periods $t_a$, $t_b$, $t_c$ and $t_d$, is shown in Table B below:

TABLE B

| | $t_a$ | $t_b$ | $t_c$ | $t_d$ |
|---|---|---|---|---|
| pixel | | | | |
| 1 - ON | | | | |
| first value | −1 | 1 | −1 | 1 |
| second value | −1 | −1 | −1 | −1 |
| match | yes | no | yes | no |
| mismatch | no | yes | no | yes |
| 2 - OFF | | | | |
| first value | −1 | −1 | 1 | 1 |
| second value | 1 | 1 | 1 | 1 |
| match | no | no | yes | yes |
| mismatch | yes | yes | no | no |
| no. of matches | 1 | 0 | 2 | 1 |
| no. of mismatches | 1 | 2 | 0 | 1 |
| difference | 0 | −2 | 2 | 0 |
| column voltage | 0 | $-V_2$ | $V_2$ | 0 |

As is readily apparent, the column voltage $Y_a$ corresponds to the column voltage pattern and is applied to the column to place the first pixel in its ON state and the second pixel in its OFF state.

As for the other column voltage waveforms, $Y_b$ to $Y_d$, the voltages are selected under the same criteria as described above and are summarized in Tables C, D and E hereinbelow:

TABLE C

| | $t_a$ | $t_b$ | $t_c$ | $t_d$ |
|---|---|---|---|---|
| pixel | | | | |
| 1 - OFF | | | | |
| first value | −1 | 1 | −1 | 1 |
| second value | 1 | 1 | 1 | 1 |
| match | no | yes | no | yes |
| mismatch | yes | no | yes | no |
| 2 - ON | | | | |
| first value | −1 | −1 | 1 | 1 |
| second value | −1 | −1 | −1 | −1 |
| match | yes | yes | no | no |
| mismatch | no | no | yes | yes |
| no. of matches | 1 | 2 | 0 | 1 |
| no. of mismatches | 1 | 0 | 2 | 1 |
| difference | 0 | −2 | 2 | 0 |
| column voltage | 0 | $-V_2$ | $V_2$ | 0 |
| Column Voltage Applied = $Y_b$ | | | | |

TABLE D

| | $t_a$ | $t_b$ | $t_c$ | $t_d$ |
|---|---|---|---|---|
| pixel | | | | |
| 1 - ON | | | | |
| first value | −1 | 1 | −1 | 1 |
| second value | −1 | −1 | −1 | −1 |
| match | yes | no | yes | no |
| mismatch | no | yes | no | yes |
| 2 - ON | | | | |
| first value | −1 | −1 | 1 | 1 |
| second value | −1 | −1 | −1 | −1 |
| match | yes | yes | no | no |
| mismatch | no | | yes | yes |
| no. of matches | 2 | 1 | 1 | 0 |
| no. of mismatches | 0 | 1 | 1 | 2 |

TABLE D-continued

| | $t_a$ | $t_b$ | $t_c$ | $t_d$ |
|---|---|---|---|---|
| difference | 2 | 0 | 0 | −2 |
| column voltage | $V_2$ | 0 | 0 | $-V_2$ |
| Column Voltage Applied = $Y_c$ | | | | |

TABLE E

| | $t_a$ | $t_b$ | $t_c$ | $t_d$ |
|---|---|---|---|---|
| pixel | | | | |
| 1 - OFF | | | | |
| first value | −1 | 1 | −1 | 1 |
| second value | 1 | 1 | 1 | 1 |
| match | no | yes | no | yes |
| mismatch | yes | no | yes | no |
| 2 - OFF | | | | |
| first value | −1 | −1 | 1 | 1 |
| second value | 1 | 1 | 1 | 1 |
| match | no | no | yes | yes |
| mismatch | yes | yes | no | no |
| no. of matches | 0 | 1 | 1 | 2 |
| no. of mismatches | 2 | 1 | 1 | 0 |
| difference | −2 | 0 | 0 | 2 |
| column voltage | $-V_2$ | 0 | 0 | $V_2$ |
| Column Voltage Applied = $Y_d$ | | | | |

In the examples above, the first value is 1 when the row-select voltage has a positive polarity or the first value when the row-select voltage has a negative polarity. Additionally, the second value is −1 when the display state of the pixel is ON, or 1 when the display state is OFF. The column voltage waveforms were selected by means of the difference between the number of matches and the number of mismatches As described above, these methods of simultaneously selecting and driving plural sequential row electrodes can suppress the drive voltage while achieving the same on/off ratio as the single line selection method shown in FIG. 43A–E.

The following is a general discussion regarding the conventional method for simultaneously selecting multiple row electrodes.

A. Requirements

A The N number of row electrodes to be displayed are divided up into N/h non-intersecting subgroups.

B Each subgroup has h number of address lines.

C At a particular time, the display data on each column electrode is composed of an h-bit words, e.g.:

$d_{k*h+1}, d_{k*h+2} \ldots d_{k*h+h}; d_{k*h+j}=0$ or 1

Where $0 \leqq k \leqq (N/h)-1$ (k: subgroup)

In other words, one column of display data is:

$d_1, d_2 \ldots d_h \ldots$ Subgroup 0

$d_{h+1}, d_{h+2} \ldots d_{h+h} \ldots$ Subgroup 1

$d_{N-h+1}, d_{N-h+2} \ldots d_{N-h+h} \ldots$ Subgroup N/h−1

D The row-select pattern has $2^h$ cycle and is represented by an h-bit words, e.g.:

$a_{k*h+1}, a_{k*h+2} \ldots a_{k*h+h}; a_{k*h+j}=0$ or 1

B. Guidelines (1) One subgroup is selected simultaneously for addressing.

(2) One h-bit word is selected as the row-select pattern.

(3) The row-select voltages are:

$-V_r$ for a logic 0, $+V_r$ for a logic 1, 0 volts or ground for the unselected period.

(4) The row-select patterns and the display data patterns in the selected subgroup are compared bit by bit such as with digital comparators, viz. exclusive OR logic gates.

(5) The number of mismatches i between these two patterns is determined by counting the number of exclusive-OR logic gates having a logical 1 output.

Steps 1–4 are summarized by the following equation:

$$i = \sum_{j=1}^{h} a_{k*h+j} \oplus d_{k*h+j} \; (0 \leqq i \leqq h)$$

(where ⊕is an exclusive OR logic operation)

(6) The column voltage is chosen to be V(i) when the number of mismatches is i.

(7) The column voltages for each column in the matrix is determined independently by repeating the steps (4)–(6).

(8) Both the row voltage and column voltage are applied simultaneously to the matrix display for a time duration Δt, where Δt is minimum pulse width.

(9) A new row-select pattern is chosen and the column voltages are determined using steps (4)–(6). The new row and column voltages are applied to the display for an equal duration of time at the end of Δt.

(10) A frame or cycle is completed when all of the subgroups (=N/h) are selected with all the $2^h$ row-select patterns once.

1 cycle=$\Delta t \cdot 2^h \cdot N/h$

C. Analysis

The row select patterns in a case in which there are i number of mismatches will now be considered. The number of h-bit row-select patterns which differ from and h-bit display data pattern by i bits is given by hCi=h!/({i! (h−i)!}=Ci For example, when the case for h=3 and row electrode selection pattern =(0,0,0) is considered, the results would be as shown in the table below:

| Mismatching number | Display Data pattern | Ci |
|---|---|---|
| i = 0 | (0,0,0) | 1 way |
| i = 1 | (0,0,1) (0,1,0) (1,0,0) | 3 ways |
| i = 2 | (1,1,0) (1,0,1) (0,1,1) | 3 ways |
| i = 3 | (1,1,1,) | 1 way |

These are determined by the number of bits of a word, not the row electrode selection patterns.

If the amplitude $V_{pixel}$ of the instantaneous voltage that is applied to the pixel had a row voltage of $V_{row}$ and column voltage of $V_{column}$, the synthesized voltage would be as follows:

$V_{pixel}=(V_{column}-V_{row})$ or $(V_{row}-V_{column})$

Where, if $V_{row}=\pm V_r$ and $V_{column}=V(i)$, then $V_{pixel}=+V_r-V(i)$ or $-V_r-V(i)$.

If $V_{row}=\pm V_r$ and $V_{column}=\pm V(i)$, then $V_{pixel}=V_r-V(i)$, $V_r+V(i)$,$-V_r-V(i)$ or $-V_r+V(i)$.

That is:

$V_{pixel}=|V_r-V(i)|$ or $|V_r+V(i)|$

As a consequence, the specific amplitude to be applied to the pixel is either $-(V_r+V(i))$ or $(V_r-V(i))$ in the selection row and is V(i) in the non-selection row.

In general, in order to achieve a high selection ratio, it is desirable that the voltage across a pixel should be as high as possible for an ON pixel and as low as possible for an OFF pixel.

As a result, when a pixel is in the ON state, the voltage $|V_r+V(i)|$ is favorable for the ON pixel, and the voltage $|V_r-V(i)|$ is unfavorable for the ON pixel. On the other hand, when a pixel is in the OFF state, the voltage $|V_r-V(i)|$ is favorable for the OFF pixel, and the voltage $|V_r+V(i)|$ is unfavorable for the OFF pixel.

Here, it is favorable for the ON pixel to increase the effective voltage and unfavorable for the ON pixel to decrease the effective voltage. The number of combinations that selects i units from among the h bits is:

Ci=hCi={h!}/{i! (h−i)!}

The total number of mismatches provides the number of unfavorable voltages in the selected rows in a column. The total number of mismatches is i·Ci in Ci row select patterns considered are equally distributed over the h pixels in the selected rows. Hence the number of unfavorable voltages per pixel (Bi) when number of mismatches is i can be obtained as given following;

Bi=i·Ci/h (units/pixel)

The number of times a pixel gets a favorable voltage during the Ci time intervals considered is:

$$Ai=\{(h-i)/h\}\cdot Ci$$

In addition:

$$\{((h-i)/h\}\cdot Ci+(i/h)\cdot Ci=(h/h)Ci=Ci$$

Accordingly, the following is obtained:

$$Ai=Ci-Bi=\{(h-1)!\}/\{i!\cdot(h-i-1)!\}$$

Where: h≦i+1

To summarize the above:

$V_{on}$ (rms)={(S1+S2+S3)/S4}$^{1/2}$ $V_{off}$ (rms)={(S5+S6+S3)/S4}$^{1/2}$ $$S_1 = \sum_{i=0}^{h} Ai\,(V_r + V(i))^2 \text{ (favorable)}$$

$$S_2 = \sum_{i=0}^{h} Bi\,(V_r - V(i))^2 \text{ (unfavorable)}$$

$$S_3 = \{(N/h) - 1\} \sum_{i=0}^{h} (Ai + Bi)V(i)^2$$

$$S_4 = 2^h \cdot (N/h)$$

$$S_5 = \sum_{i=0}^{h} Ai\,(Vr - V(i))^2 \text{ (favorable)}$$

$$S_6 = \sum_{i=0}^{h} Bi\,(Vr + V(i))^2 \text{ (unfavorable)}$$

In addition:

$V_r/V_o=N^{1/2}/h$ . . . row selection voltage

V(i)/V0=(h−2i)/h={1−(2i/h)} . . . column voltage, and $R=(V_{on}/V_{off})_{max}=\{(N^{1/2}+1)/(N^{1/2}-1)\}^{1/2}$ When plural sequentially row electrodes are simultaneously selected and driven as in prior art example described above, however, the pulse width applied to the row electrodes and column electrode also narrows as the number of simultaneously selected row electrodes increases, and picture quality deteriorates as crosstalk increases due to waveform rounding. This problem is particularly noticeable when this drive method is applied to gray scale displays using pulse width modulation.

Moreover, a liquid crystal display driven according to such a method has poor contrast between its ON and OFF states.

OBJECTS OF THE INVENTION

It is an object of the present invention to provide an apparatus that obviates the aforementioned problems of the conventional liquid crystal devices.

It is a further object of the present invention to provide a liquid crystal display for displaying a gray scale image having high image quality, simply and reliably.

It is still another object of the present invention to provide a gray scale display with a reduced number of column voltage levels.

It is an additional object of the present invention to provide a drive method, drive circuit, and display apparatus for a liquid crystal panel capable of achieving a good gray scale display even when simultaneously selecting and driving plural sequentially row electrodes.

It is still yet another object of the present invention to provide a driving method for a liquid crystal panel having reduced crosstalk.

These and other objects, features and advantages of the present invention will become more apparent upon a consideration of the following detailed description of the preferred embodiments of the present invention in conjunction with the accompanying drawings.

Although the detailed description and annexed drawings describe a number of preferred embodiments of the present invention, it should be appreciated by those skilled in the art that many variations and modifications of the present invention fall within the spirit and scope of the present invention as defined by the appended claims.

SUMMARY OF THE INVENTION

According to an aspect of the present invention, a multiplex drive method for a liquid crystal panel is provided in which the selection period is divided into plural periods, and a weighted voltage is applied in accordance with the desired display data in the divided selection periods to achieve a gray scale display.

According to another aspect of the present invention, a drive method for a liquid crystal panel is provided in which selected pulse data generated by the scan data generating circuit and display data pattern for plural simultaneously selected scan lines by means of an operating circuit is calculated. The data based on the calculation result is transferred to a column electrode driver and the scan data is simultaneously transferred to the row electrode driver to achieve a desired gray scale display.

According to a further aspect of the present invention, a liquid crystal display apparatus comprises a drive circuit for calculating selected pulse data generated by the row-select pattern generating circuit and the display data for plural simultaneously selected scan lines by means of an operating circuit. A means is provided for transferring the data based on the calculation result to the column electrode driver and for simultaneously transferring the scan data to the row electrode driver. This means also divides the selection period into plural parts and applies a weighted column voltage in accordance with the desired display data by the drive circuit to the column electrodes in each of the divided selection periods to chieve a gray scale display.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference characters denote similar elements throughout the several views.

FIG. 2 is a schematic diagram of a liquid crystal display panel depicting the displayed data;

FIG. 3A is an example of waveforms applied to row electrodes in accordance with a preferred embodiment of the present invention;

FIG. 3B is another example of waveforms applied to row electrodes in accordance with an embodiment of the present invention;

FIGS. 11A, A', B, and C show the applied voltage waveforms of a fourth embodiment of a driving method of the liquid crystal display according to the present invention;

FIGS. 12A, A', B, and C show the applied voltage waveforms of a fifth embodiment of a driving method of the liquid crystal display according to the present invention;

FIG. 31 illustrates another example of display data of a liquid crystal display panel;

FIG. 44 illustrates a liquid crystal display panel;

FIGS. 48A and 48B illustrates the row selection and column voltage waveforms that are applied to the row and column electrodes in accordance with the conventional driving method of FIGS. 47A, A', B and C.

DESCRIPTION OF THE PREFERRED EMBODIMENTS

Figure 4:
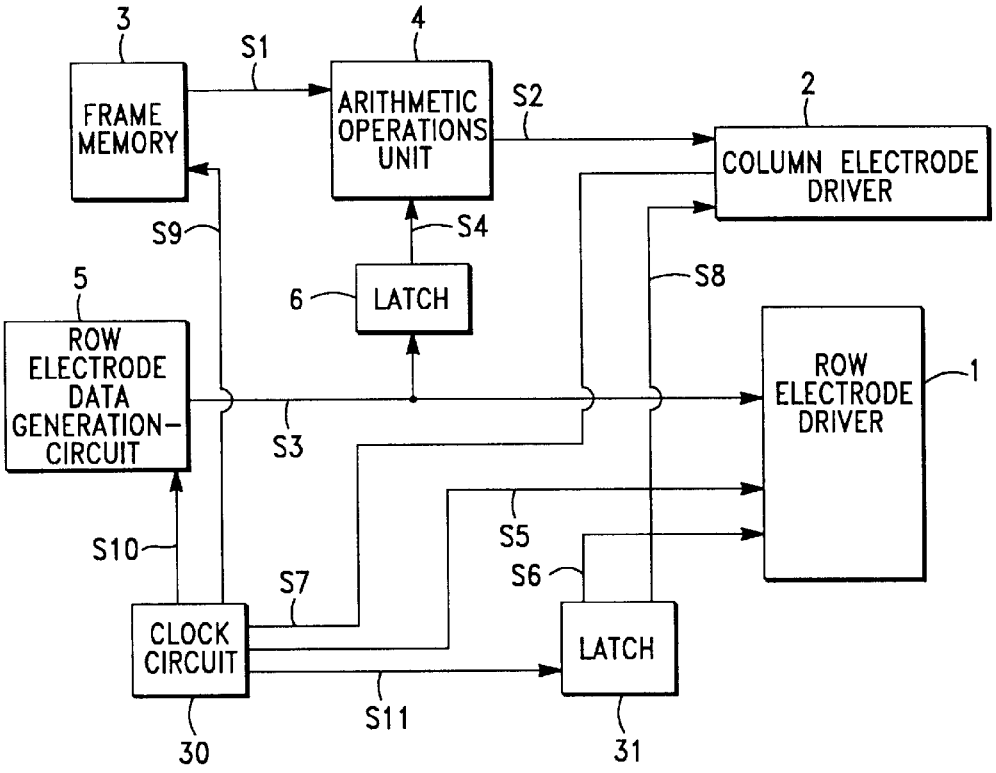
FIG. 4 is a block diagram of a driving circuit in accordance with the first embodiment of the present invention.
Figure 5:
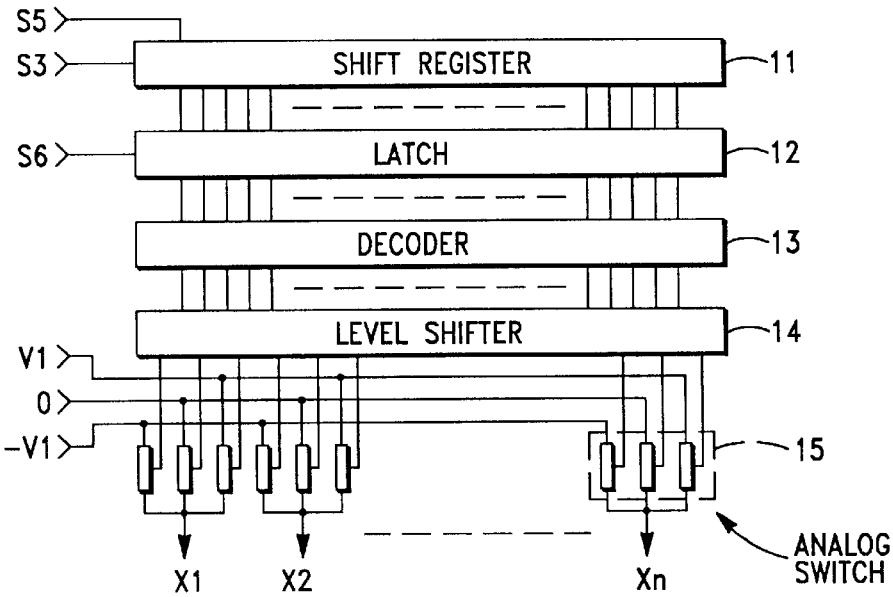
FIG. 5 is a block diagram of the row electrode driver of the row driving circuit of FIG. 4.
Figure 6:
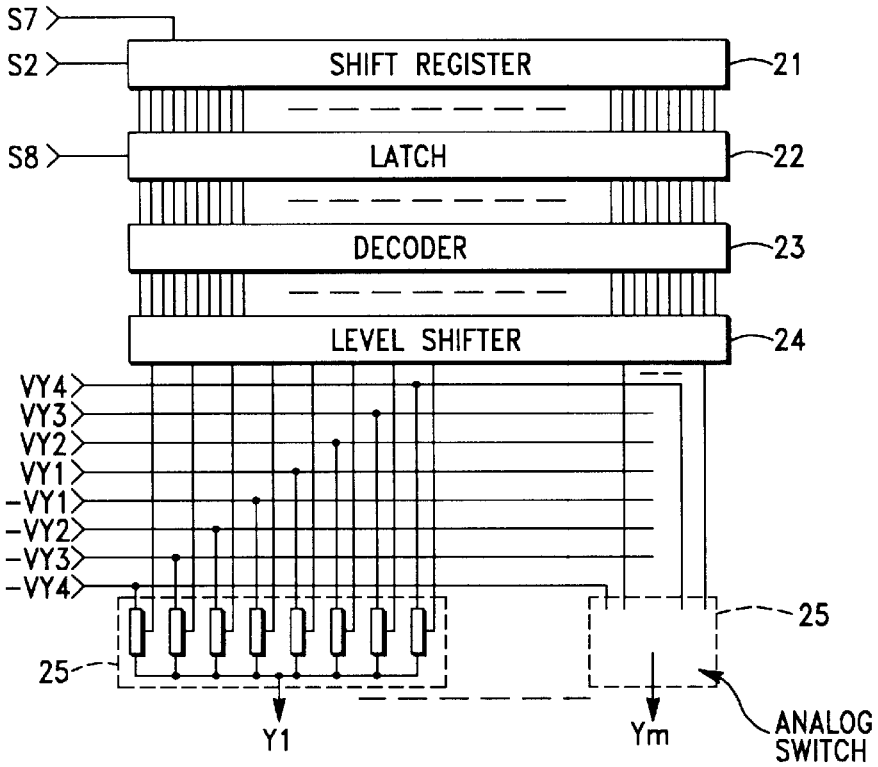
FIG. 6 is a block diagram of the column electrode driver of the column driving circuit of FIG. 4.
Figure 49:
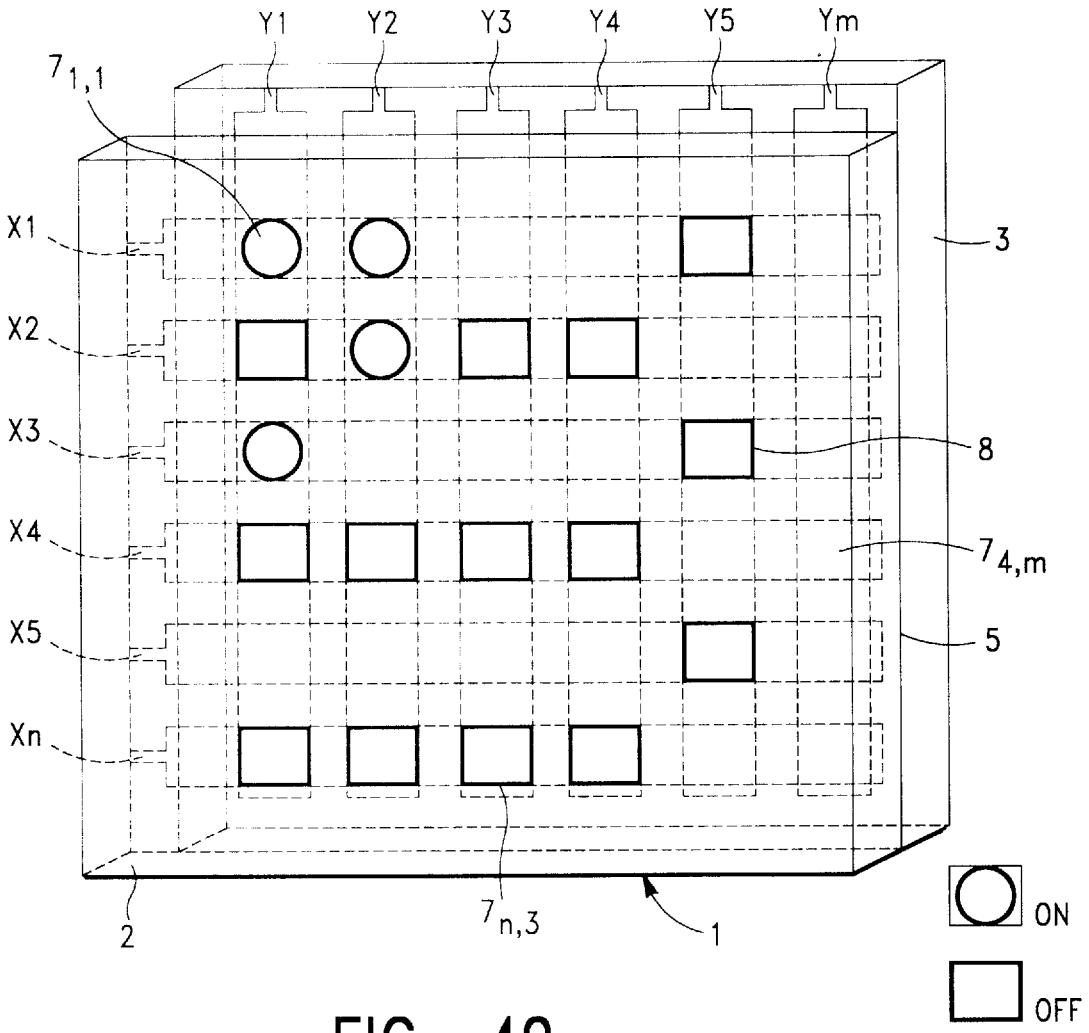
FIG.—49 (PRIOR ART)
FIG. 49 illustrates a liquid crystal display panel.

Referring to FIGS. 4–6, a preferred example of a liquid crystal panel driving circuit according to the present invention is illustrated. More specifically, FIG. 4 illustrates a preferred drive circuit, FIG. 5 illustrates a preferred row electrode driver circuit and FIG. 6 illustrates a preferred column electrode driver circuit. Of course, while the circuits of FIGS. 4–6 are preferred, persons of ordinary skill in the art who have read this description will recognize that various modifications and changes may be made therein. The driving circuit is for driving a liquid crystal display panel 1, as shown in FIG. 49. In the preferred embodiment, the liquid crystal display panel comprises m column electrodes, $Y_1$–$Y_m$, and n row electrodes, $X_1$–$X_n$. The intersections of the m column electrodes and n row electrodes form n×m pixels. In the preferred embodiment the n row electrodes are arranged in j groups of row electrodes, and each of the j groups of row electrodes comprise i row electrodes. In accordance with the invention, each of the j groups of row electrodes are selected sequentially, and each of the i row electrodes within each group are simultaneously selected. A detailed explanation of the driving method is presented hereinbelow.

Turning to FIG. 4, reference numeral 1 denotes the row electrode driver and reference numeral 2 represents the column electrode driver. Details of the row and column electrode driver circuits will be explained hereinbelow and are shown in FIGS. 5 and 6, respectively. Reference numeral 3 represents the frame memory; reference numeral 4 represents an arithmetic operations circuit; reference numeral 5 represents a row electrode data generation circuit; reference numeral 30 represents a clock circuit; reference numeral 6 represents a first latch and reference numeral 31 represents a second latch circuit.

FIG. 5 illustrates a block diagram of the row electrode driver 1. In this drawing, reference numeral 11 is a first shift register; reference numeral 12 is a third latch circuit; reference numeral 13 is a first decoder circuit; reference numeral 14 is a first level shifter; and reference numeral 15 are first analog switches.

FIG. 6 is a block diagram of the column electrode driver 2. In this drawing, reference numeral 21 is a second shift register; reference numeral 22 is a fourth latch circuit;

reference 23 is a second decoder; reference numeral 24 is a second level shifter; and reference numeral 25 are second analog switches.

The operation of the liquid crystal display panel will now be described with respect to FIGS. 4–6. Initially, a clock circuit 30 provides appropriate timing signals to row electrode generator 5, signal S10, to row driver 1, signal S5, to column driver 2, signal S7, and to second latch circuit 31, signal S11.

Row electrode generator 5 generates a row-select pattern S3 for sequentially selecting a group of row electrodes and for simultaneously selecting the row electrodes within each group to row driver 1. As shown in FIG. 5, the row select pattern is transferred to the first shift register 11 in accordance with clock signal S3. After the data for each row electrode in one scanning period has been transferred to the first shift register 11, each data is latched in the third latch circuit 12 by latch signal S6 from the second latch circuit 31. The data is then decoded by decoder 13 and the appropriate voltage level is selected by the first level shifter 14 and the first analog switches 15. The voltages selected are from among $-V_1$, 0 and $V_1$. More specifically, when a positive level has been selected, $V_1$ volts is supplied to the selected row electrodes and when a negative level has been selected, $-V_1$ volts is supplied to the selected row electrodes. During the unselected period, a voltage of zero is supplied to row electrodes. The selected voltages are applied to the row electrodes in accordance with the methods described below.

Image data generated by, for example, a CPU (not shown) is stored in frame memory 3. A display data signal S1, which corresponds to each of the row electrodes selected simultaneously, is read from memory 3 for providing each column voltage waveform. As shown in FIG. 4, the row-select pattern signal S3 is latched by the first latch circuit 6. The display data signal S1 and the latched row-select pattern data signal S4 are converted by arithmetic operations circuit 4. Data conversion by arithmetic operations circuit 4 is performed in accordance with, for example, embodiments one to twenty-two described hereinbelow. The converted data S2 is then transferred to column electrode driver 2.

Figure 4A:
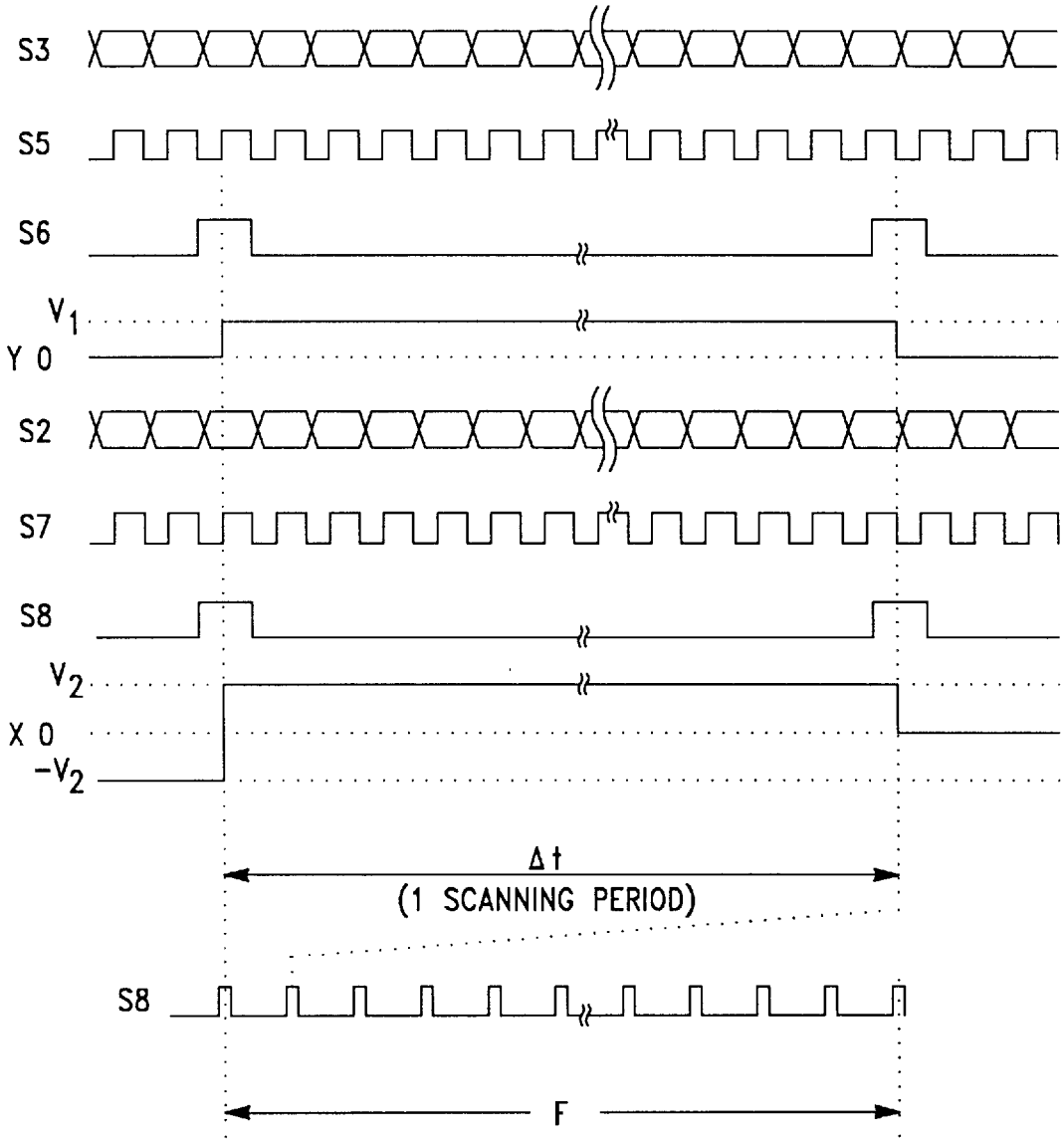
FIG. 4A is a timing diagram of the driving circuit of FIG. 4.

As shown in FIG. 6, data signal S2 from arithmetic operations circuit 4 is transferred to the second shift register 21 in accordance with shift clock signal S7. After each row electrode data during one scanning period has been transferred, each data will be latched by fourth latch circuit 22 in accordance with latch signal S8. The data is then decoded by the second decoder circuit 23. An appropriate voltage level is selected by the second level shifter 24 and second analog switches 25. In other words one of eight voltage levels is selected by analog switches 25, e.g. $V_{Y4}$, $V_{Y3}$, $V_{Y2}$, $V_{Y1}$, $^{-}V_{Y1}$, $^{-}V_{Y2}$, $^{-}V_{Y3}$, AND $^{-}V_{Y4}$. Timing diagrams of the aforementioned signals are shown in FIG. 4A.

First Embodiment

Figures 1A, 1B, 1C:
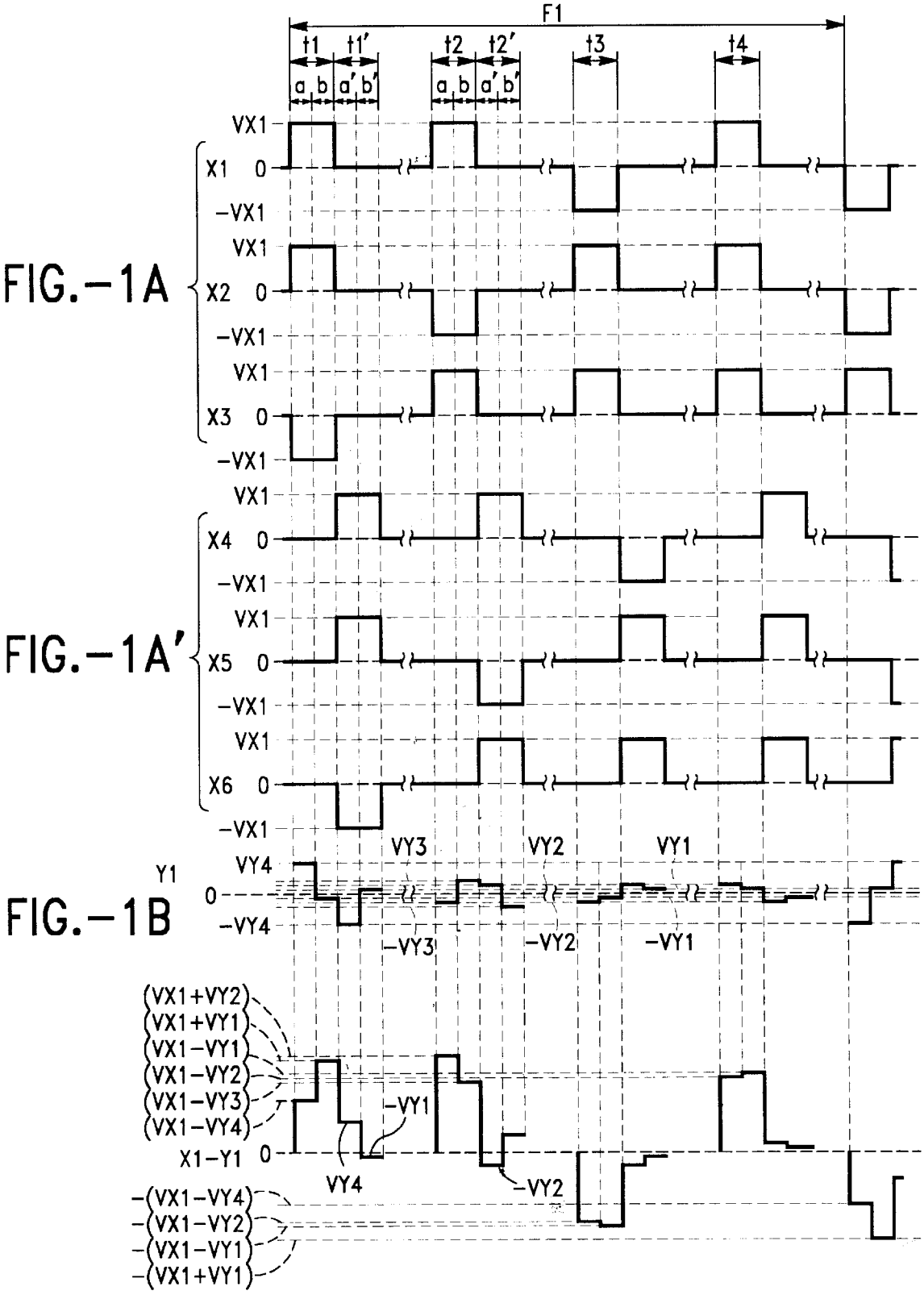
FIGS. 1A, A', B and C show applied voltage waveforms in accordance with the first embodiment of a drive method of a liquid crystal panel in accordance with the present invention.

FIGS. 1A, A', B and C illustrate a driving method for a liquid crystal display panel according to a first embodiment of the present invention. In this embodiment the selection signal is divided into plural portions during each frame period.

Referring specifically to FIG. 1A, voltage waveforms applied simultaneously to row electrodes $X_1$, $X_2$, and $X_3$, i.e. during periods $t_1$, $t_2$, $t_3$ and $t_4$ in frame period F are shown therein. During the other times during frame period F, a voltage of zero is applied to those electrodes. Similarly, waveforms applied simultaneously to row electrodes $X_4$, $X_5$, and $X_6$, i.e. during periods $t_1'$, $t_2'$, $t_3'$ and $t_4'$ in frame period F are shown in FIG. 1A', and a voltage of zero is applied to those electrodes during the remaining times of frame period F. FIG. 1B depicts the voltage waveform applied to column electrode $Y_1$. A detailed explanation of the determination of the column electrode waveform is presented hereinbelow. FIG. 1C illustrates the synthesized voltage at the pixel formed at the intersection of row electrode $X_1$ and column electrode $Y_1$.

In the preferred embodiment, therefore, the voltage waveforms applied to the row electrodes are set as described below so that the pulse width is wider, so as to overcome the problems associated with conventional driving methods.

The voltage waveforms applied to the row electrodes are decided based on the conditions that:

(1) each row electrode must be identifiable, (2) the frequency components applied to the row electrodes must not differ significantly, and (3) the AC characteristic must be maintained for one or plural frames.

In other words, the pattern of the applied voltage is appropriately determined from a natural binary, Walsh, Hadamard, or other systems of orthogonal functions considering the above conditions.

Of these conditions, the first is absolute. To satisfy this condition the voltage waveforms applied to each row electrode are generated so that the voltage waveforms applied to each of the row electrodes are orthogonal to each other.

The applied voltage waveforms shown in FIGS. 3A and B were determined considering the above conditions. The applied voltage waveforms in FIG. 3A contain different frequency components where $X_1$: $4\cdot\Delta t_0$ $X_2$: $4\cdot\Delta t_0$, $2\cdot\Delta t_0$ $X_3$: $2\cdot\Delta t_0$.

The applied voltage waveforms in FIG. 3B contain three different frequency components where $X_1$: $4\cdot\Delta t_0$, $2\cdot\Delta t_0$ $X_2$: $4\cdot\Delta t_0$, $2\cdot\Delta t_0$ $X_3$: $6\cdot\Delta t_0$, $2\cdot\Delta t_0$.

Figures 46A, 46B:
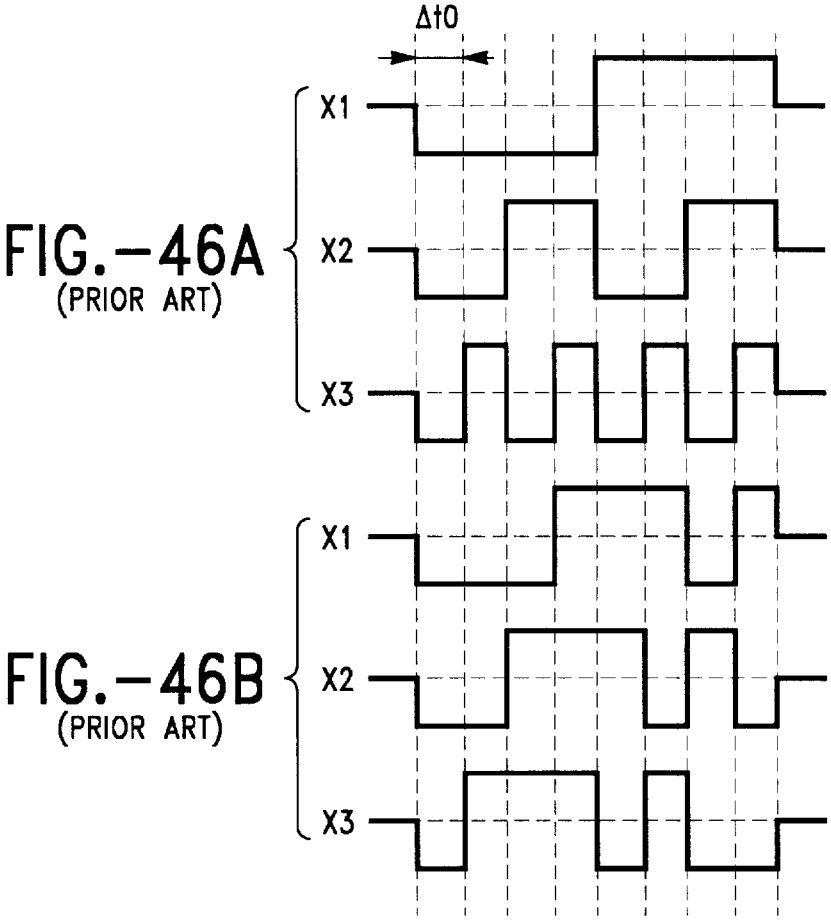
FIG.-46A (PRIOR ART)
FIG.-46B (PRIOR ART)
FIGS. 46A and 48B show the applied voltage waveforms of another conventional driving method of a liquid crystal display.
Figures 47A, 47B, 47C:
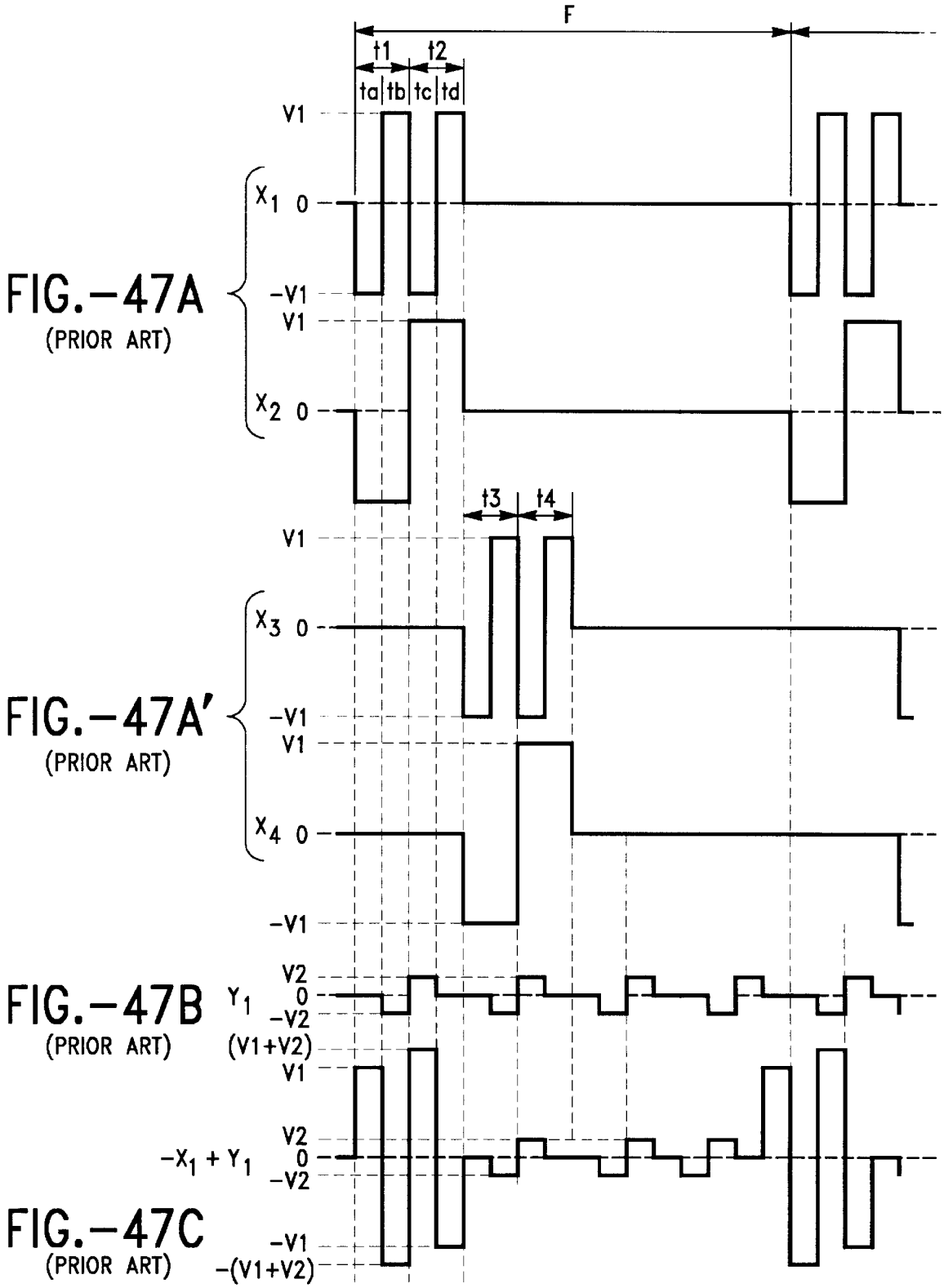
FIG.-47A (PRIOR ART)
FIG.-47A' (PRIOR ART)
FIG.-47B (PRIOR ART)
FIG.-47C (PRIOR ART)
FIGS. 47A, A', B and C show the applied voltage waveforms of another conventional driving method of a liquid crystal display.

While the shortest pulse width in the waveforms shown in FIG. 46A and B is $\Delta t_0$, the narrowest pulse width in the waveforms in FIG. 3A and B is $2\Delta t_0$, an increase of two times. It is thus possible to reduce the effects of waveform rounding, decrease crosstalk, and increase the number of simultaneously selected row electrodes by increasing the pulse width.

It is to be noted that the waveforms shown in FIG. 3A and B are but one example and can be changed as appropriate. In particular, the row electrode selection sequence and sequence of the row select patterns applied to the row electrodes can also be changed using the properties of the systems of orthogonal functions.

The row voltage waveform shown in FIG. 1A and A' form the voltage waveforms applied to the three simultaneously selected row electrodes based on the waveforms in FIG. 3B. In addition, in this embodiment, the selection period is divided and driven in four portions i.e., $t_1$, $t_2$, $t_3$, and $t_4$ in one frame period F. In other words, the first portion is applied sequentially to each group of the row electrodes and simultaneously to each electrode within each group, the second portion is applied sequentially to each group of the row electrodes and simultaneously to each electrode within each group, the third portion is then applied sequentially to each group of the row electrodes and simultaneously to each electrode within each group and, finally, the fourth portion is applied sequentially to each group of the row electrodes and simultaneously to each electrode within each group. The application of the four portions of the waveforms to all the row electrodes is conducted during one frame period.

Figure 23A:
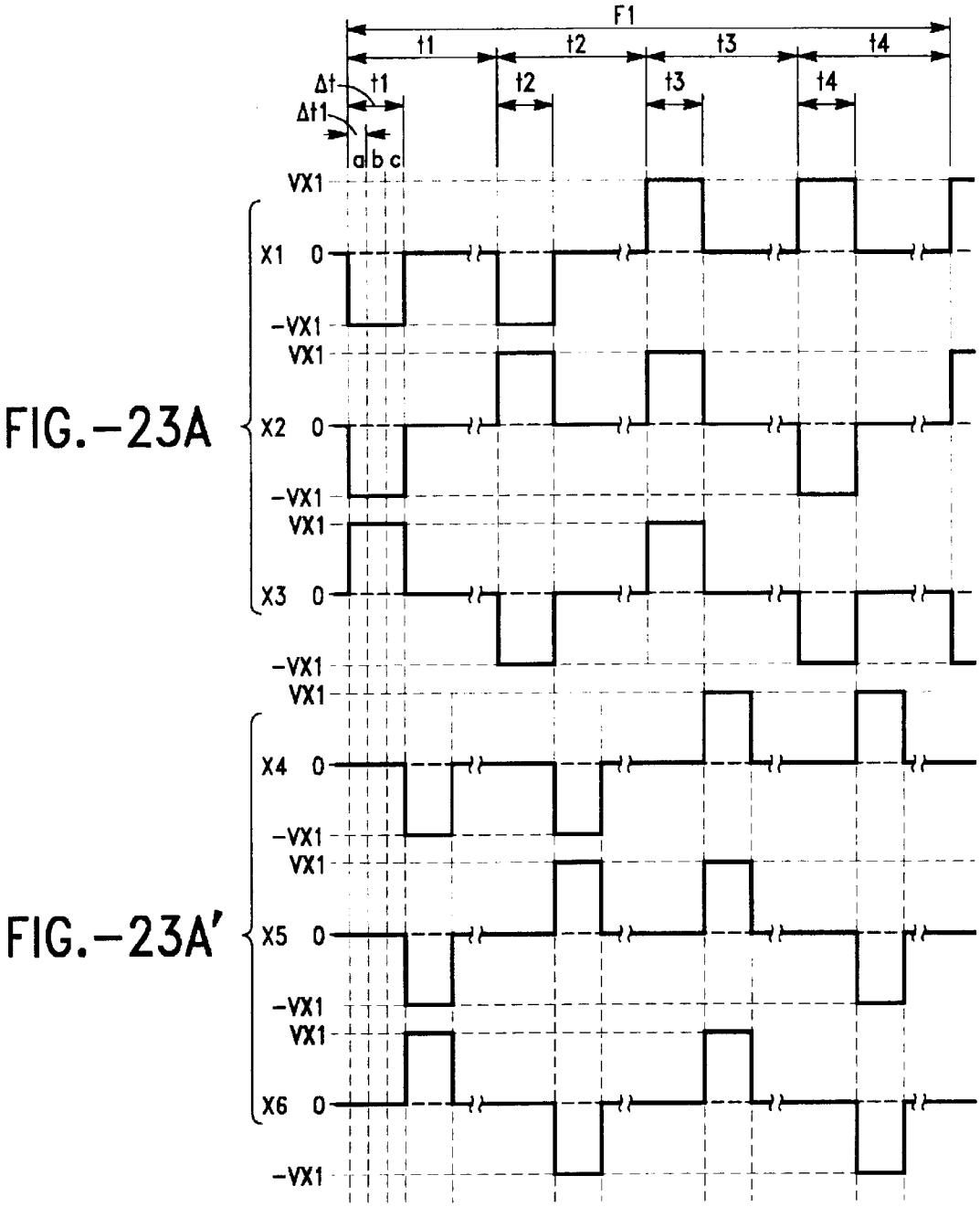
FIGS. 23A, A', B and C show the applied voltage waveforms of a twelfth embodiment of a driving method of the liquid crystal display according to the present invention.

More specifically, the first group of row electrode comprising row electrodes $X_1$, $X_2$, $X_3$ are simultaneously selected in period t1. Row selection voltage waveforms in that time interval similar to those in FIG. 23A are applied in time interval $t_1$. At the same time, a column voltage waveform selected in accordance with the method described above is applied to each column electrode, $Y_1$ to $Y_m$. In the present embodiment, row electrodes $X_4$, $X_5$ and $X_6$ are then selected with the row selection voltage waveforms shown in FIG. 1A'. At the same time column voltages are applied in the same manner to each column electrode, $Y_1$ to $Y_m$. This process is repeated until all of the row electrodes have been selected.

As is readily apparent, all of the row electrodes are selected four times in one frame period F. That is, an image or one screen is displayed when each row electrode is selected four times.

Each of the selection periods $t_1$, $t_2$, $t_3$, $t_4$ as described above is further divided into plural portions as shown in FIG. 1C, and in each of these divided periods weighted voltage data is applied to the column electrodes $Y_1$–$Y_m$ to obtain a desired display having a gray scale.

In other words, in this embodiment, period $t_1$ is divided into two equal parts to form the two periods ta and tb, a column voltage specifically weighted for each bit based on the display data shown in FIG. 2 and expressing a four gray scale display with two bits in a binary format is applied during period a for the high or most significant bit and to period b for the low or least significant bit as shown in FIG. 1C.

The column voltage waveforms are determined in a similar manner as discussed above. Specifically, if voltage $V_{X1}$ is applied to the row electrode in each ON state, $-V_{X1}$ is applied in each OFF state, and the display data value is 0 when OFF and 1 when ON, and the ON/OFF states of the simultaneously selected row electrodes and the ON/OFF state of the display data are compared bit by bit to calculate the number of mismatches. The voltages applied for the high or most significant bit when the number of mismatches is 3, 2, 1, and 0 are $V_{Y4}$, $V_{Y2}$, $-V_{Y2}$, and $-V_{Y4}$, the voltages applied for the low or the least significant bit when the number of mismatches is 3, 2, 1, and 0 are $V_{Y3}$, $V_{Y1}$, $-V_{Y1}$, and $-V_{Y3}$, respectively. In other words a weighted voltage is applied to the column electrodes. In the presently preferred embodiment the relationship between each of the voltage levels are:

$2*V_{Y1}=V_{Y2}$ $2*V_{Y3}=V_{Y4}$ $2*V_{Y1}=V_{Y3}-V_{Y1}$

2*VY2=VY4−VY2.

For example, during period $t_1$ in FIG. 1C, the selected pulses applied to row electrodes $X_1$, $X_2$, and $X_3$ are ON, ON, OFF, respectively, the display data for the pixels at the intersections of column electrode $Y_1$ and row electrodes $X_1$, $X_2$, and $X_3$ are (00), (01), (10). In particular, the high or most significant bits are OFF, OFF, ON, respectively. the number of mismatches is three, and voltage $V_{Y4}$ is therefore applied to the column electrode $Y_1$ in period ta. The low or least significant bits are OFF, ON, OFF, respectively, and the number of mismatches is one. Therefore a voltage of $-V_{Y1}$ is therefore applied in period tb.

Thus, the display data on the row electrodes $X_1$, $X_2$, and $X_3$ are compared with the selected pulses applied to the row electrodes for each of the column electrodes Y1–$Y_m$, and a column voltage corresponding to the number of mismatches is applied.

Next, row electrodes $X_4$, $X_5$, and $X_6$ are simultaneously selected and the corresponding column electrode waveform is applied to the column electrodes. When the sequence of simultaneously selecting the row electrodes three lines at a time and applying the corresponding column electrode waveform to the column electrodes until all row electrodes $X_1$–$X_n$ have been scanned is completed, the operation returns to the first group of row electrodes $X_1$, $X_2$, and $X_3$ and the specified voltages are sequentially applied following the above sequence in periods $t_2$, $t_3$, and $t_4$. When all row electrodes $X_1$–$X_n$ have been selected in each of the four periods $t_1$–$t_4$, the row electrodes are selected in succeeding frames in a similar manner. Note that the polarity of the applied voltage is reversed in each frame in this embodiment for so-called alternating current drive scheme.

A good gray scale display with minimal crosstalk can thus be achieved by driving as described above.

It is to be noted that the sequence of the row voltage waveforms applied to the row electrodes in the above periods $t_1$–$t_4$ can be changed for all frames or in single frames, and the waveforms shown in FIG. 3A or other waveforms satisfying the conditions described above can be used as the row voltage waveforms applied to the row electrodes. Moreover, two waveforms can alternately used for each group of simultaneously selected row electrodes, for example using the waveform shown in FIG. 3A for row electrodes $X_1$–$X_3$ and the waveform shown in FIG. 3B for row electrodes $X_4$–$X_6$, or a sequence of three or more waveforms can be used alternately. In addition, it is also possible to combine reordering the waveforms in periods $t_1$–$t_4$ with reordering the waveforms for the groups of simultaneously selected row electrodes.

While the periods $t_1$–$t_4$ can be driven separately in each period as in the above embodiment, or can be driven consecutively in one frame, if the selection period is driven in plural parts within one frame as in the present embodiment, the unselected selection period becomes shorter and contrast can be improved. In this case, while the selection period is divided into four parts $t_1$–$t_4$ in the above embodiment, any number of divisions can be used. For example, periods $t_1$–$t_4$ can be divided and driven in two parts, or can be divided and driven in more than two parts.

In addition, row electrodes are selected three at a time in sequence of position in the above embodiment, but the number of the selected row elements is an appropriate number and the row electrode do not necessarily need to be selected in sequence of position.

The above changes can also be applied to the alternative embodiments described below.

As understood by one of ordinary skill in the art, the method for driving a liquid crystal display panel can be implemented by the circuit illustrated in FIGS. 4–6 previously described.

Second Embodiment

As described above in the first embodiment, one of four voltage levels is selected according to the display data and applied to the column electrodes for each bit of the display data. However, the number of levels can be reduced by implementing the following method. By reducing the number of voltage levels, a driving circuit can be fabricated which is simpler, less expensive and more reliable.

Initially, a description will be given based on the general methods of reducing the number of previously mentioned voltage levels.

In this embodiment, subgroup h comprises a virtual line e. Line e is a virtual electrode and its sole purpose is for determining the voltage levels applied to the column electrodes. There is no requirement that the virtual electrode is to be fabricated on the liquid crystal display panel. However the virtual electrode may be fabricated in a non-display area of the display panel.

The number of voltage levels may be reduced by controlling the number of matches and mismatches of the virtual row electrode data. As a result, the total number of matches and number of mismatches will be limited, and the number of drive voltage levels for column electrodes will be reduced.

With Mi representing the number of mismatches and Vc representing the appropriate constant, $V_{column}$, the applied voltage to the column electrode, is be as follows:

$$\begin{aligned} V_{column} &= V_c \sum_{j=1}^{h} a_{k*h+j} \oplus d_{k*h+j} \\ &= V_c(2Mi - h)\ (V_c\text{: constant}) \end{aligned}$$

or, more simply:

$V_{column}=V(i)\ (0 \leqq i \leqq h)$

In either case, $V_{column}$ is the h+1 level.

Figure 8:
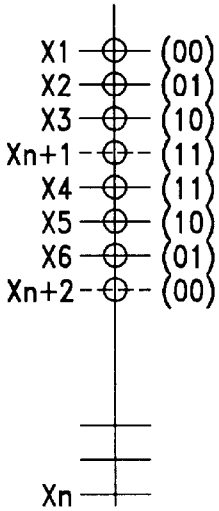
FIG. 8 illustrates an example of display data of a liquid crystal display panel having at least one virtual electrode.
Figures 7A, 7B, 7C:
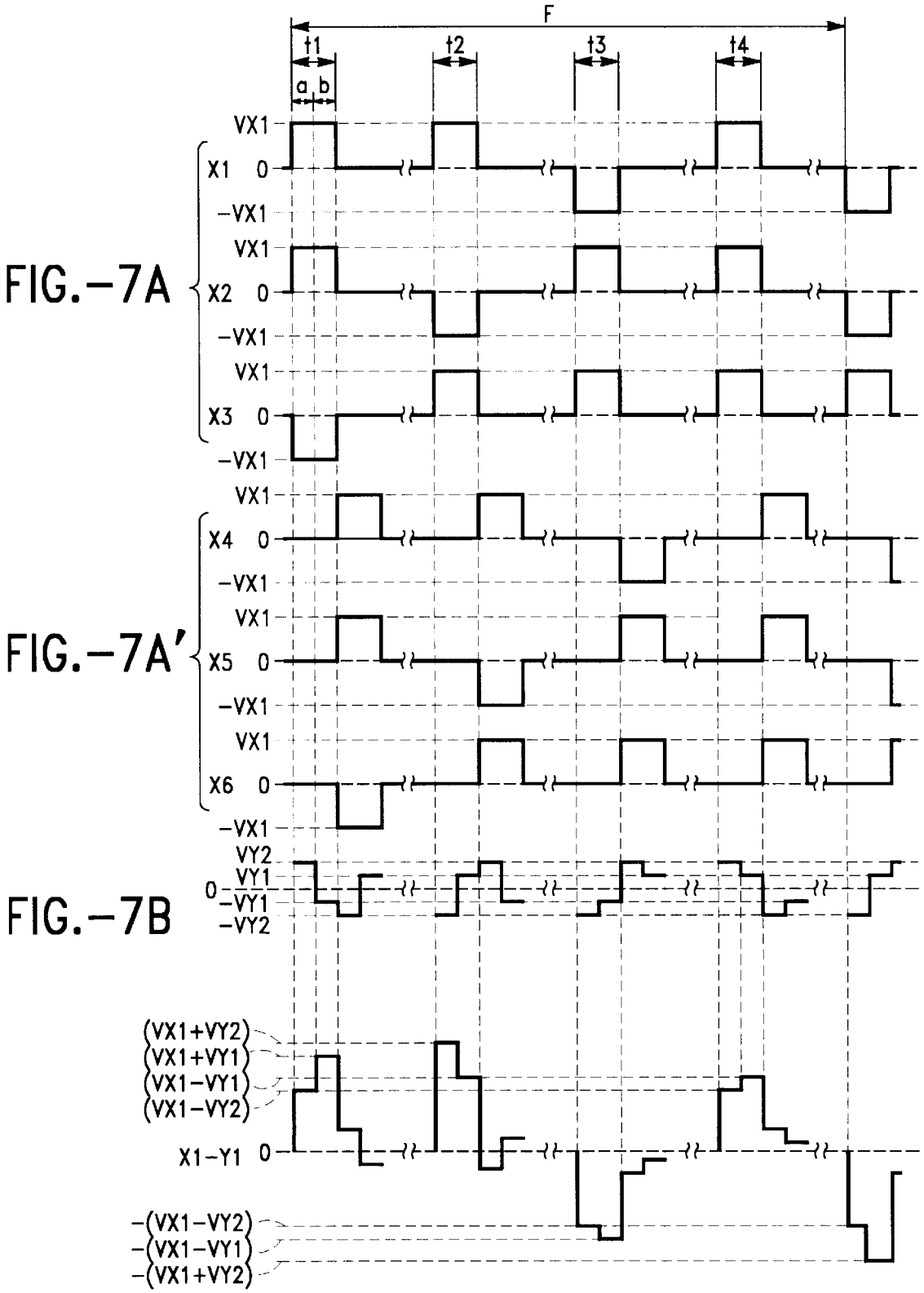
FIGS. 7A, A', B and C show the applied voltage waveforms of a second embodiment of a driving method of the liquid crystal display according to the present invention.

Referring to FIGS. 7A, A', B and C, a driving method in accordance with the second embodiment is shown therein having voltage waveforms applied to the column electrodes and the row electrodes. As shown in FIG. 8, the row electrodes include virtual electrodes $X_{n+1}, X_{n+2}, \ldots X_{n+p}$. At least one virtual electrode is simultaneously selected along with, for example, row electrodes $X_1$, $X_2$, and $X_3$. The number of mismatches is calculated as in the first embodiment described above. As in the first embodiment voltage $V_{X1}$ is applied to the row electrode in each ON state, $-V_{X1}$ is applied in each OFF state, and the display data value is 0 when OFF and 1 when ON. Assuming in this embodiment, the number of mismatches is always 1 or 3 which is accomplished by appropriately changing the display state of the virtual electrode.

In the second embodiment, when the number of mismatches between the display data and the high or most significant bit is 1, $-V_{Y2}$ is selected, and when the number of mismatches is 3, $V_{Y2}$ is selected; when the number of mismatches between the display data and the low or least significant bit is 1, $-V_{Y1}$ selected, and when the number of mismatches is 3, $V_{Y1}$ is selected. It is preferable that the relationship between each of the voltage levels is $2 \cdot V_{Y1} = V_{Y2}$.

The display shown in FIG. 8 is achieved by the waveforms in FIGS. 7A, A', B and C applying the above principle. Referring specifically to FIG. 7A, during period $t_1$, the selected pulses applied to row electrodes $X_1$, $X_2$, $X_3$ and virtual electrode $X_{n+1}$ are ON, ON, OFF, ON, respectively, and as shown in FIG. 8, the display data for the pixels at the intersections of column electrode $Y_1$ and row electrodes $X_1$, $X_2$, $X_3$ and virtual electrode $X_{n+1}$ are (00), (01), (10), (11). In other words the high bits are OFF, OFF, ON, ON, and the low bits are OFF, ON, OFF, and ON, respectively. Sequential comparison shows the number of mismatches is three; conversion data S2 is therefore generated according to this number of mismatches, and voltage $V_{Y2}$ is therefore applied to the column electrode $Y_1$ in period a.

As noted above, the low bits are OFF, ON, OFF, ON, and the number of mismatches determined is one. Accordingly, conversion data S2 is therefore generated according to this number of mismatches, and voltage $-V_{Y1}$ is therefore applied in period b.

Thus, the display data on the row electrodes $X_1$, $X_2$, $X_3$ and virtual electrode $X_{n+1}$ is compared with the selected pulses applied to the row electrodes for each of the column electrodes $Y1-Y_m$, and a column voltage corresponding to the number of mismatches is applied.

Next, row electrodes $X_4$, $X_5$, $X_6$ and $X_{n+2}$ are simultaneously selected and the corresponding column electrode waveform is applied to the column electrodes. The column voltage waveform is determined in a similar manner. When the sequence of simultaneously selecting the row electrodes three lines at a time plus one virtual electrode line and applying the corresponding column electrode waveform to the column electrodes until all row electrodes to $X_n$ have been scanned is completed, the operation returns to the first group of row electrodes $X_1$, $X_2$, and $X_3$ and sequential scanning using the row select pattern shown in $t_2$ continues. One frame period is completed by scanning four times with the row select patterns shown in $t_1$, $t_2$, $t_3$, and $t_4$, and the same operation is repeated in the next frame.

By thus providing a virtual electrode as above, the number of voltage levels applied to the column electrodes can be made less than that of the first embodiment.

It will be apparent to one of ordinary skill in the art, that the technique of reducing the number of voltage levels applied to the column electrodes by means of a virtual electrode, as described above, can also be applied to each of the embodiments described below.

Moreover, it will appreciated that the same driving circuit used in the first embodiment may be used in the second embodiment and each of the embodiments described below. In the second embodiment, the arithmetic operation circuit 4 in FIG. 4 is designed to execute data processing to drive the liquid crystal display panel in accordance with each of the embodiments. The voltage levels of the row electrode driver in FIG. 5 are selected by analog switch 15, and the voltage levels of the column electrode driver in FIG. 6 are selected by analog switch 25.

In this embodiment, for example, the arithmetic operation circuit 4 in FIG. 4 and the row electrode driver in FIG. 5 are the same as those of the first embodiment, but while eight voltage levels $V_{Y4}$, $V_{Y3}$, $V_{Y2}$, $V_{Y1}$, $-V_{Y1}$, $-V_{Y2}$, $-V_{Y3}$, and $-V_{Y4}$ are provided in the column electrode driver of the first embodiment in FIG. 6, it is sufficient to provide four voltage levels $V_{Y2}$, $V_{Y1}$, $-V_{Y1}$, and $-V_{Y2}$ in the second embodiment. Accordingly since four fewer voltage levels are required, the driving circuit is simpler, less expensive and more reliable.

Third Embodiment

The first and second embodiments, described above, achieve a gray scale display by changing the voltage value or applying a weighted voltage in accordance with the display data. It is also contemplated to achieve a gray scale display by varying the pulse width of either the voltage applied to the column or row electrodes. The technique of varying the pulse width is known as pulse width modulation.

Figures 9A, 9B, 9C:
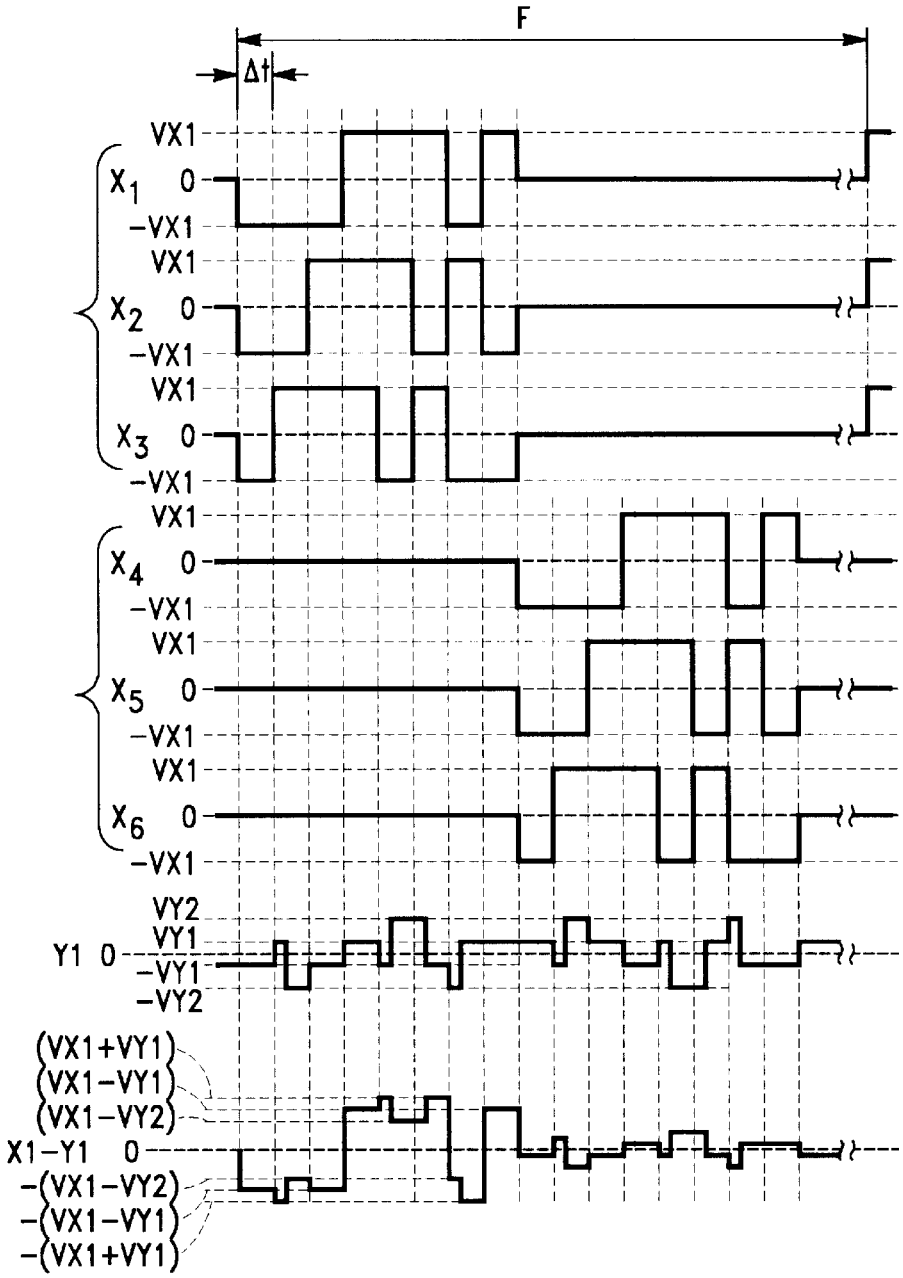
FIGS. 9A, A', B and C show the applied voltage waveforms of a third embodiment of a driving method of the liquid crystal display according to the present invention.

Referring specifically to FIGS. 9A, A', B and C, the third embodiment is shown therein employing a pulse width modulation technique for achieving a gray scale display.

The general procedure for achieving a gray scale display by means of pulse width modulation is now described with reference to FIG. 10.

In general, the period Δt of each pulse is divided into f periods of preferably of unequal duration to achieve a gray scale display by means of pulse width modulation.

$$\Delta t_g = 2^{g-1}/(2^f - 1)$$

where f is the bit number of gradations.

Figure 10:
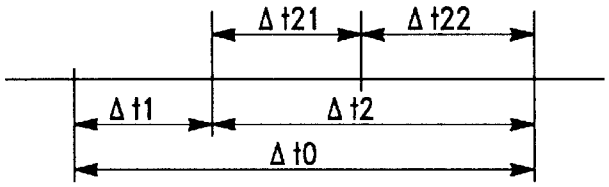
FIG. 10 illustrates the relationship of the time periods used to achieve a gray scale display by means of a pulse width modulation method.

For example, if f=2, there are $2^2=4$ gradations, and the period is divided:

$\Delta t_1=(1/3)\Delta t_0$ $\Delta t_2=(2/3)\Delta t_0$ as shown in FIG. 10.

The data is then divided into f bits (expressed as f bits).

$d_1=(d_{1,f}, d_{1,f-1} \ldots d_{1,1})$ $d_2=(d_{2,f}, d_{2,f-1} \ldots d_{2,1})$ $d_h=(d_{h,f}, d_{h,f-1} \ldots d_{h,l})$ Each bit of the row electrode selection patterns and the data patterns are then compared at an interval of $\Delta t_g$.

For example, when f=2, $d_1=(d_{1,2}, d_{1,1})$ $d_2=(d_{2,2}, d_{2,1})$

The low or least significant bit ($d_{1,l}$) of $d_1$ and the row electrode selection pattern are first compared, and applied to the display for period $\Delta t_1$ in a similar manner described hereinabove. The high or most significant bit, for example, bit $d_{1,2}$ and the row electrode selection pattern is then compared and applied to the display for period $\Delta t_2$.

As is apparent to those who have read this description, this procedure is sequentially repeated as above for each bit d.

The embodiment illustrated in FIGS. 9A, A', B and C achieves a four gray scale display of the data shown in FIG. 2 using the pulse width modulation technique as described above.

Figures 45A, 45B, 45C, 45D:
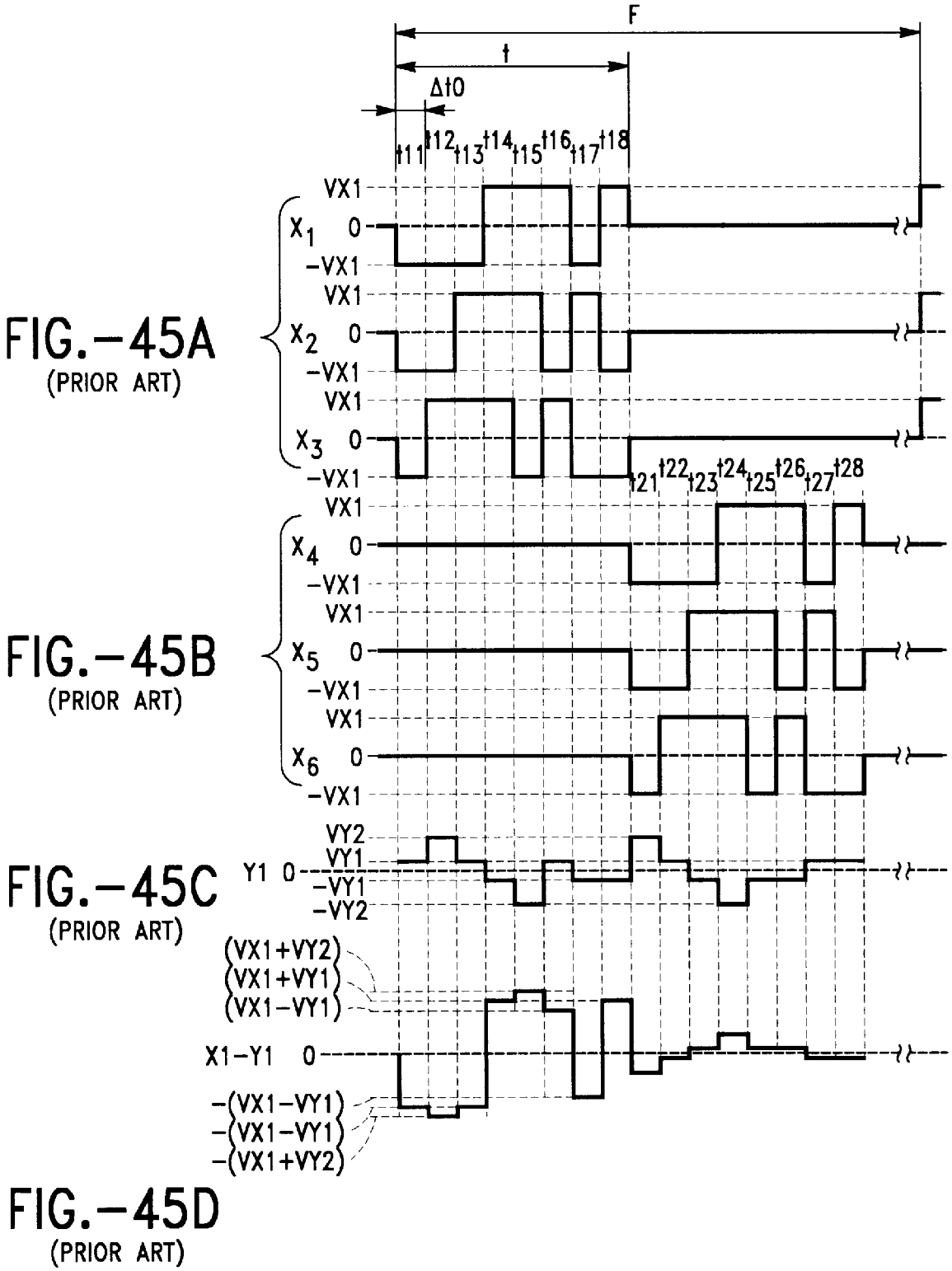
FIG.-45A (PRIOR ART)
FIG.-45B (PRIOR ART)
FIG.-45C (PRIOR ART)
FIG.-45D (PRIOR ART)
FIGS. 45A–D show the applied voltage waveforms of another conventional driving method of a liquid crystal display.

In this example, the row voltage applied to the row electrodes $X_1$–$X_n$ is the same as in the example illustrated in FIG. 45, and the pulse widths of the corresponding column electrodes $Y_1$–$Y_m$ are modulated according to the gray scale display as above.

More specifically, the display data has a gray scale defined by four gradations 0–3 using a 2-bit binary display data, e.g. (00), (01), (10), (11). Accordingly, each pulse width $\Delta t$ is divided into three equal parts, e.g. $\Delta t_1$, $\Delta t_{21}$ and $\Delta t_{22}$. Furthermore, as shown in FIG. 10, applicants define $\Delta t_2=\Delta t_{21}+\Delta t_{22}$. The column voltage level of two of the three pulse width parts is determined based on the number of mismatches between the on/off state of the simultaneously selected row electrodes and the high bit state of the display data. The signal voltage level of the remaining one part is determined based on the number of mismatches between the ON/OFF state of the row electrodes and the low bit state. Variations in the brightness of the gray scale display can also be corrected by equally reducing the three parts.

Specifically, if in FIGS. 9A, A', B and C an ON state is achieved by applying voltage $V_{X1}$ to the row electrode and an OFF state by applying voltage $-V_{X1}$, the first pulse applied to the row electrodes $X_1$, $X_2$, and $X_3$ generates an OFF state for all three row electrodes. Because a low bit value of 0 indicates an OFF state and a low bit value of 1 an ON state in the display data for the row electrodes $X_1$, $X_2$, and $X_3$ in FIG. 2, the corresponding states are OFF, ON, OFF. The number of mismatches is therefore one, and the voltage pulse during period $\Delta t_1$ is $-V_{Y1}$. In this example, the high bit states are OFF, OFF, ON, and, accordingly, the number of mismatches is one, and the voltage pulse during period $\Delta t_2$ is $-V_{Y1}$. It is thus sufficient to obtain the voltage pulse applied to the column electrodes by a comparison executed each selection period $\Delta t$.

In this embodiment, the voltage for the high bit is applied during the latter two of the three period divisions, and the voltage for the low bit is applied during the first of the three period divisions.

Fourth Embodiment

FIGS. 11A, A', B and C depict the fourth embodiment of the present invention. The fourth embodiment is similar to the third embodiment, in that width of the column voltage is varied to obtain a gray scale. Another feature of the fourth embodiment is that the selection period is divided into plural portions within each frame period. This feature is similar to the first embodiment described above. While it will be understood, that in this embodiment the selection period is preferably divided into eight portions, for a matter of convenience, only five portions are illustrated in FIGS. 11A, A', B and C.

Referring specifically to FIG. 11A, voltage waveforms applied simultaneously to row electrodes $X_1$, $X_2$, and $X_3$, i.e. during periods $t_1$–$t_8$ (period $t_5$–$t_8$ are not shown) in frame period F are shown therein. During the other times during frame period F, a voltage of zero is applied to those electrodes. Similarly, waveforms applied simultaneously to row electrodes $X_4$, $X_5$, and $X_6$, i.e. during periods $t_1'$–$t_8'$, $t_3'$ and $t_4'$ in frame period F are shown in FIG. 11A', and a voltage of zero is applied to those electrodes during the remaining times of frame period F. FIG. 11B depicts the voltage waveform applied to column electrode $Y_1$. A detailed explanation of the determination of column electrode waveform is presented hereinbelow. FIG. 11C illustrates the synthesized voltage at the pixel formed at the intersection of row electrode $X_1$ and column electrode $Y_1$.

The column voltages are determined similarly as in the third embodiment. As noted above, the display data has a gray scale defined by four gradations 0–3 using a 2-bit binary display data, e.g. (00), (01), (10), (11). Accordingly, each pulse width $\Delta t$ is divided into three equal parts, e.g. $\Delta t_1$, $\Delta t_{21}$ and $\Delta t_{22}$. Furthermore and as shown in FIG. 10, applicants define $\Delta t_2=\Delta t_{21}+\Delta t_{22}$. The column voltage level of two of the three pulse width parts is determined based on the number of mismatches between the on/off state of the simultaneously selected row electrodes and the high bit state of the display data. The signal voltage level of the remaining one part is determined based on the number of mismatches between the ON/OFF state of the row electrodes and the low bit state. Variations in the brightness of the gray scale display can also be corrected by equally reducing the three parts.

Specifically, if in FIGS. 11A, A', B and C an ON state is achieved by applying voltage $V_{X1}$ to the row electrode and an OFF state by applying voltage $-V_{X1}$, the first pulse applied to the row electrodes $X_1$, $X_2$, and $X_3$ in period $t_1$ generates an OFF state for all three row electrodes. Because a low bit value of 0 indicates an OFF state and a low bit value of 1 an ON state in the display data for the row electrodes $X_1$, $X_2$, and $X_3$ in FIG. 2, the corresponding states are OFF, ON, OFF. The number of mismatches is therefore one, and the voltage pulse during period $t_1$ is $-V_{Y1}$. In this example, the high bit states are OFF, OFF, ON, and, accordingly, the number of mismatches is one, and the voltage pulse during period $t_2$ is $-V_{Y1}$. It is thus sufficient to obtain the voltage pulse applied to the column electrodes by a comparison executed each selection period t.

In accordance with the fourth embodiment, when the liquid crystal elements are driven by dividing the selection period into plural parts in one frame as described above, the contrast can be improved as in the previous embodiment.

Fifth Embodiment

FIGS. 12A, A', B and C illustrate the fifth embodiment of the present invention. The fifth embodiment is similar to the third embodiment, e.g. the selection period is divided into plural portions and the width of the column voltage is varied to achieve a gray scale display. However, in the fifth embodiment at least one virtual electrode is employed to reduce the number of voltage levels. In the third and fourth embodiments, four voltage levels $V_{Y2}$, $V_{Y1}$, $-V_{Y1}$, and $-V_{Y2}$ are used as the column electrode voltage levels, but this number of voltage levels can be further reduced by providing a virtual electrode as in the second embodiment.

FIG. 12 A, A', B and C show an example that provides a virtual electrode in the third embodiment to reduce the number of voltage levels applied to the column electrode, and is driven by dividing the selection period in to plural parts within one frame as in the fourth embodiment.

Reducing the number of voltage levels by providing a virtual electrode as described above has already been described in the second embodiment, but is described further below, including the general methodology.

First, of the h row electrodes in each subgroup, e column electrodes are operated as virtual row electrodes (virtual lines). By controlling the data matching/mismatching of these virtual row electrodes, the overall number of matches/mismatches can be controlled, and the number of drive voltage levels for the column electrodes can be reduced.

If the number of mismatches is Mi and Vc is an appropriate constant, the voltage $V_{column}$ applied to the column electrode is defined as $$\begin{aligned} V_{column} &= V_c \sum_{j=1}^{h} a_{k*h+j} \oplus d_{k*h+j} \\ &= V_c(2Mi - h)\ (V_c\text{: constant}) \end{aligned}$$

or simply $V_{column}$=V(i)
where 0≦i≦h.

In any event, $V_{Column}$ is h+1 levels.

The case where the number of subgroups h=4 and the number of virtual row electrodes e=1 is considered by way of example below.

As in the previous embodiment, the number of levels when h=3 is four ($-V_{Y2}$, $-V_{Y1}$, $V_{Y1}$, $V_{Y2}$). If the number of mismatches is controlled using the virtual row electrodes to be an even number, the resulting voltage levels are shown in the following table.

| Original voltage level | Original number of mismatches | Virtual row electrode | Number of mismatches after correction | Voltage level after correction |
|---|---|---|---|---|
| $-V_{Y2}$ | 0 | Match | 0 | Va |
| $-V_{Y1}$ | 1 | Mismatch | 2 | Vb |
| $V_{Y1}$ | 2 | Match | 2 | Vb |
| $V_{Y2}$ | 3 | Mismatch | 4 | Vd |

As shown in the above table, the original four voltage levels can be reduced to three. If the number of mismatches is controlled to be odd, the number of mismatches after correction will change in the above table to 1, 1, 3, 3 (from the top), and there will be only two voltage levels (Va, Va, Vb, Vb from the top) after correction.

If the number of subgroups h=4 and the number of unreduced voltage levels is therefore five ($-V_{Y2}$, $-V_{Y1}$, 0, $V_{Y1}$, $V_{Y2}$), controlling the number of mismatches to be an even number using the virtual row electrodes results in the voltage levels shown in the following table.

| Voltage levels before reduction | Number of mismatches before reduction | Virtual line | Number of mismatches after correction | Voltage level after correction |
|---|---|---|---|---|
| $-V_{Y2}$ | 0 | Match | 0 | Va |
| $-V_{Y1}$ | 1 | Mismatch | 2 | Vb |
| 0 | 2 | Match | 2 | Vb |
| $V_{Y1}$ | 3 | Mismatch | 4 | Vd |
| $V_{Y2}$ | 4 | Match | 4 | Vd |

The original number of voltage levels can thus be reduced from five to three. Note that the voltage levels can also be set by controlling the number of mismatches to be odd.

Figure 13:
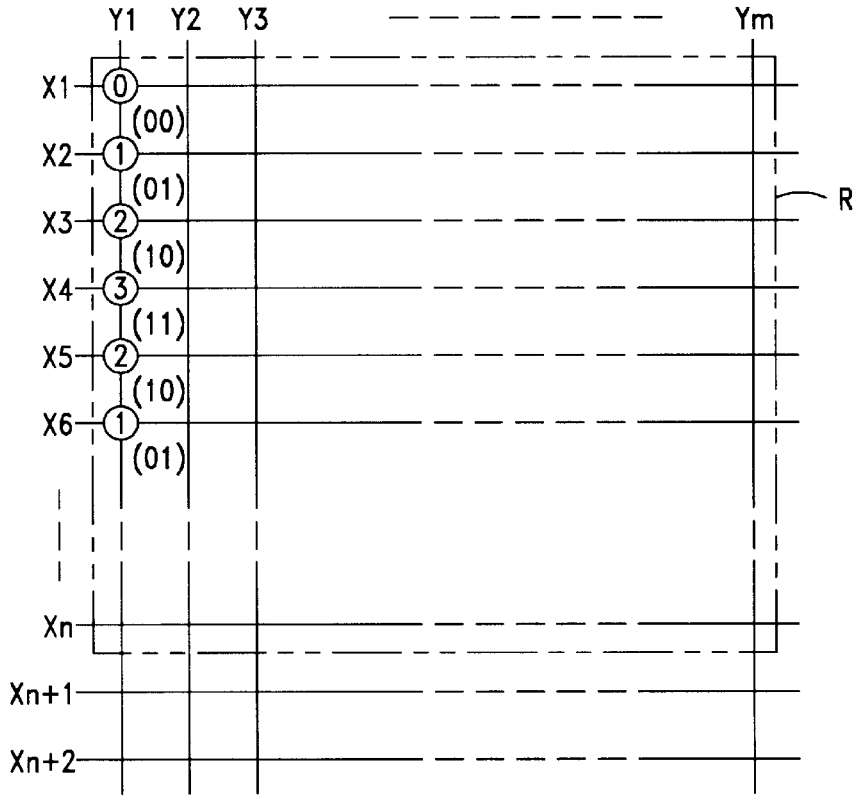
FIG. 13 illustrates another example of display data of a liquid crystal display panel having at least one virtual electrode.

It is not always necessary to provide these virtual row electrodes because they are not normally displayed. When they are provided, however, the virtual row electrodes can be provided in an area not affecting the display. When provided in a liquid crystal display, for example, the virtual row electrodes $X_{n+1}$ . . . are provided outside the display area R as shown in FIG. 13. Alternatively, any extra row electrodes outside the normal display area R can also be used as virtual row electrodes.

The number of voltage levels can be further reduced by increasing the number e of virtual row electrodes. In the above example the number of mismatches is controlled to be divisible by two when e=1, but if e=2, the same result can be obtained by controlling the number of mismatches to be divisible by three. It is also possible to divide by three to leave a remainder of one or two.

The maximum reduction possible with the above method is 1/(e+1), or ½ when e=1 (except for 0 V).

The present embodiment as shown in FIGS. 12 A, A', B and C simultaneously selects three row electrodes and one virtual electrode to reduce the number of voltage levels applied to the column electrodes, and drives by dividing the selection period into plural parts in one frame.

Figure 14A:
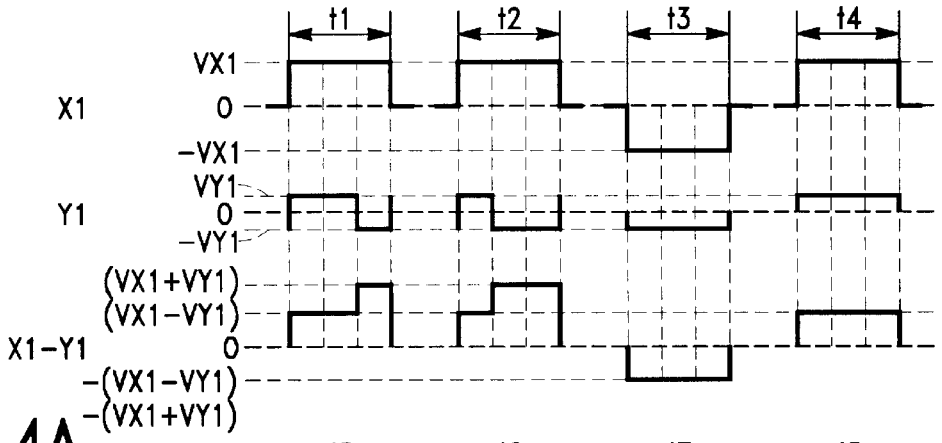
FIGS. 14A and 14B show the applied voltage waveforms of a sixth embodiment of a driving method of the liquid crystal display according to the present invention.
Figure 14B:
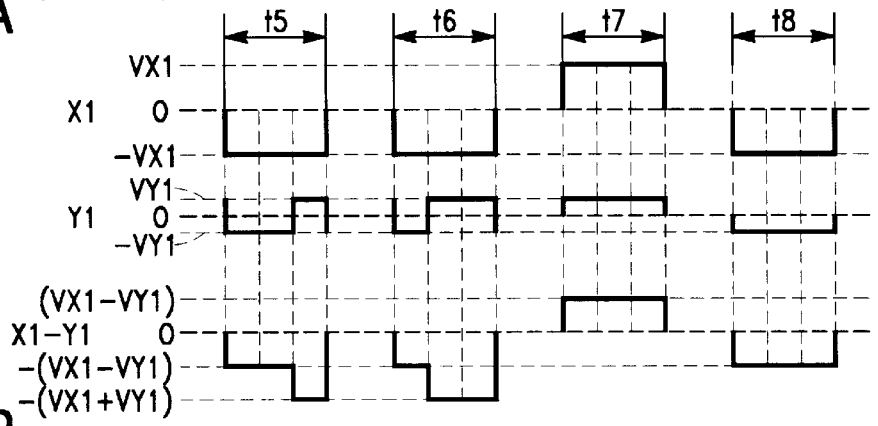

As shown in FIG. 12 A, A', B and C and FIG. 14, the fifth embodiment divides the selection period into four parts in one frame, and the number of mismatches with the display data is counted bit by bit for four row electrodes, including the virtual row electrode, in each of the four partial periods to adjust the number of mismatches to an odd number. The number of mismatches is thus either 1 or 3, and the voltage level of the column voltage waveform is therefore one of two levels, $V_{Y1}$ or $-V_{Y1}$.

Considering the display shown in FIG. 13, the virtual row electrode $X_{n+1}$ follows after the first three selected row electrodes $X_1$, $X_2$, and $X_3$ as shown in FIG. 8. Note that it is not essential for the virtual row electrode to be previously provided, but that when it is the virtual row electrode is preferably provided outside the display area R.

If a positive voltage applied to the row electrode is ON and a negative voltage is OFF, each of the selection periods Δt is divided into three parts, and the display data on the simultaneously selected row electrodes $X_1$, $X_2$, and $X_3$ is (00), (01), (10) as shown in FIG. 13, the data for the virtual row electrode is (11) as shown in FIG. 8.

The number of mismatches is then counted bit by bit to determine either voltage level $V_{Y1}$ or $-V_{Y1}$, and the voltages for the high bits are applied for the latter two of the three period divisions and the voltage for the low bit is applied for the first one period division. Note that, as in the third embodiment, it is also possible to apply the voltage for the high bit in the first two period divisions and to apply the voltage for the low bit in the last one period division.

It is therefore sufficient to determine the pulse width of voltage $V_{Y1}$ or $-V_{Y1}$ by a per bit comparison with the display data, and the present embodiment can reduce the number of voltage levels applied to the column electrodes, specifically to two in the above embodiment, by always setting the number of mismatches between the display data and the row select pattern of the selected pulse applied to the virtual row electrode to 1, 3, or some other odd number. Note that an even number of mismatches can be alternatively used.

Note also that while the above embodiment has been described for a four gray scale display, a display with a larger number of gradations is also possible. For example, an eight gray scale display can be achieved by using 3-bit display data and dividing each selection period into three parts weighted to the pulse width of each display data bit. A display with 16 gradations can be achieved by using 4-bit display data and dividing each selection period into four parts weighted to the pulse width of each display data bit. Thus, a gray scale display is possible by changing the number of divisions each selection period is divided into.

Sixth Embodiment

The sixth embodiment is illustrated in FIGS. 14A and B in which the width of the column voltages are varied by pulse width modulation and at least one virtual electrode is employed to reduce the number of voltage levels, similar to the fifth embodiment. Additionally the row voltages similar to the first embodiment are applied to the row electrodes. The application of such voltages achieves a high quality gray scale display.

More specifically, the voltage waveforms applied to the simultaneously selected row electrodes are the same as that of the first embodiment shown in FIG. 1A as above, each of the selection periods $t_1$–$t_4$, $t_5$–$t_8$ is divided into three parts, and when the display data of the simultaneously selected row electrodes $X_1$, $X_2$, and $X_3$ is (00), (01), (10) as shown in FIG. 13, it is sufficient for the data of the virtual electrode to be (11) as shown in FIG. 8.

The number of mismatches is then counted bit by bit to determine the voltage level, and either $V_{Y1}$ or $-V_{Y1}$ is applied as the voltage for the high or most significant bit in two of the three period divisions and the voltage for the low or least significant bit in one period division.

It is thus possible to obtain as high a quality of a gray scale display as the fifth embodiment.

It is to be noted that the selection periods $t_1$–$t_4$ may be provided consecutively in one frame F, or separately in one frame F. The same is true of selection periods $t_5$–$t_8$.

Seventh Embodiment

Figures 15A, 15B, 15C:
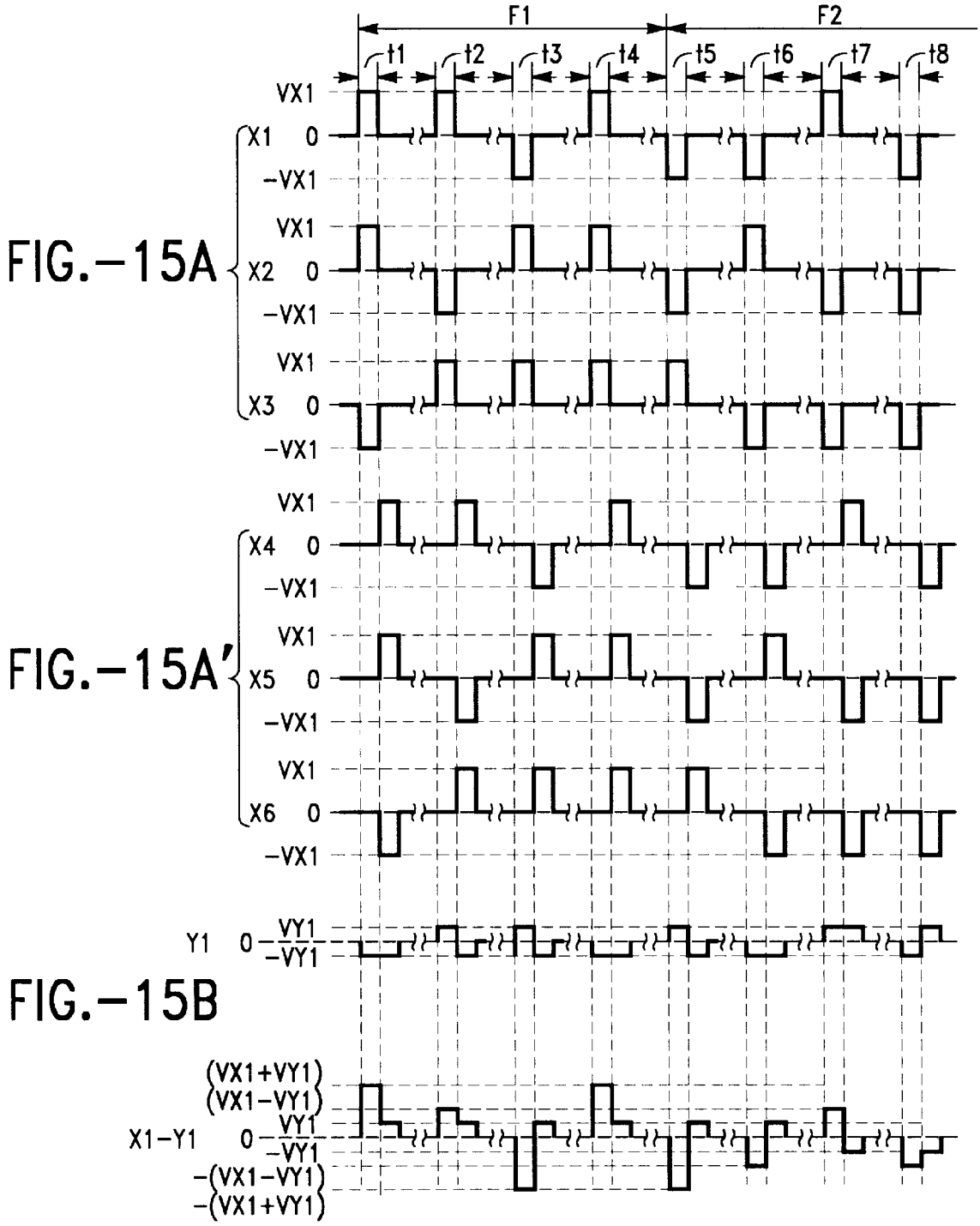
FIGS. 15A, A', B, and C show the applied voltage waveforms of a seventh embodiment of a driving method of the liquid crystal display according to the present invention.

The seventh embodiment illustrated in FIGS. 15A, A', B and C is directed to a method referred to as frame rate control modulation. More specifically, a gray scale display based on frame rate control modulation turns some pixels ON during a first frame and a succeeding frame, some pixels OFF during both frames, some pixels ON during the first frame and OFF during the succeeding frame and some pixels OFF during the first frames and ON during the succeeding frame. Those pixels having their states changed from frame to frame exhibit gray scale characteristics. The gray scale display employing frame rate control modulation can be further enhanced by employing various other techniques described above, such as, the division of the selection period and the use of virtual electrodes to reduce the number of voltage levels.

The seventh embodiment is shown in FIGS. 15A, A', B and C whereby the number of voltage levels applied to the column electrodes is reduced using three sequential row electrodes and one virtual row electrode similarly to the sixth embodiment, and drives the display by dividing the selection period into plural parts within one frame, achieving a gray scale display by means of frame rate control modulation.

Figure 48A:
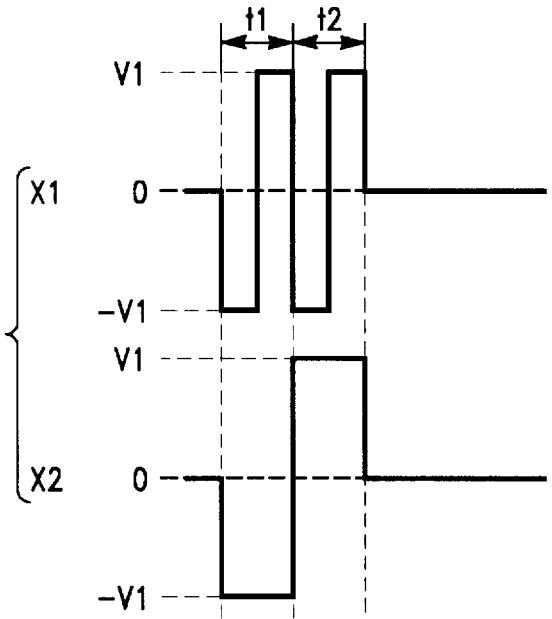
FIG.-48A (PRIOR ART)
Figure 48B:
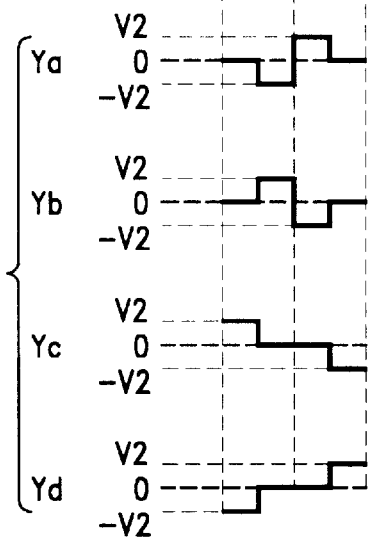
FIG.-48B (PRIOR ART)

As will be understood by those of ordinary skill in the art, that while the waveform shown in FIG. 3B is used as the voltage waveform applied to the simultaneously selected row electrodes in this embodiment, the waveform shown in FIG. 3A or FIG. 48 A or B may also be used.

Figure 16:
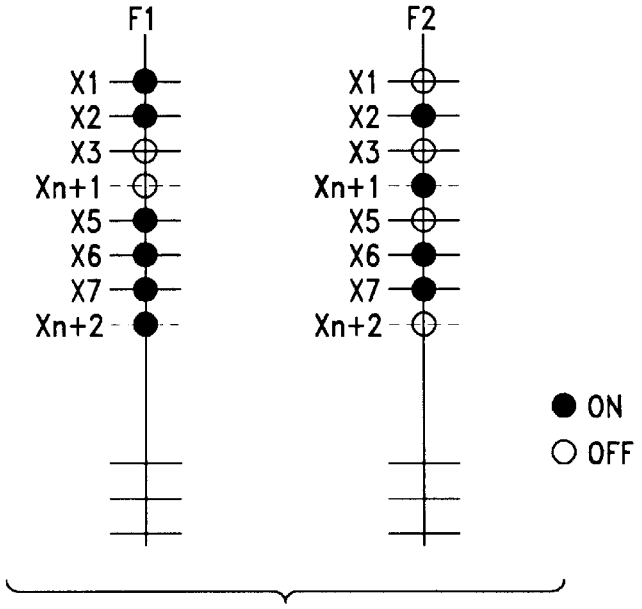
FIG. 16 illustrates another example of display data of a liquid crystal display panel during two frame periods.

A gray scale display based on frame rate control modulation turns some frames on and some frames off during any given frame period, and in the example shown in FIG. 16, a gradation between on and off is displayed by applying an ON voltage during F1 and an OFF voltage during F2. Of course, a gradation can be displayed by applying an OFF voltage during frame F1 and an ON voltage during frame F2.

In this embodiment, the brightness difference between F1 and F2 is also reduced and flicker becomes less noticeable because the fields are selected four times during one frame. For example, in a gray scale display using plural frame periods as one block, the position of the selection pulse can be changed within the plural frames, and the difference between frames can be reduced by interchanging periods $t_3$ and $t_7$, for example, in FIG. 15A.

As will be apparent, while a gray scale display can be achieved by turning one of two frames ON and one frame OFF in the above embodiment, more frames, for example 7 frames, can be grouped in one block to achieve an 8 gray scale display by changing the number of ON and OFF frames within the block, or 15 frames can be grouped in one block to achieve a 16. Thus, a display with the desired number of gradations is possible depending on the number of frames of one block.

Eighth Embodiment

Figure 17A:
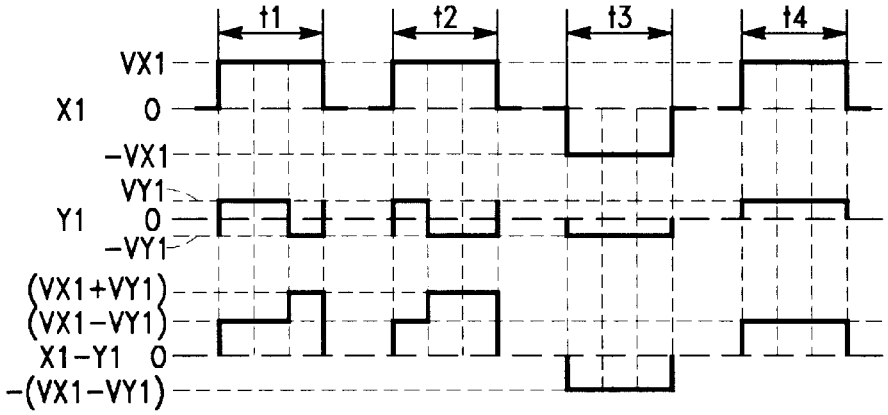
FIGS. 17A and 17B show the applied voltage waveforms of an eighth embodiment of a driving method of the liquid crystal display according to the present invention.
Figure 17B:
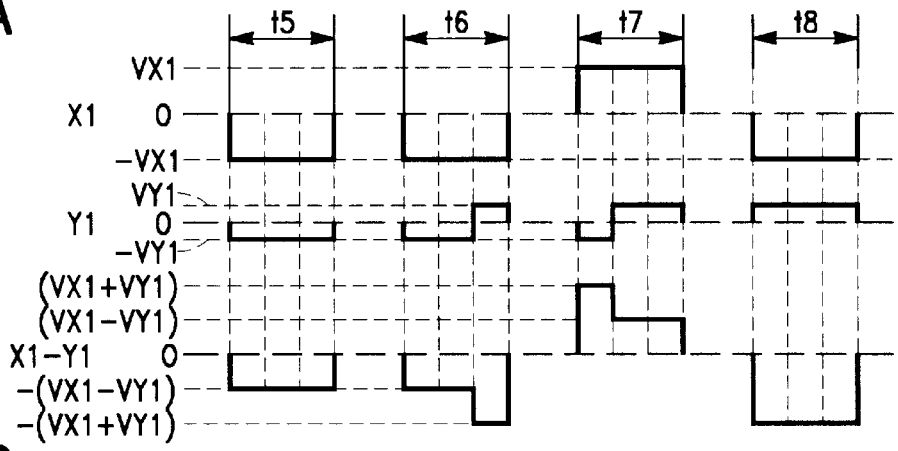

The eighth embodiment is shown in FIGS. 17A and B. The eighth embodiment achieves a gray scale display by means of frame rate control modulation, dividing the selection period into plural portions, reducing the number of applied voltage levels and by varying the column pulse width by pulse width modulation. FIG. 13 shows an embodiment whereby the number of voltage levels applied to the column electrodes is reduced using three sequential row electrodes and one virtual row electrode similar to the fifth embodiment and dividing the selection period into plural parts within one frame for achieving a gray scale display by means of frame rate control modulation as noted above.

The eighth embodiment achieves a finer gray scale display by displaying plural gradations during plural frame periods. Thus, gradations between the gradations of the plural frames can be displayed.

Figure 18:
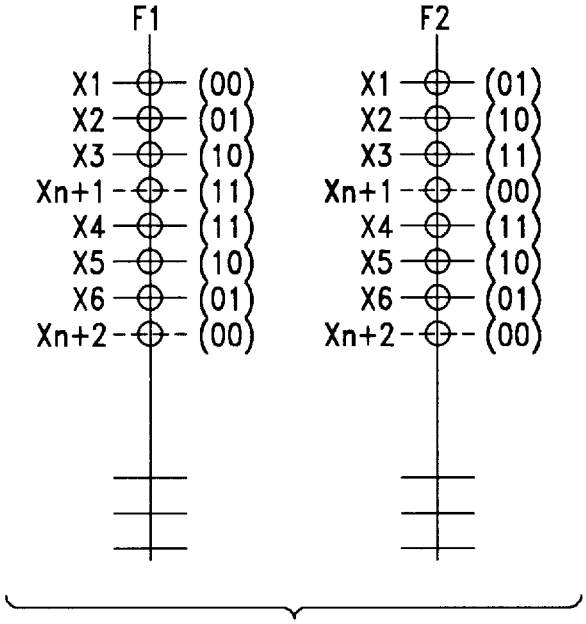
FIG. 18 illustrates another example of display data of a liquid crystal display panel during two frame periods.

More specifically, by displaying (00) during the first frame F1 period and during the next frame F2 period as shown in FIG. 18, a gradation actually between (00) and (01) can be displayed.

As will be apparent, display flicker can be reduced and a multiple gray scale display can be achieved by thus dividing the selection period and reducing the number of applied voltage levels, and combining pulse width modulation with frame rate control modulation for the gray scale display. Of course, the order of the selection pulses can be changed as in the sixth embodiment above.

While the fifth to eighth embodiments above have been described assuming the use of a virtual row electrode, it will be apparent to those who have read this description that a gray scale display can still be achieved by means of frame rate control modulation or by a combination of frame rate control modulation and pulse width modulation even when a virtual row electrode is not provided.

Ninth Embodiment

Each of the above embodiments have been described as achieving a four gray scale display by applying a column voltage weighted according to each bit of 2-bit display data, but it is possible to drive other numbers of gradations. For example, an eight gray scale display can be obtained using a column electrode waveform in accordance with the ninth embodiment depicted in FIG. 19.

Figure 19:
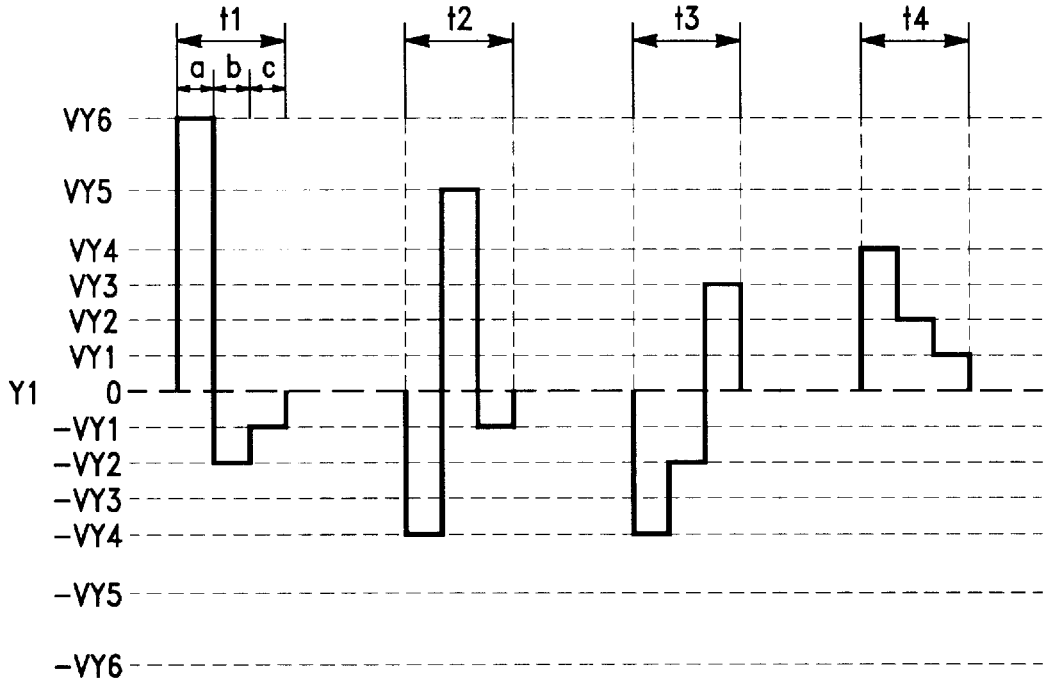
FIG. 19 shows the applied voltage waveforms of a ninth embodiment of a driving method of the liquid crystal display according to the present invention.

Referring to FIG. 19, the column electrode waveform is shown therein when the display data for the pixels at the intersection of the row electrodes $X_1$, $X_2$, and $X_3$ and column electrode $Y_1$ are (001), (010), (100). The row electrode waveforms applied to each of the row electrodes are the same as that of the first embodiment as shown in FIG. 2.

In this embodiment, the four selection periods $t_1$–$t_4$ in the first embodiment are each divided into three equal periods a, b, c, and the voltage waveform corresponding to the highest of the three display data bits is applied in the first period division a, the voltage waveform corresponding to the middle bit is applied in the next period division b, and the voltage waveform corresponding to the lowest bit is applied in the last period division c; each of these voltage waveforms is weighted according to each of the display data bits as in the first embodiment.

Specifically, one of the voltages $-V_{Y6}$, $-V_{Y4}$, $V_{Y4}$, or $V_{Y6}$ is selected for period a according to the highest display data bit, one of the voltages $-V_{Y5}$, $-V_{Y2}$, $V_{Y2}$, or $V_{Y5}$ is selected for period b according to the middle display data bit, and one of the voltages $-V_{Y3}$, $-V_{Y1}$, $V_{Y3}$, or $V_{Y1}$ is selected for period c according to the lowest display data bit. The relationship between each of the voltage levels is defined as $$4*V_{Y1}=2*V_{Y2}=V_{Y4}$$
$$4*V_{Y3}=2*V_{Y5}=V_{Y6}$$
$$2*V_{Y1}=V_{Y3}-V_{Y1}$$
$$2*V_{Y2}=V_{Y5}-V_{Y2}$$
$$2*V_{Y4}=V_{Y6}-V_{Y4}.$$

Under these conditions, an eight gray scale display can be achieved as in the first embodiment by generating the column electrode waveform based on the number of mismatches in each bit of the display data.

As described above, a four gray scale display is obtained in the first embodiment by selecting a voltage for each of the two equal periods into which the selection period is divided, and applying this voltage to the column electrode, but in the present embodiment an eight gray scale display is obtained by dividing the selection period into three equal parts. In addition, a sixteen gray scale display can be obtained by dividing the selection period into four equal parts, and as this indicates, the number of gradations can be increased by appropriately dividing the selection period into plural parts and applying a voltage selected for each of these parts to the column electrode. The brightness level of each gradation can also be adjusted by changing the voltage ratio applied to each column electrode, or by slightly changing the duration of each part into which the selection period is divided instead of using equal parts.

Tenth Embodiment

In a gray scale display obtained by changing the voltages applied to the column electrodes as shown in FIG. 19 of the ninth embodiment above, a voltage is applied according to each bit in sequence from the high bit in the periods a, b, c, divided according to the number of display data bits, but this sequence can be appropriately changed for each column electrode.

If, for example, in the ninth embodiment above the display of the pixels at the intersections of row electrodes $X_1$, $X_2$, and $X_3$ and column electrodes $Y_2$–$Y_m$ are the same as the display of the pixels at the intersections of row electrodes $X_1$, $X_2$, and $X_3$ and column electrode $Y_1$, the column voltage waveforms applied to the column electrodes $Y_1$–$Y_m$ will all be identical to the waveforms shown in FIG. 19. However, rounding of the waveform applied to each pixel becomes great in this case, and display quality deteriorates.

Figure 20:
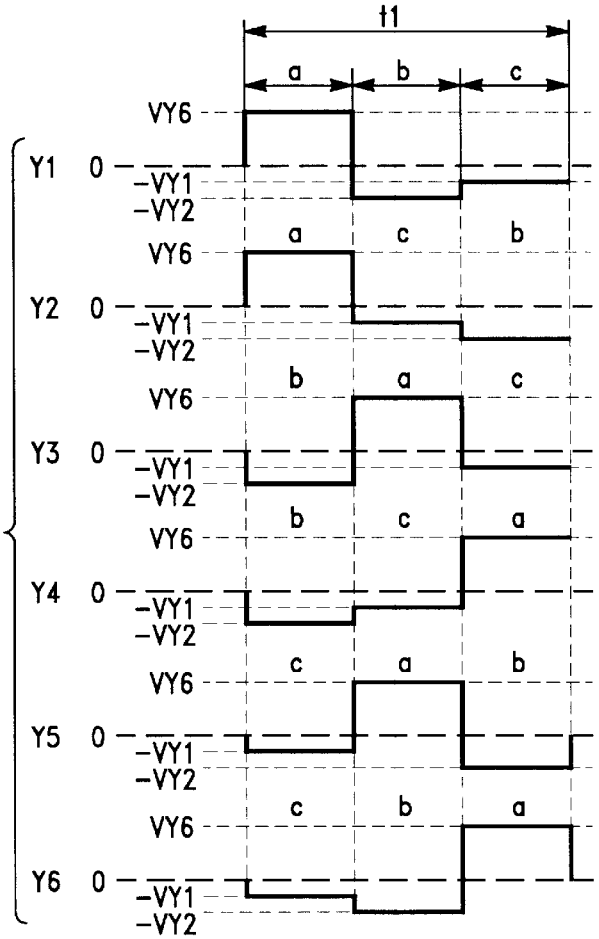
FIG. 20 shows the applied voltage waveforms of a tenth embodiment of a driving method of the liquid crystal display according to the present invention.

The order of the column electrode waveforms applied to each of the column electrodes $Y_1$–$Y_m$ is thus changed in this embodiment as shown in FIG. 20.

In other words, in the ninth embodiment the voltage corresponding to the highest of the three display data bits is applied in sequence to column electrode $Y_1$ during period a in FIG. 20, the voltage corresponding to the middle bit during period b, and the voltage corresponding to the lowest bit during period c. The same is true of the other column electrodes $Y_1$–$Y_m$.

In the tenth embodiment as shown in FIG. 20, however, if the period in which the voltage corresponding to the highest bit is applied is a, the period in which the voltage corresponding to the middle bit is applied is b, and the period in which the voltage corresponding to the lowest bit is applied is c, and the voltages are applied to column electrode $Y_1$ in the order (a, b, c) in sequence from the highest bit as in the second embodiment, the order is changed for the next column electrode, for example to (a, c, b) for column electrode $Y_2$, (b, a, c) for column electrode $Y_3$, (b, c, a) for column electrode $Y_4$, (c, a, b) for column electrode $Y_5$, and (c, b, a) for column electrode $Y_6$, and similar combinations are repeated for $Y_7$–$Y_m$.

If this method is applied, the effects of rounding rises and falls of column electrode waveform cancel each other out, and rounding of the waveforms applied to each pixel can be reduced because waveforms in six different order combinations are applied in essentially the same number to the column electrodes, It is appreciated that any combination of waveforms applied to the column electrodes can be used such that, for example, if there are six column electrode drivers, each combination of waveforms is applied to each column electrode driver. Thus, display quality can be improved if the number of rounding rises and falls cancel each other in the combination of waveforms applied to the respective column electrodes.

Furthermore, changing the order of the voltages corresponding to each bit of display data for each of the column electrodes $Y_1$–$Y_m$ as described above can also be applied to the various embodiments described hereinbefore and below.

Eleventh Embodiment

In the ninth embodiment an eight gray scale display is obtained using a waveform as shown in FIG. 1A, i.e., as shown in FIG. 3B, as the row voltage waveform applied to the row electrodes, but the waveform shown in FIG. 3A or in the FIG. 48A or B for the conventional method can also be used. The case wherein the waveform shown in FIG. 3A is used for an eight gray scale display is described in further detail below.

Figure 22:
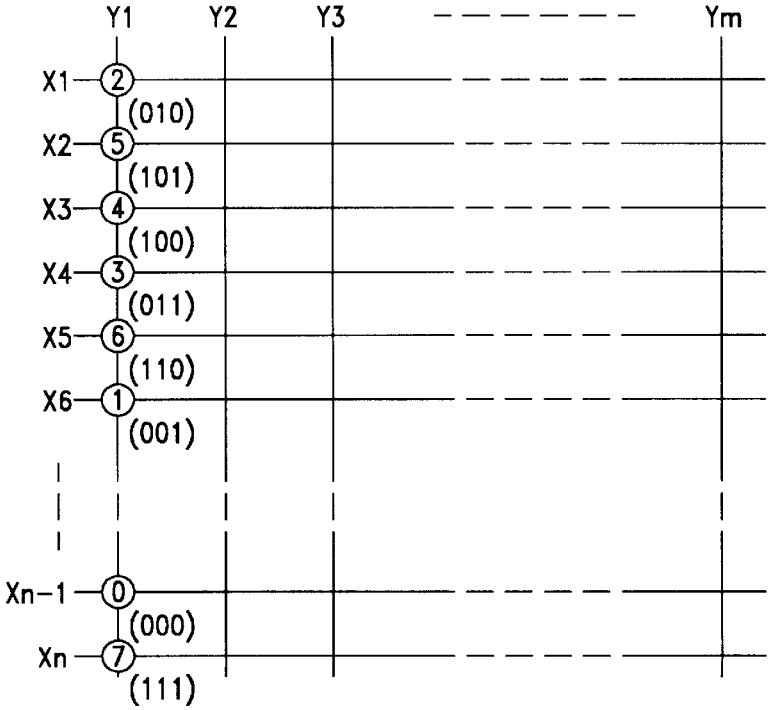
FIG. 22 illustrates another example of display data of a liquid crystal display panel.
Figure 21A:
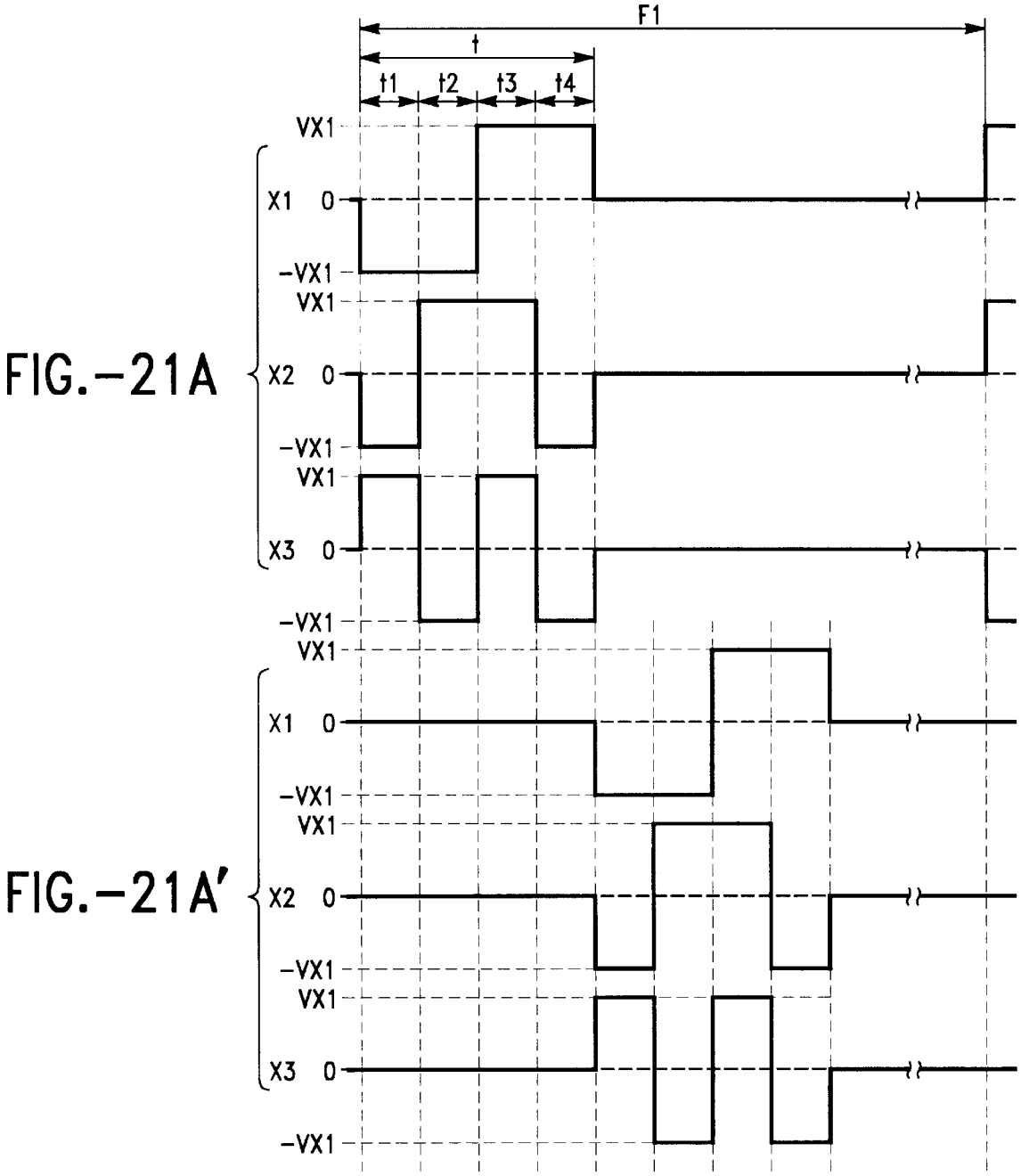
FIGS. 21A, A', B and C show the applied voltage waveforms of an eleventh embodiment of a driving method of the liquid crystal display according to the present invention.

The waveforms applied in the eleventh embodiment as shown in FIGS. 21A, A', B and C achieve an eight gray scale display based on the display data shown in FIG. 22 and using the waveform shown in FIG. 3A as the row voltage waveform applied to the row electrodes. FIG. 21A shows the row voltage waveform applied to row electrodes $X_1$, $X_2$, and $X_3$, FIG. 21B is the column voltage waveform applied to column electrode $Y_1$, and FIG. 21C is the synthesized voltage waveform applied to the pixels at the intersection of row electrode $X_1$ and column electrode $Y_1$.

In the eleventh embodiment three sequential row electrodes are also simultaneously selected are shown in FIG. 21A, and the next three row electrodes $X_4$, $X_5$, and $X_6$ are selected after row electrodes $X_1$, $X_2$, and $X_3$ are selected as shown in FIG. 21A', and a voltage is applied to these electrodes similarly to row electrodes $X_1$, $X_2$, and $X_3$. Thereafter, the row electrodes are selected in order three at a time, and one frame ends when all row electrodes have been selected.

By thus applying a row voltage waveform as shown in FIG. 3A to the three simultaneously selected row electrodes, the minimum pulse width $\Delta t$ is twice the minimum pulse width $\Delta t_0$ of the conventional method shown in FIG. 48A as described above, and all selection periods t for each of the row electrodes in one frame comprise four periods $t_1$–$t_4$ of the size of pulse widyh $\Delta t$.

The above four periods $t_1$–$t_4$ are each divided into three periods a, b, c according to the number of bits of display data, and a column voltage specifically weighted according to the bits of the display data is applied to the column electrode in each of these period divisions.

Specifically, the high bit of the display data, which is expressed as a three digit binary number as shown in FIG. 22, corresponds to the first period division a of each period $t_1$–$t_4$, the middle bit corresponds to the next period division b, and the low bit corresponds to the last period division c, and the specifically weighted voltage $\pm V_{Y4}$ or $\pm V_{Y6}$ is applied according to the conditions described below for the high bit, $\pm V_{Y2}$ or $\pm V_{Y5}$ is applied for the middle bit, and $+V_{Y1}$ or $\pm V_{Y3}$ is applied for the low bit.

It is to be noted that the ratio of the above voltage values is defined as:

$V_{Y1}:V_{Y2}:V_{Y4}=1:2:4$ $V_{Y3}:V_{Y5}:V_{Y6}=1:2:4$ $V_{Y1}:V_{Y3}=1:3$.

As the conditions for the above, ON is when the voltage waveform of the row electrode is positive and OFF is when negative, and a display data value of 1 is ON and 0 is OFF; the on/off state of the simultaneously selected row electrodes and the on/off state of the corresponding display data bit at the intersection of the selected row electrode and the column electrode to which the voltage is to be applied are compared for each bit position, and a voltage specified according to the number of mismatches is applied to the column electrode.

Specifically, when the number of mismatches between the row electrode and the high bit is 0, 1, 2, or 3, a voltage value $-V_{Y6}$, $-V_{Y4}$, $V_{Y4}$, or $V_{Y6}$, respectively, is applied in this embodiment; when the number of mismatches between the row electrode and the middle bit is 0, 1, 2, or 3, a voltage value $-V_{Y5}$, $-V_{Y2}$, $V_{Y2}$, or $V_{Y5}$, respectively, is applied; and when the number of mismatches between the row electrode and the low bit is 0, 1, 2, or 3, a voltage value $-V_{Y3}$, $-V_{Y1}$, $V_{Y1}$, or $V_{Y3}$, respectively, is applied.

Therefore, in the eleventh embodiment in FIGS. 21A, A', B and C, the three row electrodes $X_1$, $X_2$, and $X_3$ are first selected, the selected row electrodes $X_1$, $X_2$, and $X_3$ are OFF, OFF, ON, respectively, and the high bits of the display data at the intersection of the column electrode $Y_1$ and these row electrodes $X_1$, $X_2$, and $X_3$ are OFF, ON, ON. Comparing both, the number of mismatches is 1, and the voltage $-V_{Y4}$ is applied to column electrode $Y_1$ in the first period division a of the first period $t_1$. A weighted voltage is simultaneously applied to the other column electrodes $Y_2$–$Y_m$ in the same manner.

Next, during the next period division b of the first period $t_1$, the on/off state of row electrodes $X_1$, $X_2$, and $X_3$ is the same OFF, OFF, ON, and the middle bits corresponding to this period division b are, in order, ON, OFF, OFF; the number of mismatches is therefore 2, and voltage $V_{Y2}$ is applied. The low bits corresponding to the last period division c are OFF, ON, OFF; the number of mismatches is therefore 2, and voltage $V_{Y1}$ is applied.

During the next period $t_2$, the voltages $-V_{Y4}$, $V_{Y2}$, and $-V_{Y3}$, respectively, are applied to the column electrode $Y_1$ during period divisions a, b, c because the on/off states of row electrodes $X_1$, $X_2$, and $X_3$ are OFF, ON, OFF, the high bits of the display data at the intersection of the column electrode $Y_1$ and these row electrodes $X_1$, $X_2$, and $X_3$ are OFF, ON, ON, respectively, and the number of mismatches is 1. As described above, the middle bits are ON, OFF, OFF and the number of mismatches is 2, and the low bits are OFF, ON, OFF and the number of mismatches is 0.

The above sequence is also followed in the next periods $t_3$ and $t_4$ so that a column voltage corresponding to the number of mismatches is simultaneously applied to all column electrodes $Y_1$–$Y_m$ and selection of row electrodes $X_1$, $X_2$, and $X_3$ ends, the next row electrodes $X_4$, $X_5$, and $X_6$ are selected and a specified column voltage is applied in the same manner to column electrodes $Y_1$–$Y_m$, and one frame F ends when all row electrodes have been selected. Thereafter, the first row electrodes $X_1$, $X_2$, and $X_3$ are again selected in sequence and the next frame is started. The polarity of the voltage applied to the row electrodes at this time is reversed or inverted, and the polarity of the voltage applied to the column electrodes is accordingly reversed, to execute a so-called alternating current drive scheme.

As will be appreciated by one of ordinary skill in the art, it is not essential for the above voltage ratio to conform strictly to the above conditions, and it is not necessary for the periods $t_1$–$t_4$ and the divided periods a, b, c to be strictly divided into equal parts, and can, for example, be adjusted according to the characteristics of the liquid crystals. In addition, the sequence of the divided periods a, b, c can be changed. Furthermore, display of a various number of gradations is possible by means of the same principle described above; for example, to achieve a 16 gray scale display, it is sufficient to apply voltages weighted according to each bit of display data expressed using four bits. This is also true of the other embodiments described below.

Twelfth Embodiment

The twelfth embodiment is depicted in FIGS. 23A, A', B and C. FIGS. 24A–C and 25A–C illustrate other examples of the twelfth embodiment. Referring to FIGS. 23A, the twelfth embodiment provides a driving method similar to the eleventh, e.g. a single selection period t is provided for the row electrodes in one frame F, additionally the selection period is divided into plural parts in one frame F.

As shown in FIG. 23A, one field is defined as the period required for all row electrodes to be selected in each of the periods $t_1$–$t_4$, and these four fields are preferably repeated in one frame period F. Moreover these periods can be further divided and the sequence repeated for all of the row electrodes for each display data bit, as shown in FIGS. 24A–C, FIGS. 25A–C, and FIG. 26A–C, more fully discussed below.

Referring specifically to FIG. 23A voltage waveforms are applied whereby the four periods $t_1$–$t_4$ in the eleventh embodiment are divided into plural parts for display drive, and FIG. 23A' illustrates the voltage waveforms applied to row electrodes $X_4$–$X_6$.

First, row electrodes $X_1$, $X_2$, and $X_3$ are selected and a column voltage corresponding to the number of mismatches with three bits is sequentially applied to column electrodes $Y_1$–$Y_m$ in the same way as in the eleventh embodiment above, row electrodes $X_4$, $X_5$, and $X_6$ are next selected and a column voltage is again applied as above, and field $f_1$ for period $t_1$ ends when all row electrodes have been selected. Next, the row electrodes are again selected in sequence from row electrodes $X_1$, $X_2$, and $X_3$, field $f_2$ corresponding to the next period $t_2$ is executed, and when all four fields $f_1$–$f_4$ corresponding to the four period $t_1$–$t_4$ are completed, one frame F is completed.

Figure 24A:
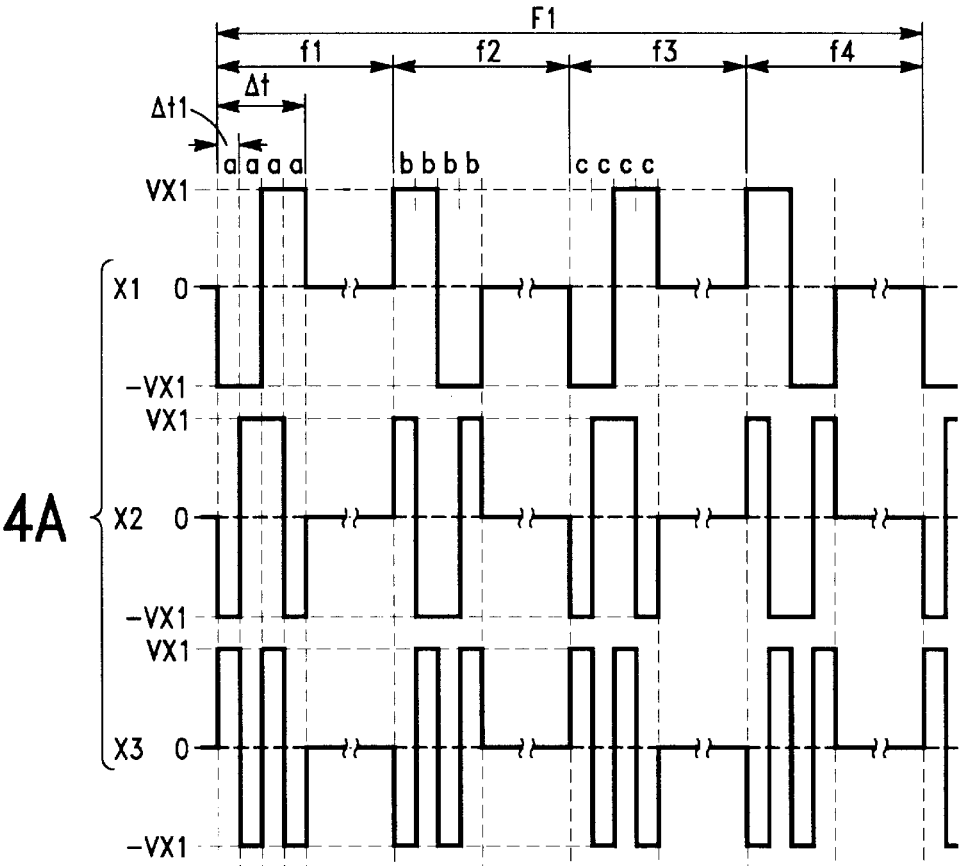
FIGS. 24A, B and C show another example of the applied voltage waveforms of the twelfth embodiment of a driving method of the liquid crystal display according to the present invention.
Figure 24B:
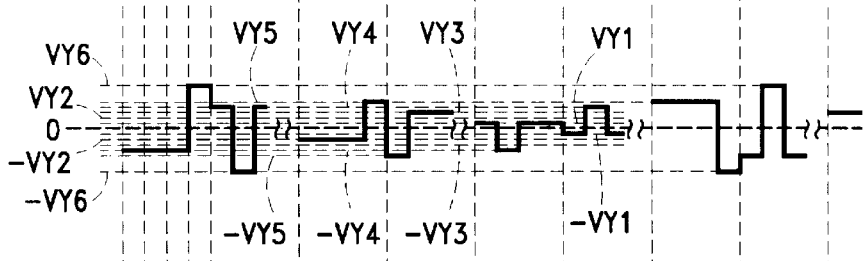
Figure 24C:
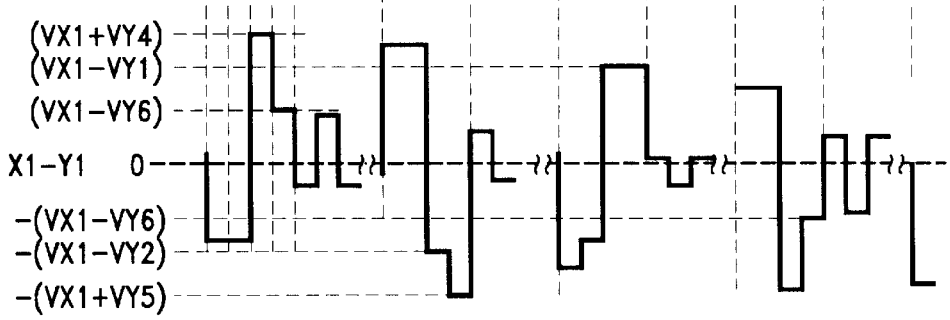

Referring to FIGS. 24A–C an example in accordance with the twelfth embodiment is illustrated in which execution is grouped for each display data bit, i.e., for each of the subdivided periods of the four periods $t_1$–$t_4$ in the above embodiment.

First, the first period division a in the four periods $t_1$–$t_4$ in FIG. 1 is treated as one field $f_1$ until all row electrodes have been selected, and one frame is completed when field $f_2$ corresponding to period division b and field $f_3$ corresponding to period division c are similarly completed. Note that the polarity of the voltage applied to the row electrodes is reversed each field, and the voltage applied to the column electrodes is also reversed accordingly.

Figures 25A, 25B, 25C:
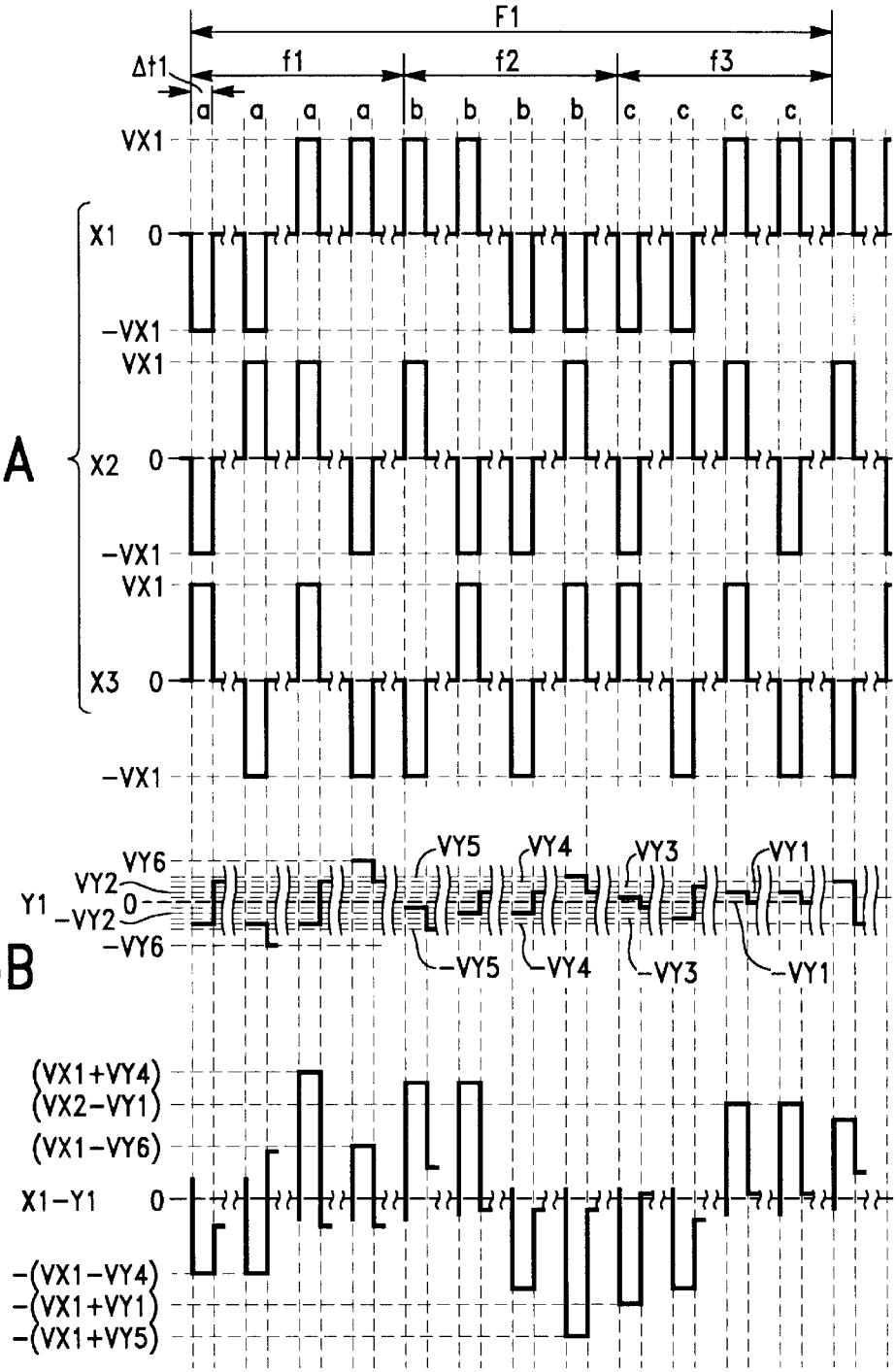
FIGS. 25A–C show another example of the applied voltage waveforms of the twelfth embodiment of a driving method of the liquid crystal display according to the present invention.

FIGS. 25A–C depict another example in accordance with the twelfth embodiment in which execution is further divided and applied to all row electrodes in each of the period divisions a, b, c in FIGS. 24A–C. In this example, the effect is the same as frame rate control modulation applied for each display data bit in the embodiment in FIG. 21 above.

When the row electrode selection period is executed plural times within one frame F as described above, the period in which the selected voltage is not applied to each row electrode, i.e., to each pixel, can be shortened, the variation in display brightness can be reduced, and a loss of contrast can be prevented.

Thirteenth Embodiment

Figures 26A, 26B, 26C:
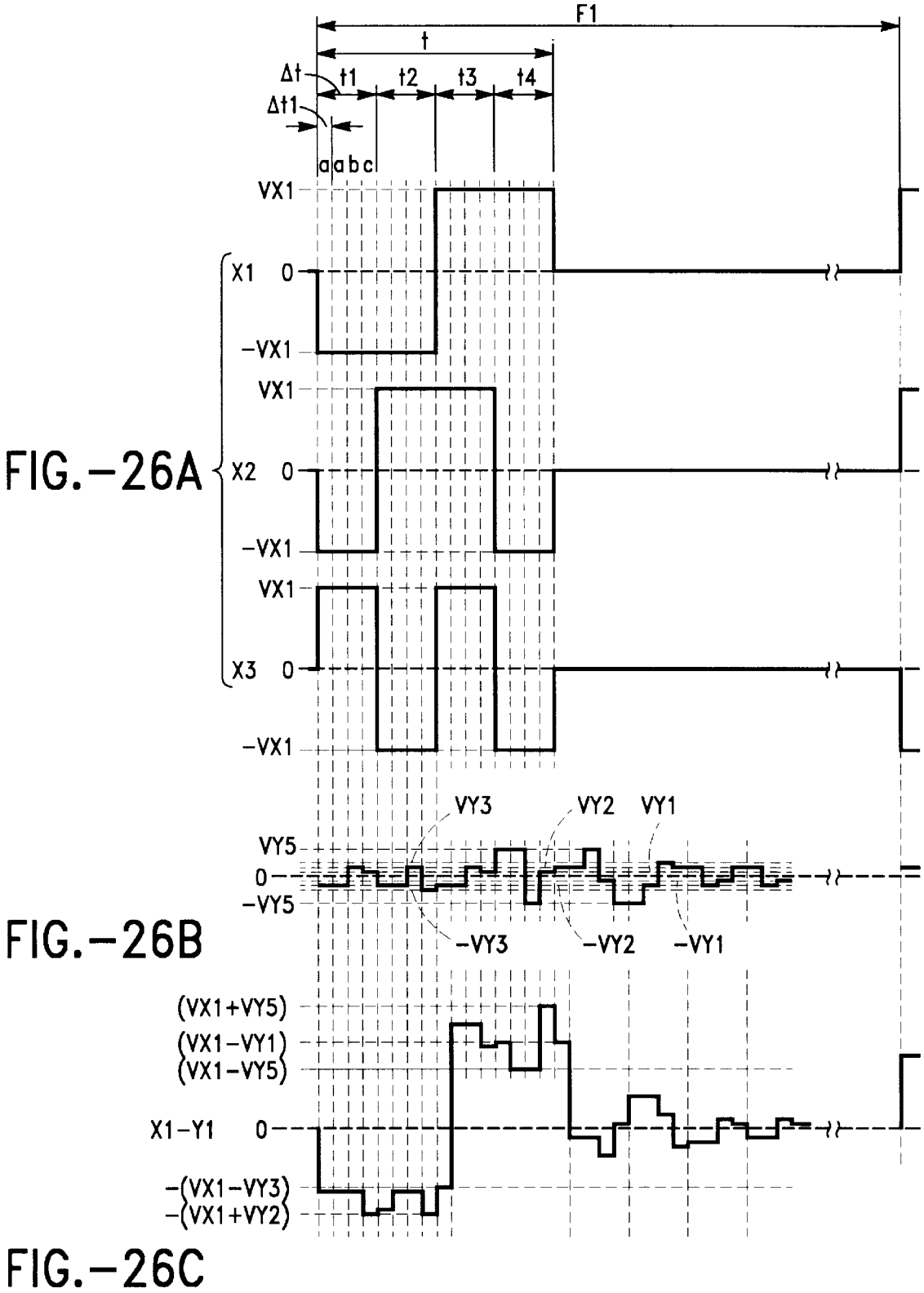
FIGS. 26A–C show the applied voltage waveforms of a thirteenth embodiment of a driving method of the liquid crystal display according to the present invention.

FIGS. 26A–C illustrate the thirteenth embodiment in accordance with the present invention. In the thirteenth embodiment, one selection period is divided into the same number of parts as there are gradation bits n, i.e., three, and a column voltage of one of six levels $V_{Y1}$–$V_{Y6}$ is selectively applied to the column electrodes as in the eleventh embodiment. Additionally, in the thirteenth embodiment the number of column voltage levels can be reduced by increasing the above number of divisions.

For example, the effective voltage when driving the liquid crystal elements of a liquid crystal display panel, etc., is generally determined by the voltage amplitude and the voltage application time (pulse width), and the panel can be equally driven whether a high voltage is applied for a short time or a low voltage is applied for a long time. In other words, it is the amount of energy applied to the liquid crystal panel that drives the liquid crystal elements.

It is therefore possible to drive the liquid crystal elements with an equivalent effect by selecting from the plural voltage levels having a low level voltage and applying this voltage for an extended period rather than using a high level voltage for a shorter time period. For example, by using voltage levels $V_{Y5}$ and $V_{Y2}$ in place of voltage levels $V_{Y6}$ and $V_{Y4}$ in the first embodiment and increasing the application time, the elements can be driven in the same manner as the first embodiment. It is thereby possible to reduce the number of column voltage levels.

FIGS. 26A–C depicts the thirteenth embodiment in which voltage waveforms are applied whereby the number of column voltage levels is decreased.

Whereas the selection periods $t_1$, $t_2$, $t_3$, $t_4$ are divided into n parts, i.e., a, b, and c, in FIGS. 21A–C, each selection period is divided into (n+1) parts, i.e., a, a, b, c, in the thirteenth embodiment. In the present embodiment the first two period divisions a, a are assigned to the voltage application time of the high display data bit.

Specifically, voltage levels $V_{Y5}$ and $V_{Y2}$ corresponding to the middle bit, which are half the level of $V_{Y6}$ and $V_{Y4}$, are respectively substituted for the $V_{Y6}$ and $V_{Y4}$ voltage levels corresponding to the high bit in the eleventh embodiment, and the application time is twice that of the middle bit. As a result, the voltage applied to the liquid crystal elements are applied for twice the time as the middle bit and four times the low bit values, and the weighting ratio for each bit is 1:2:4, the same as the first embodiment shown in FIG. 1.

Thus, equivalent driving voltages as the eleventh embodiment can be achieved while applying one less column electrode voltage level.

It is apparent to one of ordinary skill in the art who has read this description that the two highest voltage levels $VY_6$ and $V_{Y4}$ in the eleventh embodiment are eliminated by this embodiment, but the voltage levels $V_{Y3}$ and $V_{Y1}$ for the low bit can be used, respectively, instead of the middle bit voltage levels $V_{Y5}$ and $V_{Y2}$ in the eleventh embodiment, using an application time twice that of the low bits in the same way as above. Furthermore, it is also possible to eliminate four or more voltage levels, and reducing the number of voltage levels as described above is a particularly effective means of simplifying the drive circuit configuration when there are many gradation levels.

Fourteenth Embodiment

The fourteenth embodiment is depicted in FIGS. 27A–C, 28A–C and 29A–C. The fourteenth embodiment is similar to the thirteenth embodiment above. Additionally, the selection periods $t_1$–$t_4$, in the fourteenth embodiment, is divided into plural parts within one frame F as in the twelfth embodiment.

Figures 27A, 27B, 27C:
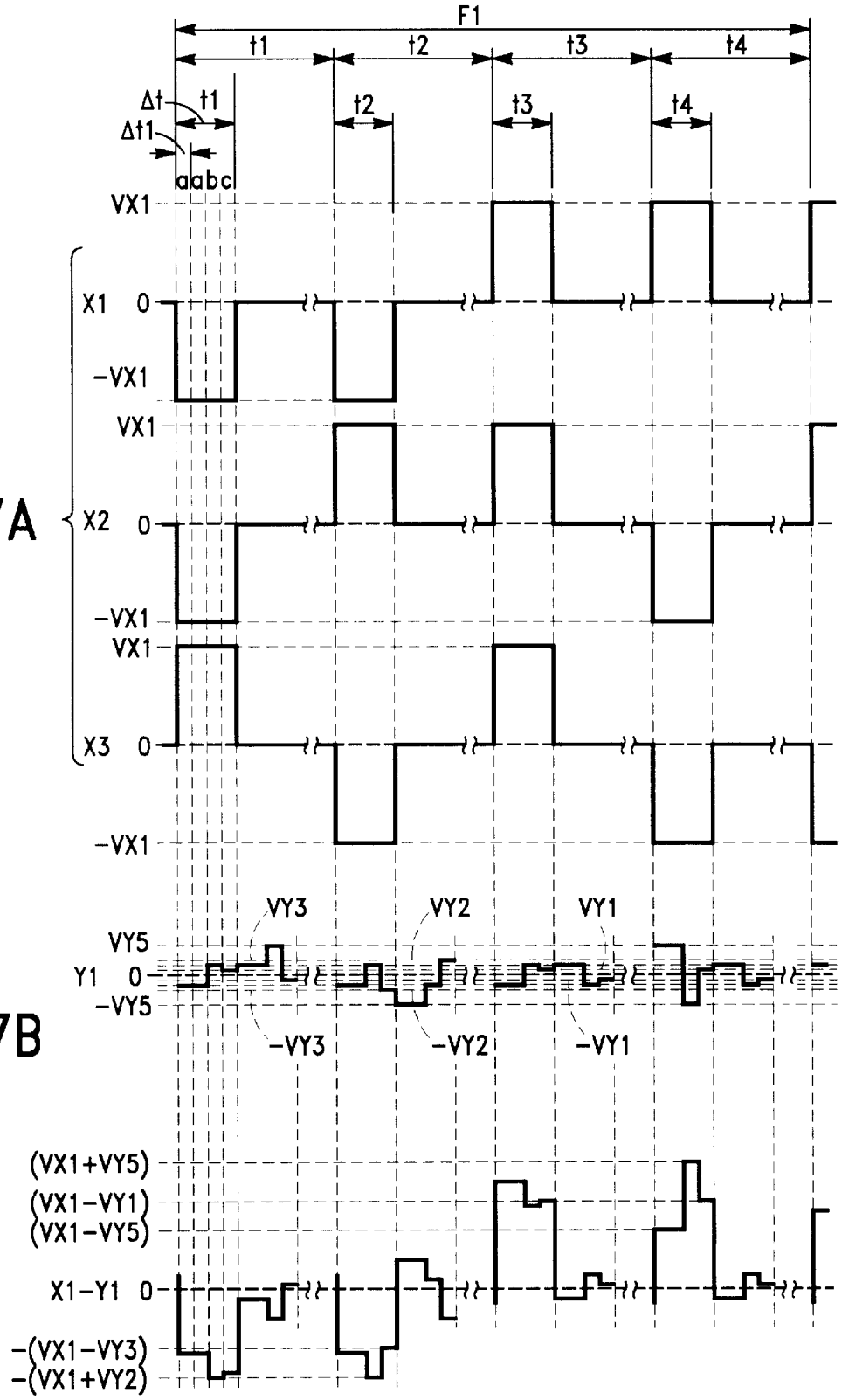
FIGS. 27A–C show the applied voltage waveforms of a fourteenth embodiment of a driving method of the liquid crystal display according to the present invention.

Referring to FIGS. 27A–C, a waveform diagrams are shown in which one selection period is divided into (n+1) parts, i.e., 4 parts, and these selection periods are divided into plural parts in one frame, specifically into four fields f, similar to the second and third embodiments. Note, however, that the selection periods can also be divided into two or three parts.

Figures 28A, 28B, 28C:
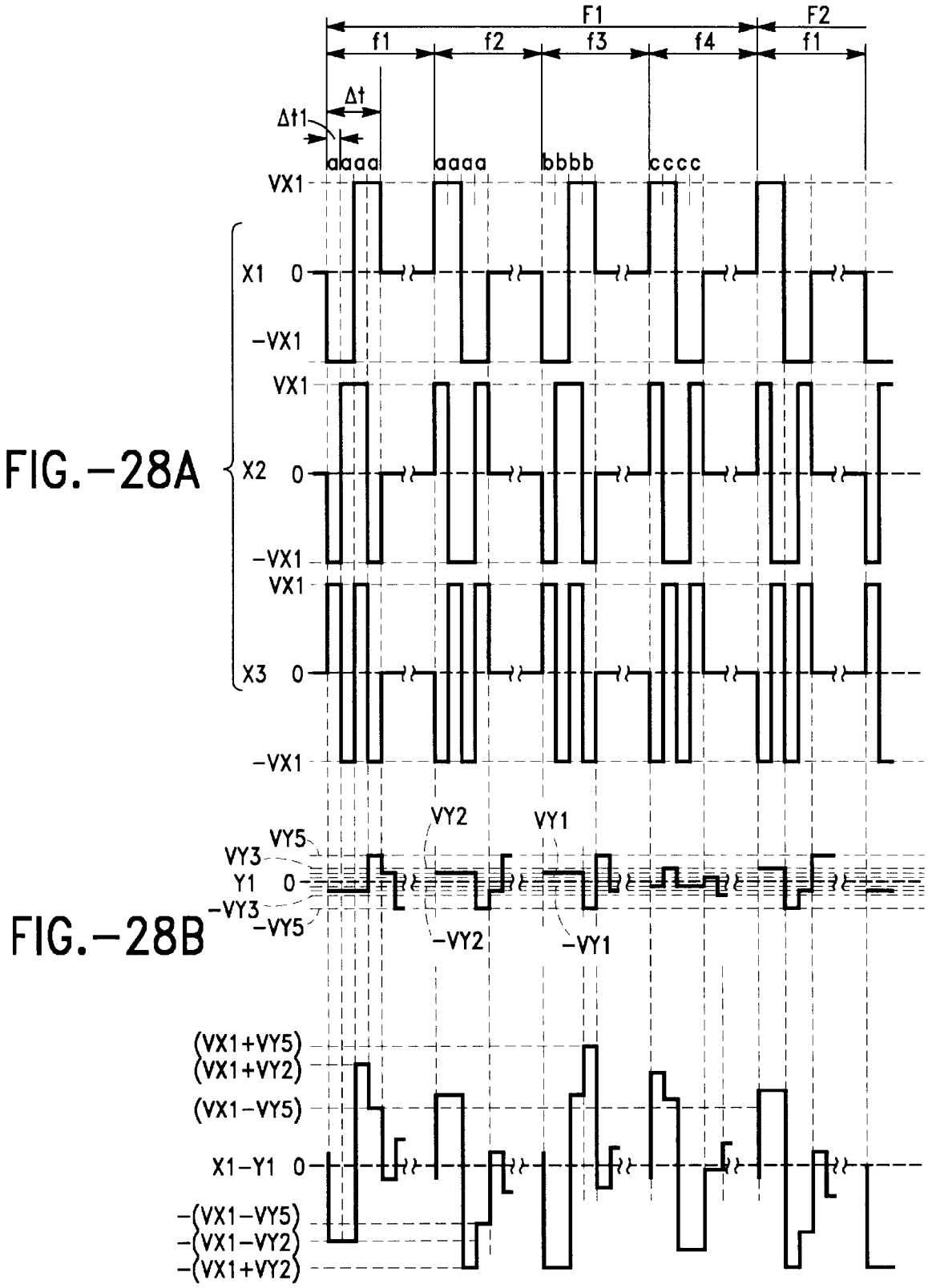
FIGS. 28A–C show another example of the applied voltage waveforms of the fourteenth embodiment of a driving method of the liquid crystal display according to the present invention.

FIG. 28*a* shows an example in which the driving is executed in each of the period divisions of the four periods $t_1$–$t_4$ in the above embodiment. The first period division a of the period divisions a, a of the four periods $t_1$–$t_4$ in FIG. 21 is treated in sequence as one grouping, and the period until all row electrodes have been selected is one field $f_1$, and one frame is completed when field $f_2$ for the next period division a, field $f_3$ for period division b, and field $f_4$ for period division c are completed. As in the previous embodiments the polarity of the voltage applied to the row electrodes is reversed each field, and the voltage applied to the column electrodes is also reversed accordingly.

Figures 29A, 29B, 29C:
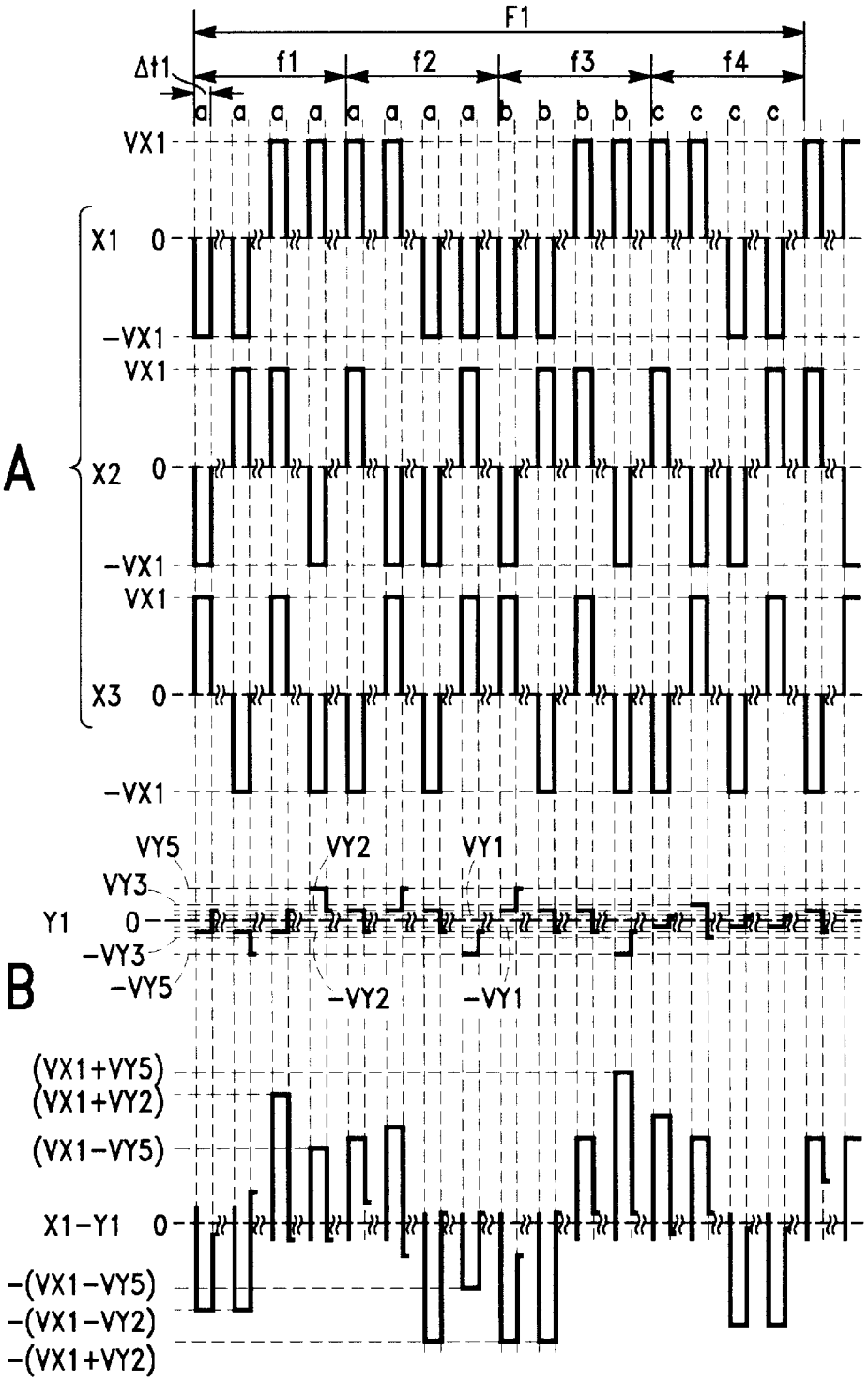
FIGS. 29A–C show another example of the applied voltage waveforms of the fourteenth embodiment of a driving method of the liquid crystal display according to the present invention.

FIGS. 29A–C show another example of the fourteenth embodiment in which execution is further divided and applied to all row electrodes in each of the period divisions a, a, b, c in FIG. 10. In other words, all the groups of row electrodes are sequentially selected after each period division.

The embodiment shown in FIGS. 28A–C and FIGS. 29A–C above achieve the same effect as a gray scale display achieved by weighting the voltage applied to the column electrodes for each field.

Fifteenth Embodiment

Figures 30A, 30B, 30C:
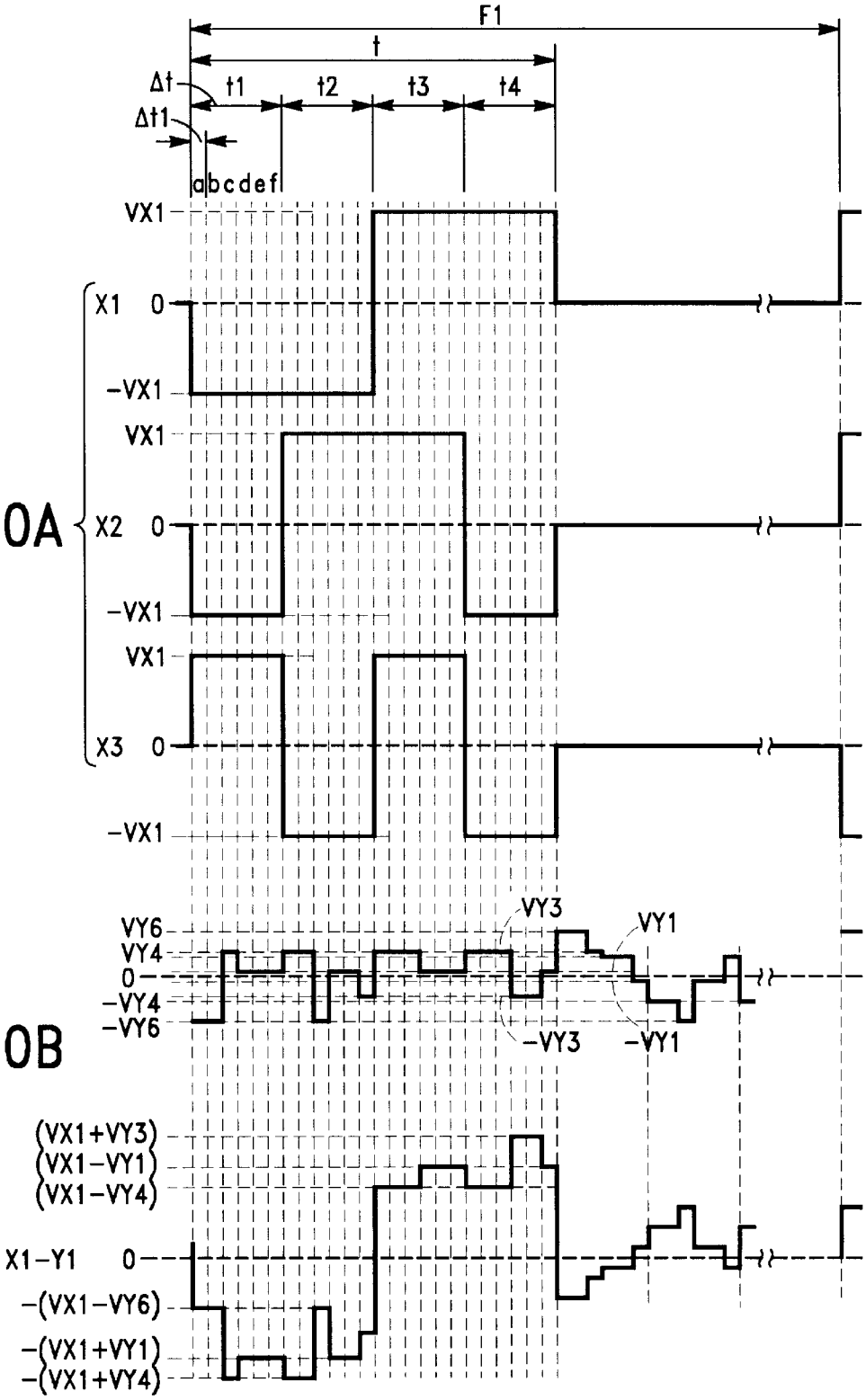
FIGS. 30A–C show the applied voltage waveforms of a fifteenth embodiment of a driving method of the liquid crystal display according to the present invention.

FIGS. 30A–C illustrate the fifteenth embodiment of the present invention. As noted above, the effective voltage when driving the liquid crystal elements is generally determined by the voltage magnitude applied and the application time (pulse width). Thus, the desired gray scale display can be achieved by appropriately combining the application time and the magnitude of the voltage applied to the column electrodes.

Referring to FIGS. 30A–C the applied voltage waveforms for an embodiment achieving a 16 gray scale display based on the display data shown in FIG. 31 by appropriately combining the application time and the magnitude of the voltage applied to the column electrode is shown therein.

This embodiment also simultaneously selects three row electrodes, and applies the row voltage to each of the row electrodes during the four selection periods $t_1$–$t_4$ as in the first embodiment described above.

Each of these four periods $t_1$–$t_4$ is divided into six periods a–f, and the first two period divisions a, b correspond to the highest bit in the four digit binary display data shown in FIG. 33, the next period division c corresponds to the second bit, the next two period divisions d, e to the third bit, and the last period division f corresponds to the lowest bit.

Column voltage $\pm V_{Y4}$ or $\pm V_{Y6}$ is selectively applied to the column electrodes according to the following conditions for the highest two bits, and $\pm V_{Y1}$ or $\pm V_{Y3}$ is selectively applied for the lowest two bits.

Note that the voltage value ratio is defined as:

$V_{Y1}:V_{Y3}=1:3$ $V_{Y4}:V_{Y6}=1:3$ $V_{Y1}:V_{Y4}=1:4$.

As above, the highest two bits and the lowest two bits use the same two voltage combinations, the highest bit and the second from the lowest bit are weighted relative to the second from highest bit and the lowest bit, respectively, by doubling the respective pulse widths; the two highest bits can thus express four gradations, the two lowest bits express four gradations, and combined these express 4×4=16 gradations.

As conditions for the above, ON is when the voltage waveform of the row electrode is positive and OFF is when negative, and a display data value of 1 is ON and 0 is OFF; the ON/OFF state of the simultaneously selected row electrodes and the ON/OFF state of the corresponding display data bits at the intersections of the selected row electrode and the column electrode to which the voltage is to be applied are compared for each bit position, and a voltage specified according to the number of mismatches is applied to the column electrode.

Specifically, when the number of mismatches between the row electrode and the highest bit is 0, 1, 2, or 3, voltage value $-V_{Y6}$, $-V_{Y4}$, $V_{Y4}$, or $V_{Y6}$, respectively, is applied to the column electrode in period divisions a, b in this embodiment; for the number of mismatches between the row electrode and the second bit, the same voltages are applied to the column electrode during period division c under the same conditions as above. When the number of mismatches between the row electrode and the third bit is 0, 1, 2, or 3, a voltage value $-V_{Y3}$, $-V_{Y1}$, $V_{Y1}$, or $V_{Y3}$, respectively, is applied to the column electrode in period divisions d, e; and for the number of mismatches between the row electrode and the lowest bit, the same voltages are applied to the column electrode during period division f under the same conditions as above.

Referring to FIGS. 30A–C, the three row electrodes $X_1$, $X_2$, and $X_3$ are first simultaneously selected, and the selected row electrodes $X_1$, $X_2$, and $X_3$ are OFF, OFF, ON, respectively, and the highest bits of the display data at the intersection of the column electrode $Y_1$ and these row electrodes $X_1$, $X_2$, and $X_3$ are OFF, OFF, ON. Comparing both, the number of mismatches is 0, and the voltage $-V_{Y6}$ is applied to column electrode $Y_1$ in the first period divisions a, b of the first period $t_1$.

Next, the second from highest bits are OFF, ON, OFF and the number of mismatches is 2 when compared with the OFF, OFF, ON states of the row electrodes $X_1$, $X_2$, and $X_3$; voltage $V_{Y4}$ is therefore applied in period division c. The second bits are ON, OFF, OFF, the number of mismatches is 2, and voltage $V_{Y1}$ is applied in period divisions d, e. The lowest bits are OFF, ON, OFF, the number of mismatches is 2, and voltage $V_{Y1}$ is therefore applied. A weighted voltage is applied to the other column electrodes $Y_{1-Ym}$ in a similar manner.

A column voltage corresponding to the number of mismatches is simultaneously applied to all column electrodes $Y_1$–$Y_m$ in the following periods $t_2$–$t_4$ in the same way, selection of row electrodes $X_1$, $X_2$, and $X_3$ ends, the next group of row electrodes i.e. $X_4$, $X_5$, and $X_6$ are selected, the specified column voltages are applied to the column electrodes $Y^1$–$Y_m$ in the same way as described above, and when all row electrodes have been selected, one frame F ends. The sign of the voltage applied to the row electrodes is then reversed because the first row electrodes $X_1$, $X_2$, and $X_3$ are again selected in sequence and the next frame begins, and the sign of the voltage applied to the column electrodes is also reversed for so-called alternating current drive scheme.

By thus achieving the desired gray scale display by appropriately combining the time and value of the voltage applied to the column electrodes as described above, a gray scale display can be achieved with fewer voltage levels, even when there are many gradation levels.

As is now apparent it is not essential to set the voltage rate as described above in the eleventh embodiment strictly according to the above conditions, and the periods $t_1$–$t_4$ and period divisions a–f do not need to be strictly equal. In addition, the order of the period divisions a–f can be changed as appropriate to achieve the same result.

Sixteenth Embodiment

Figures 32A, 32B, 32C:
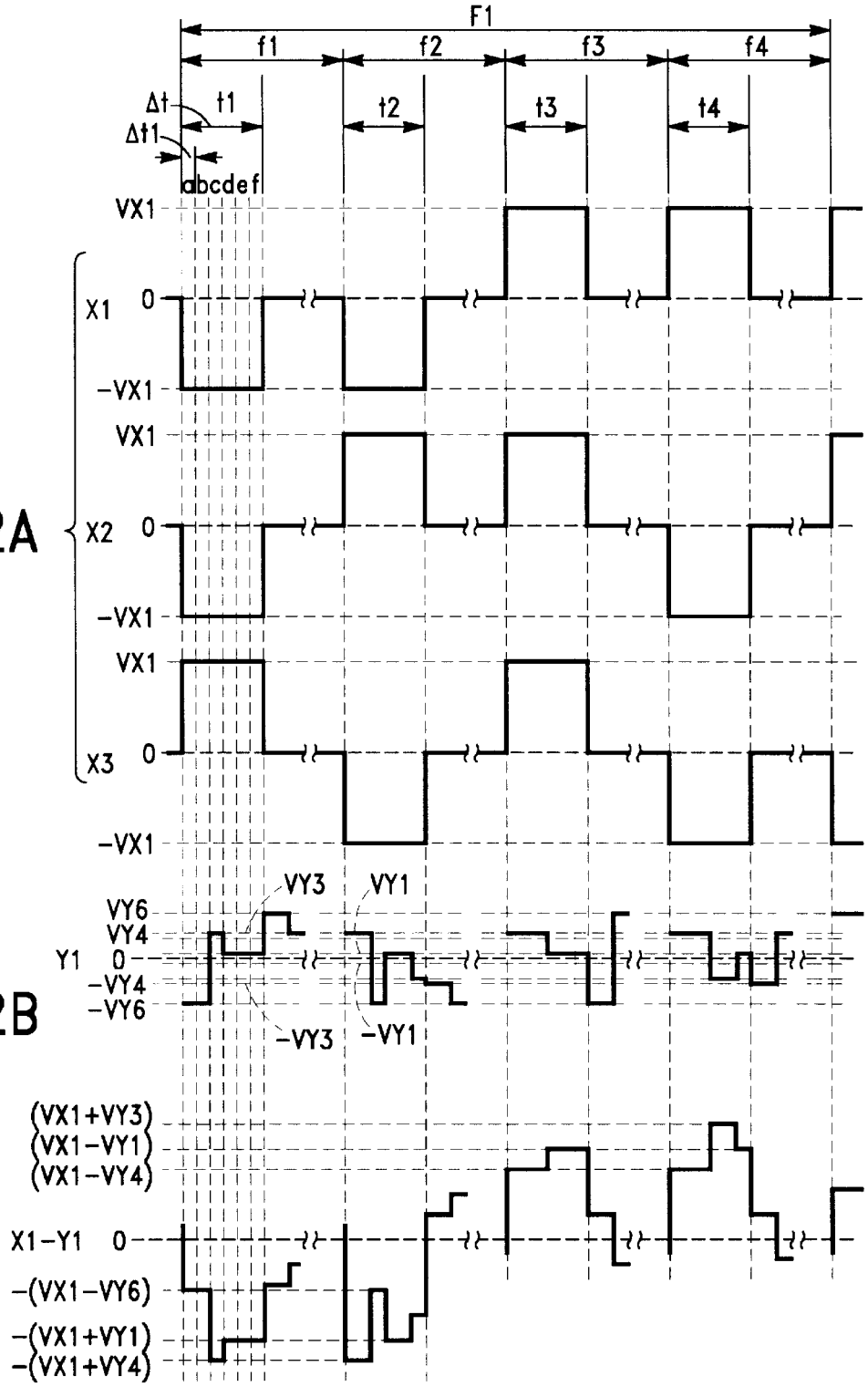
FIGS. 32A–C show the applied voltage waveforms of a sixteenth embodiment of a driving method of the liquid crystal display according to the present invention.

FIGS. 32A–C illustrate the sixteenth embodiment in which the selection period of the fifteenth embodiment is divided into plural parts within a single frame F as in the twelfth embodiment.

More specifically, as shown in FIGS. 32A–C, the periods $t_1$–$t_4$ are separately divided into four parts in a single frame F as in the second embodiment, one field f is defined as the selection of all row electrodes in each period, and the operation is repeated four times in one frame F. These column voltages are determined as described above.

As will be apparent to those who read this description, the fifteenth embodiment can also be driven for each display data bit or can be further divided as shown in FIGS. 28A–C and FIGS. 29A–C in the fourteenth embodiment.

Seventeenth Embodiment

In embodiments 11–16 above the column voltages were weighted to effectuate the gray-scale display. In the seventeenth embodiment, as shown in FIGS. 33A–C, the row voltages are weighted to provide a gray-scale display.

Figures 33A, 33B, 33C:
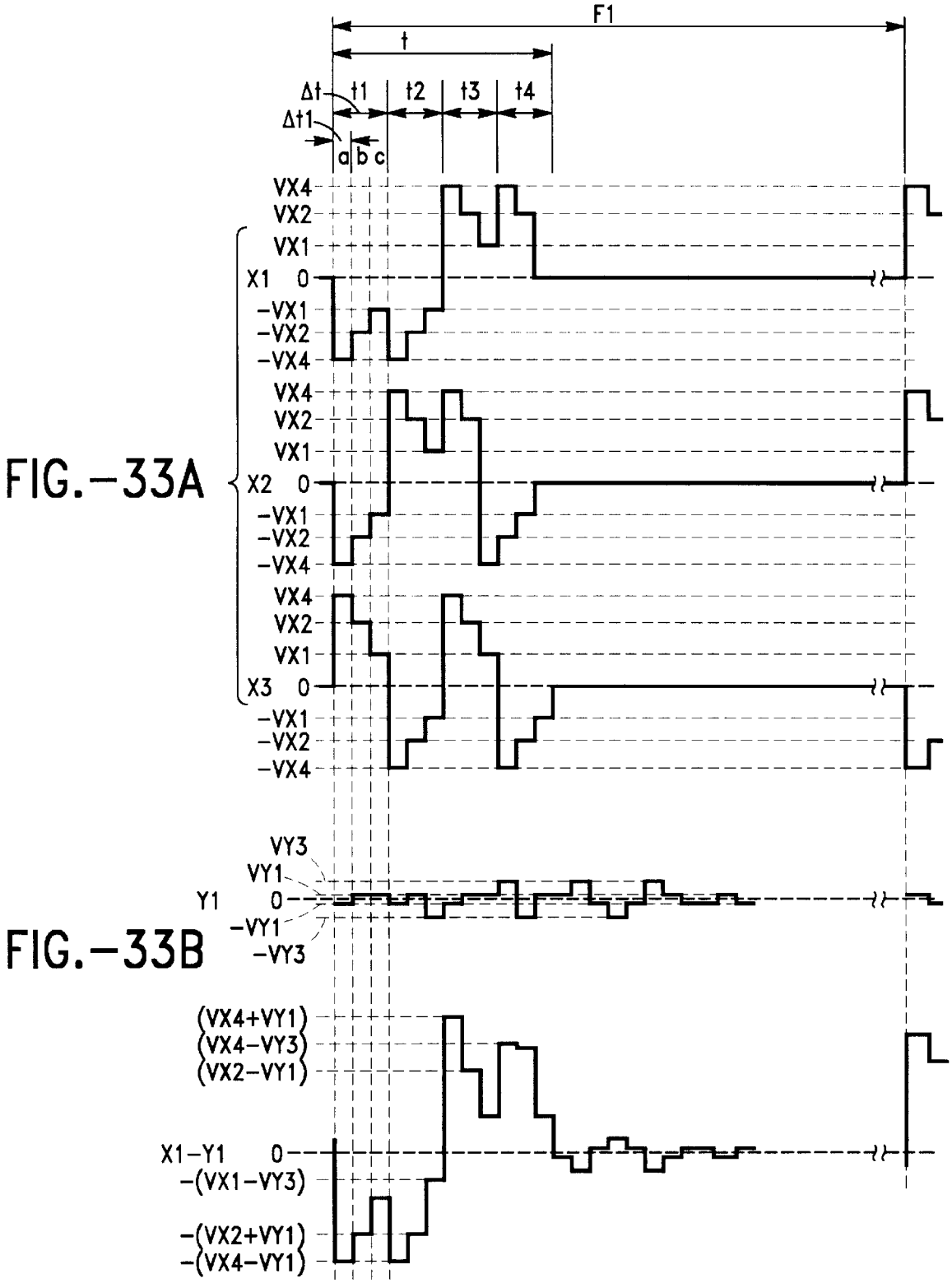
FIGS. 33A–C show the applied voltage waveforms of a seventeenth embodiment of a driving method of the liquid crystal display according to the present invention.

FIGS. 33A–C illustrate the applied voltage waveforms for the seventeenth embodiment changing the voltage levels applied to the row electrodes according to the display data bit to display eight gradations based on the display data shown in FIG. 22, similar to the eleventh embodiment.

As in the eleventh embodiment, the row electrodes are selected sequentially three lines at a time, and voltage $V_{X4}$ or $-V_{X4}$ is applied to each row electrode for the high display data bit, $V_{X2}$ or $-V_{X2}$ is applied for the middle bit, and $V_{X1}$ or $-V_{X2}$ is applied for the low bit. The ratios of the row voltages are preferably $V_{X1}:V_{X2}:V_{X4}$ or 1:2:4.

As with the previous embodiments, the ON/OFF states of the row electrodes $X_1$, $X_2$, and $X_3$ and the display data ON/OFF states are compared bit by bit, and when the number of mismatches is 0, 1, 2, and 3, respectively, voltages $-V_{Y3}$, $-V_{Y1}$, $V_{Y1}$, and $V_{Y3}$ are applied to the column electrodes $Y_1 \ldots Y_n$, preferably the $V_{Y1}:V_{Y3}$ ratio is 1:3.

If the number of voltage levels on the row electrode side is increased, rather than increasing the voltage levels on the column electrode side as in the eleventh embodiment, the number of voltage levels applied to the column electrode can be significantly reduced, and the structure of the column electrode-side drive circuit shown in FIGS. 4–6 can be simplified.

Eighteenth Embodiment

Figures 34A, 34B, 34C:
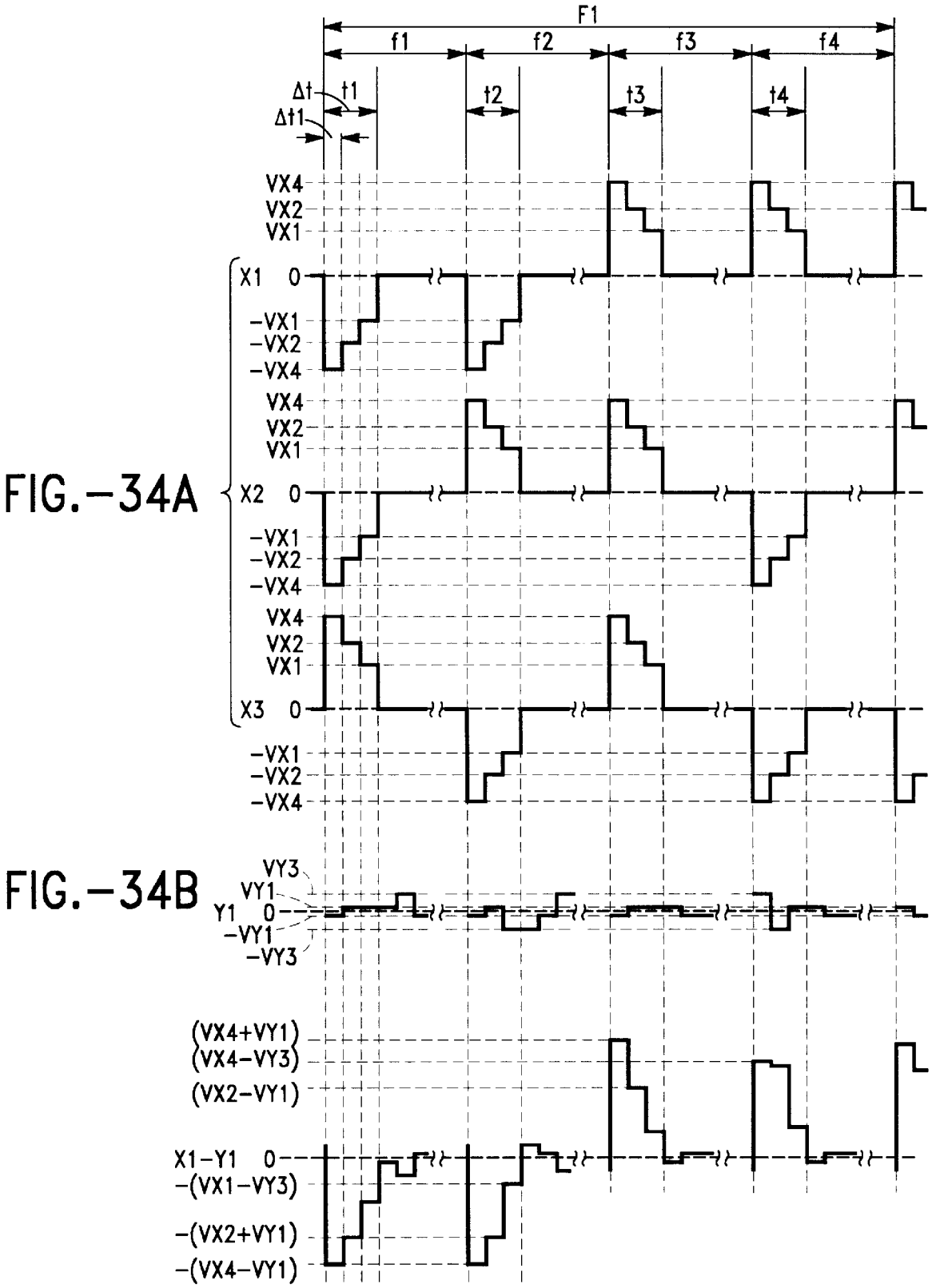
FIGS. 34A–C show the applied voltage waveforms of an eighteenth embodiment of a driving method of the liquid crystal display according to the present invention.

FIGS. 34A–C illustrate the eighteenth embodiment of the present invention in which the row voltages are weight, similar to the seventeenth embodiment and the selection period is divided into plural parts within a single frame F as in the twelfth embodiment to achieve a gray scale display. FIGS. 35A–C and FIGS. 36A–C illustrate other examples of the eighteenth embodiment.

FIGS. 34A–C depicts an example in which the periods $t_1$–$t_4$ in FIGS. 33A–C are separately divided into four parts in a single frame F as in the twelfth embodiment, one field f is defined as the selection of all row electrodes in each period, and the operation is repeated four times in one frame F.

Figures 35A, 35B, 35C:
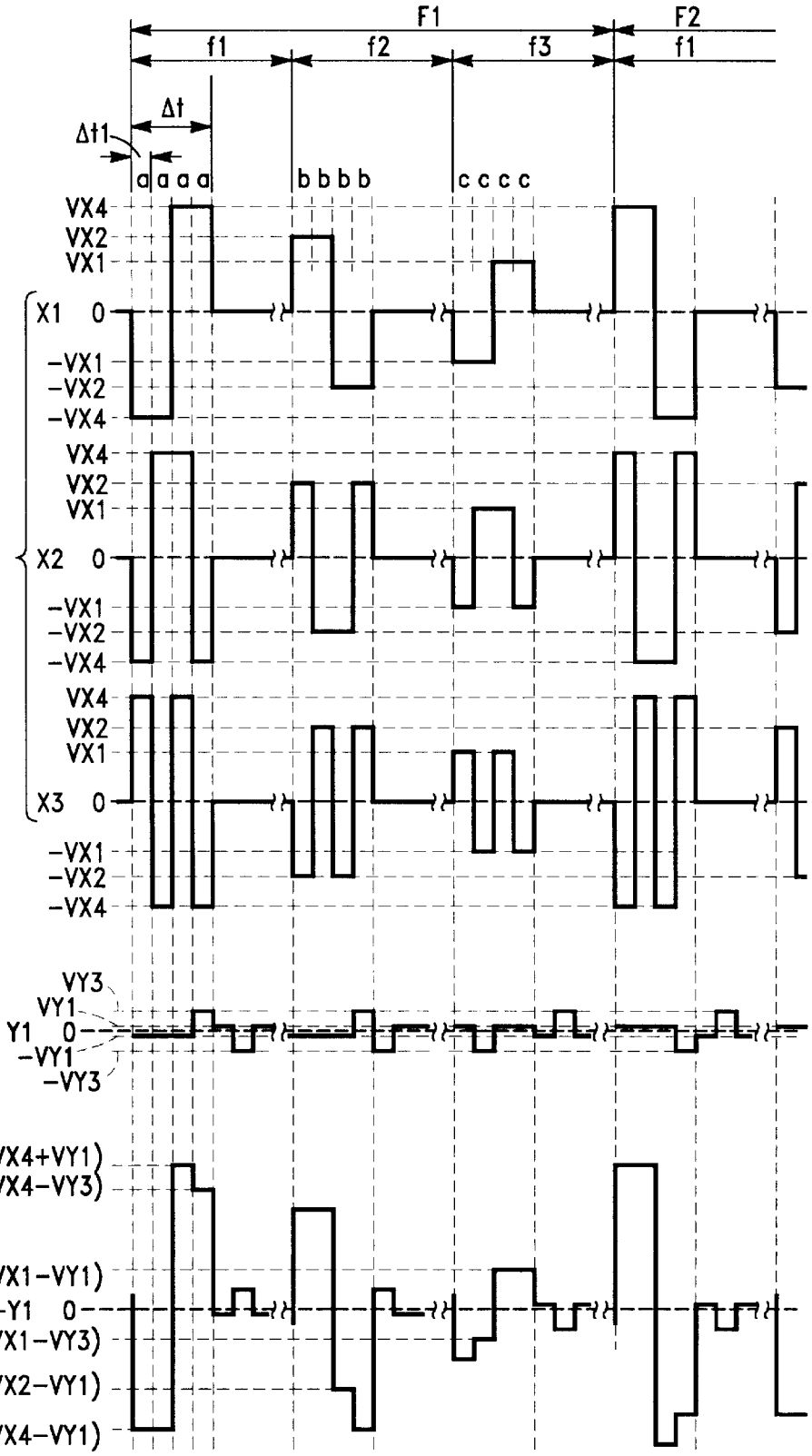
FIGS. 35A–C show another example of the applied voltage waveforms of the eighteenth embodiment of a driving method of the liquid crystal display according to the present invention.

FIGS. 35A–C shows another example of the eighteenth embodiment wherein the display is driven for each display data bit, i.e., in each of the period divisions of the four periods $t_1$–$t_4$ in the previous embodiment. Specifically, the first period division a in the four periods $t_1$–$t_4$ is treated as one field $f_1$ until all row electrodes have been selected, and one frame is completed when field $f_2$ corresponding to the other period division b and field $f_3$ corresponding to period division c are similarly completed. Note that the sign of the voltage applied to the row electrodes is inverted each field, and the voltage applied to the column electrodes is also inverted accordingly.

Figure 36A:
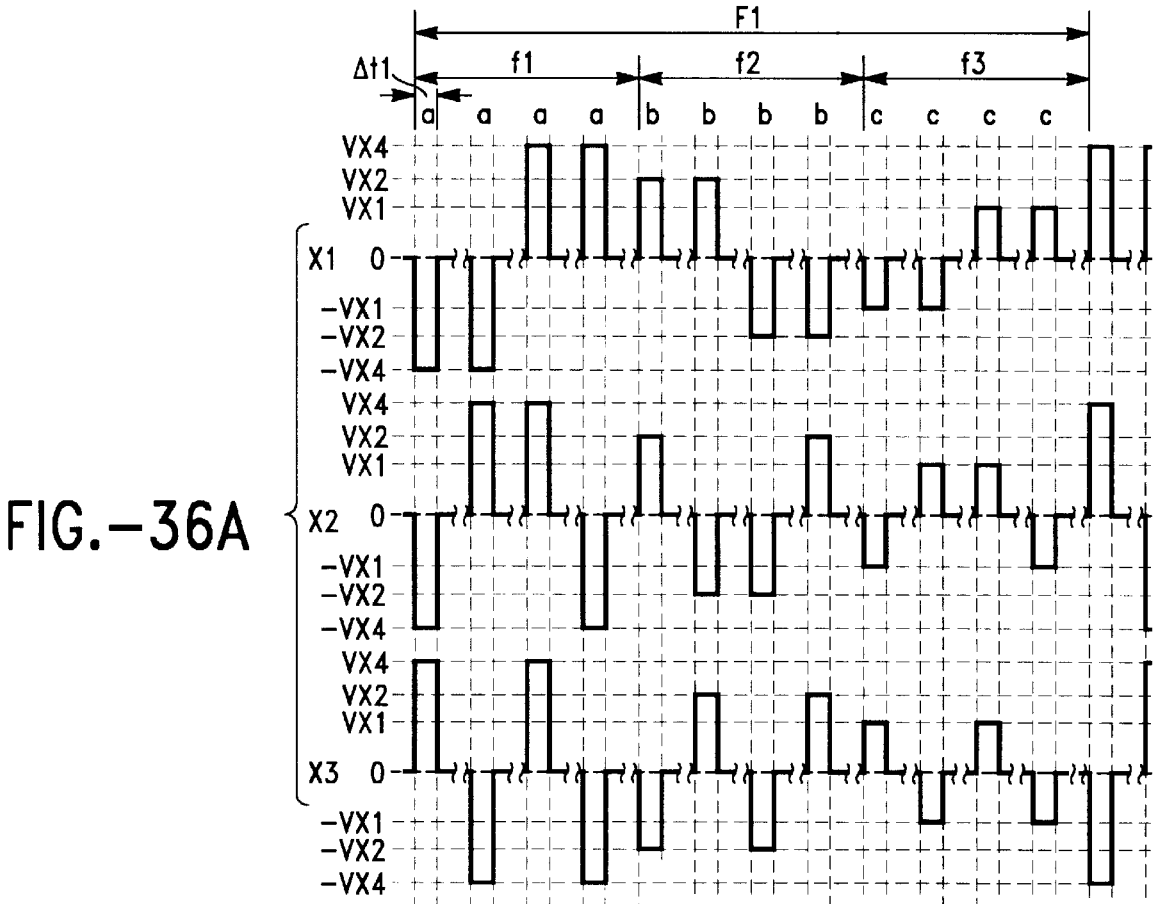
FIGS. 36A–C show another example of the applied voltage waveforms of the eighteenth embodiment of a driving method of the liquid crystal display according to the present invention.
Figure 36B:
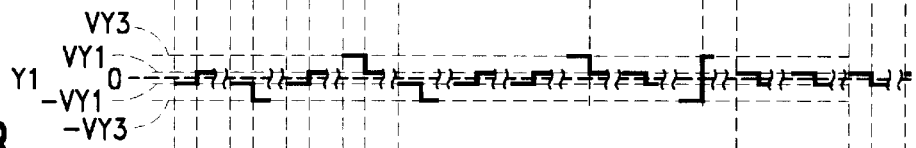
Figure 36C:
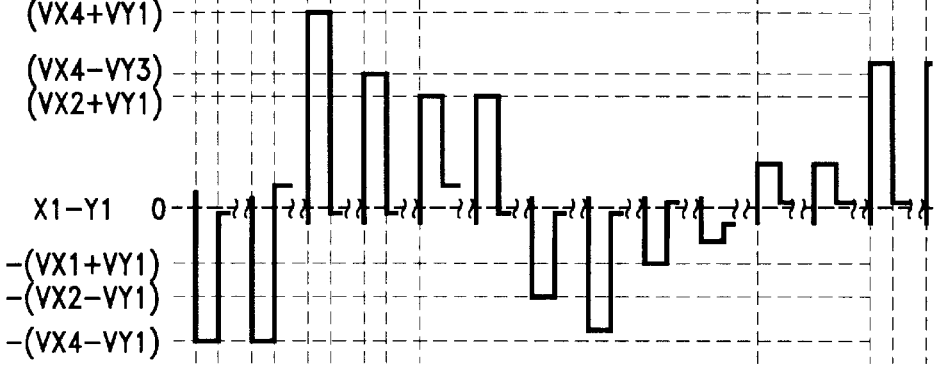

A further example of the eighteenth embodiment is shown in FIGS. 36A–C in which the periods are divided so that all row electrodes are sequentially selected in each period division. This example achieves a gray scale display similar to the twelfth embodiment by driving the display in plural parts within one frame as described above.

Nineteenth Embodiment

Figures 37A, 37B, 37C:
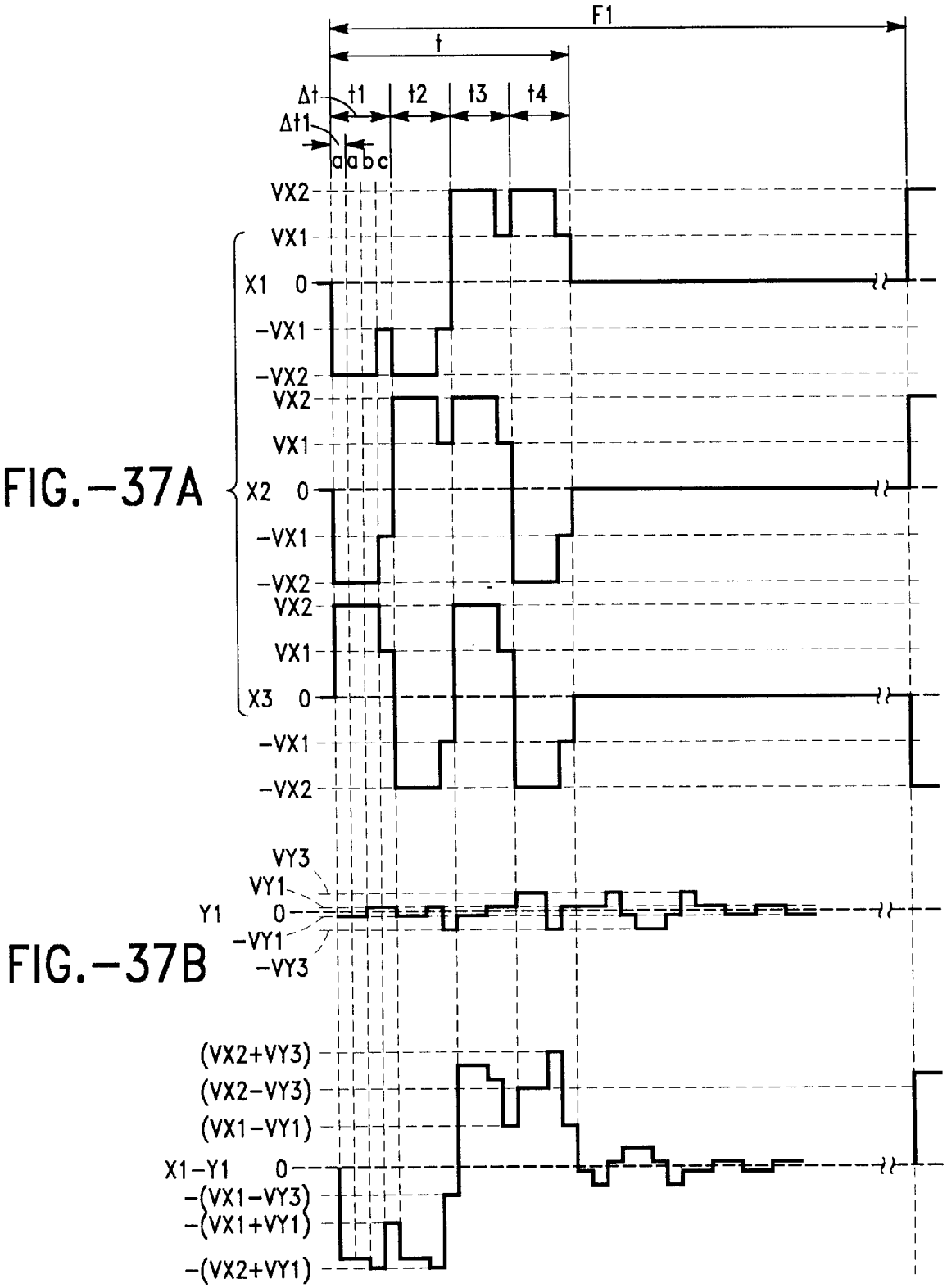
FIGS. 37A–C show the applied voltage waveforms of a nineteenth embodiment of a driving method of the liquid crystal display according to the present invention.

FIGS. 37A–C show the nineteenth embodiment of the present invention in which the number of selection period divisions, similar to the seventeenth embodiment, are increased to reduce the number of applied voltage levels as in the thirteenth embodiment.

More specifically, each of the periods $t_1$–$t_4$ in FIGS. 33A is further divided into four parts in one frame F as in FIGS. 26A–C with the first two period divisions being the application time for the high bit, and the other period divisions being the application times for the middle and low bits, respectively. Note that the relationship of the applied voltages in this embodiment is $V_{X1}:V_{X2}=1:2$, and $V_{Y1}:V_{Y3}=1:3$. The column voltages are selected in a similar manner as described above.

Twentieth Embodiment

Figures 38A, 38B, 38C:
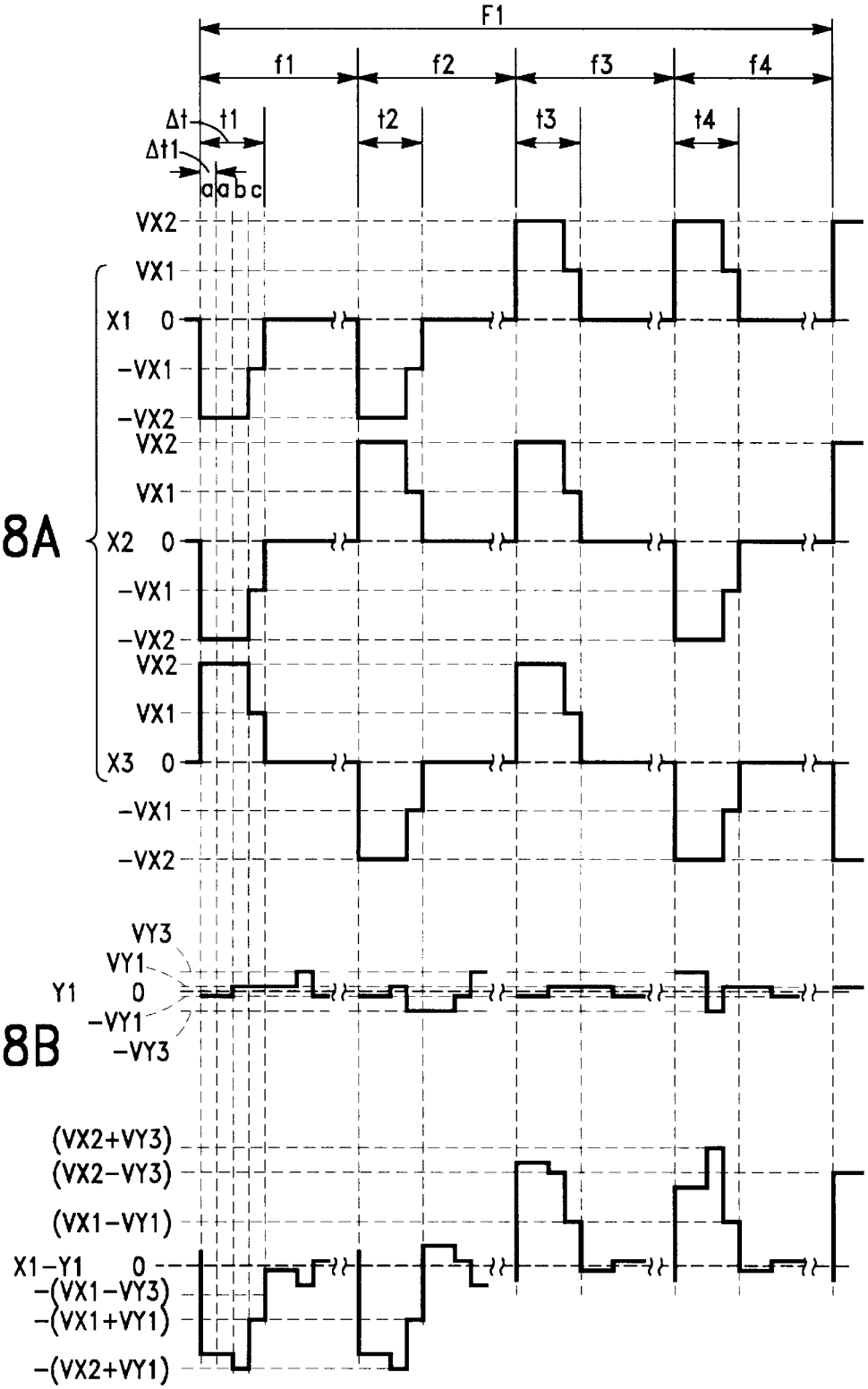
FIGS. 38A–C show the applied voltage waveforms of a twentieth embodiment of a driving method of the liquid crystal display according to the present invention.

FIGS. 38A–C illustrate one example of the twentieth embodiment. In the twentieth embodiment the selection period, similar to the nineteenth embodiment is divided into plural parts within a single frame F. FIGS. 39A–C and 40A–C illustrate other examples of the twentieth embodiment.

FIGS. 38A–C show the example where the periods $t_1$–$t_4$, in FIG. 39, are separately divided into four parts in a single frame F as in FIG. 25. More specifically, one field f is defined as the selection of all row electrodes in each period, and the operation is repeated four times in one frame F.

Figure 39A:
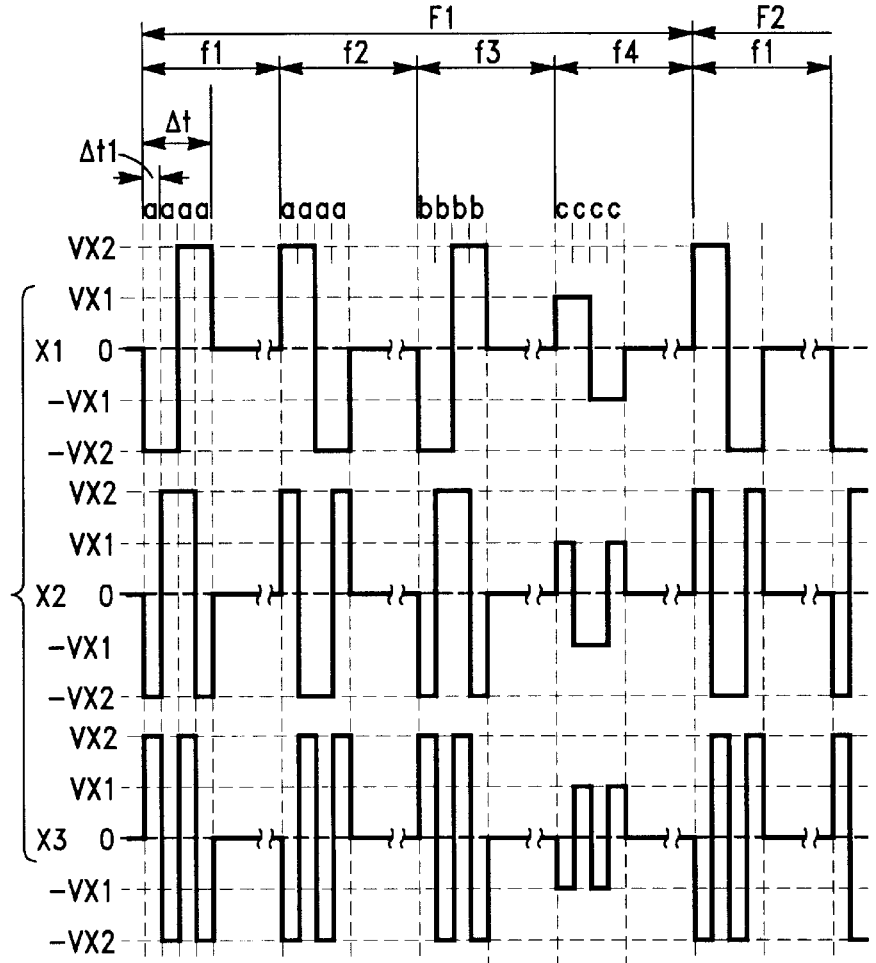
FIGS. 39A–C show another example of the applied voltage waveforms of the twentieth embodiment of a driving method of the liquid crystal display according to the present invention.
Figure 39B:
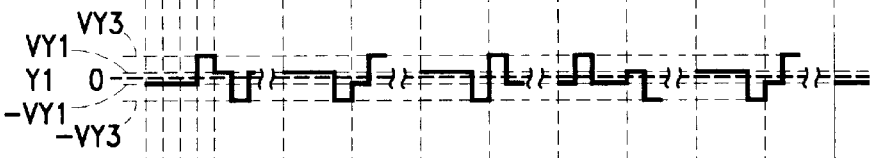
Figure 39C:
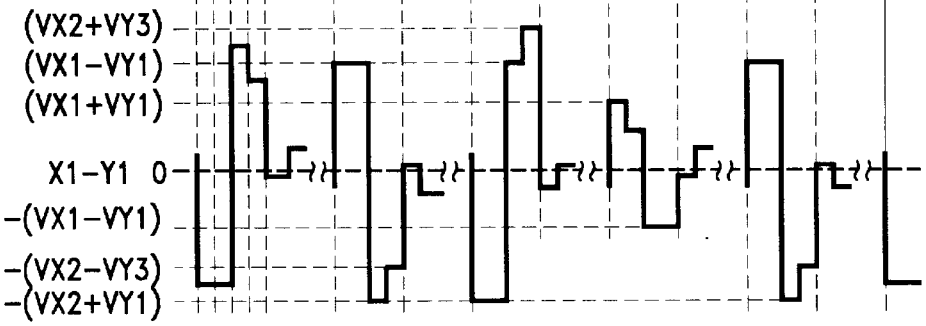

Referring to FIGS. 39A–C, another example is shown in which execution is grouped for each period division of the four periods $t_1$–$t_4$ in the previous embodiment; the first period division a of period divisions a, a in the four periods $t_1$–$t_4$ in FIG. 39 is treated as one field $f_1$ until all row electrodes have been selected, and one frame is completed when field $f_2$ corresponding to the other period division a, field $f_3$ corresponding to period division b, and field $f_3$ corresponding to period division c are similarly completed. Note that the sign of the voltage applied to the row electrodes is inverted each field, and the voltage applied to the column electrodes is also inverted accordingly.

Figures 40A, 40B, 40C:
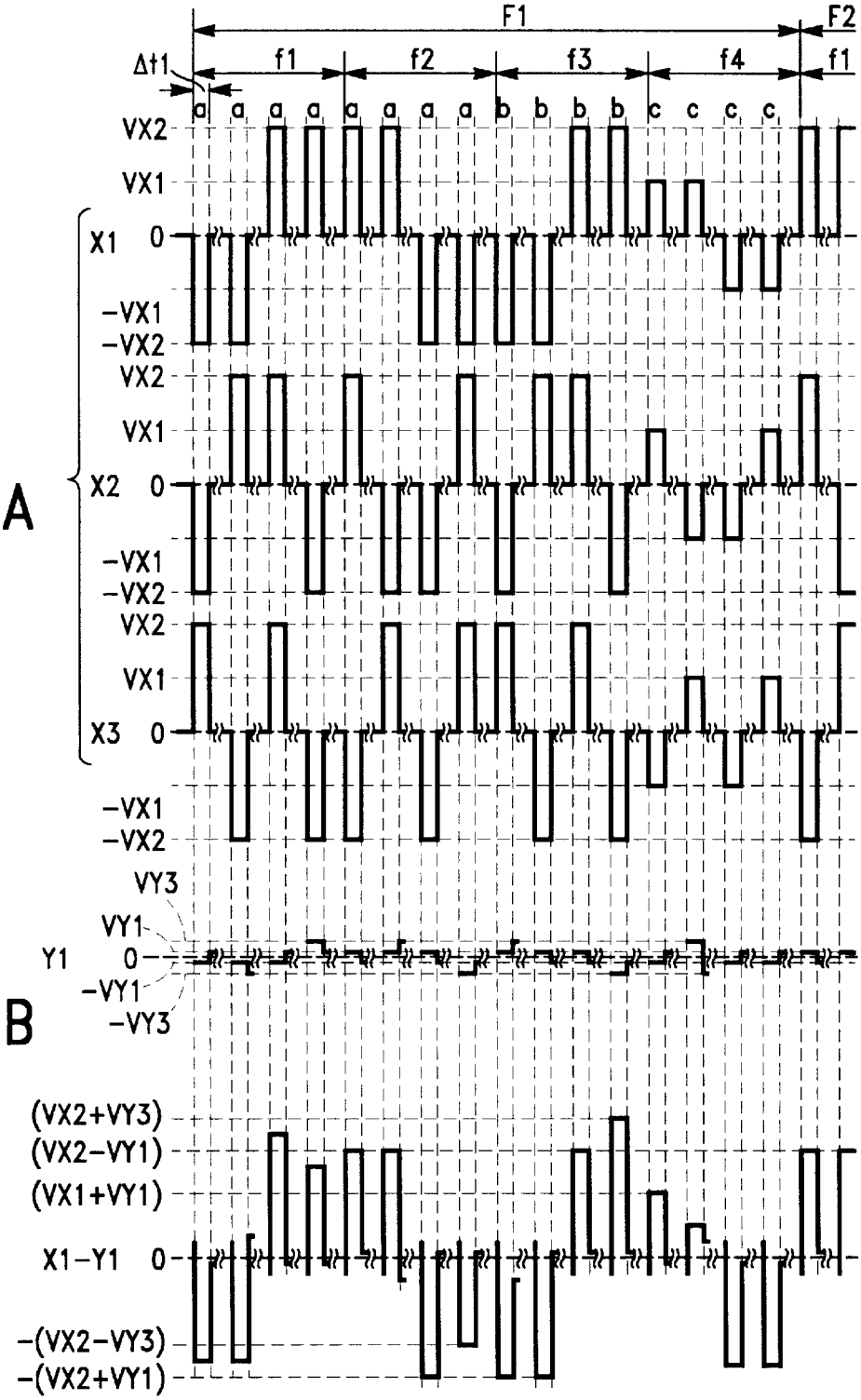
FIGS. 40A–C show another example of the applied voltage waveforms of the twentieth embodiment of a driving method of the liquid crystal display according to the present invention.

As shown in FIGS. 40A–C, it is also possible to further divide the periods so that all row electrodes are selected in each period division.

Thus, the same effects obtained with the twelfth embodiment can thus be obtained by driving the display in plural parts within one frame as described above.

Twenty-first Embodiment

Figures 41A, 41B, 41C:
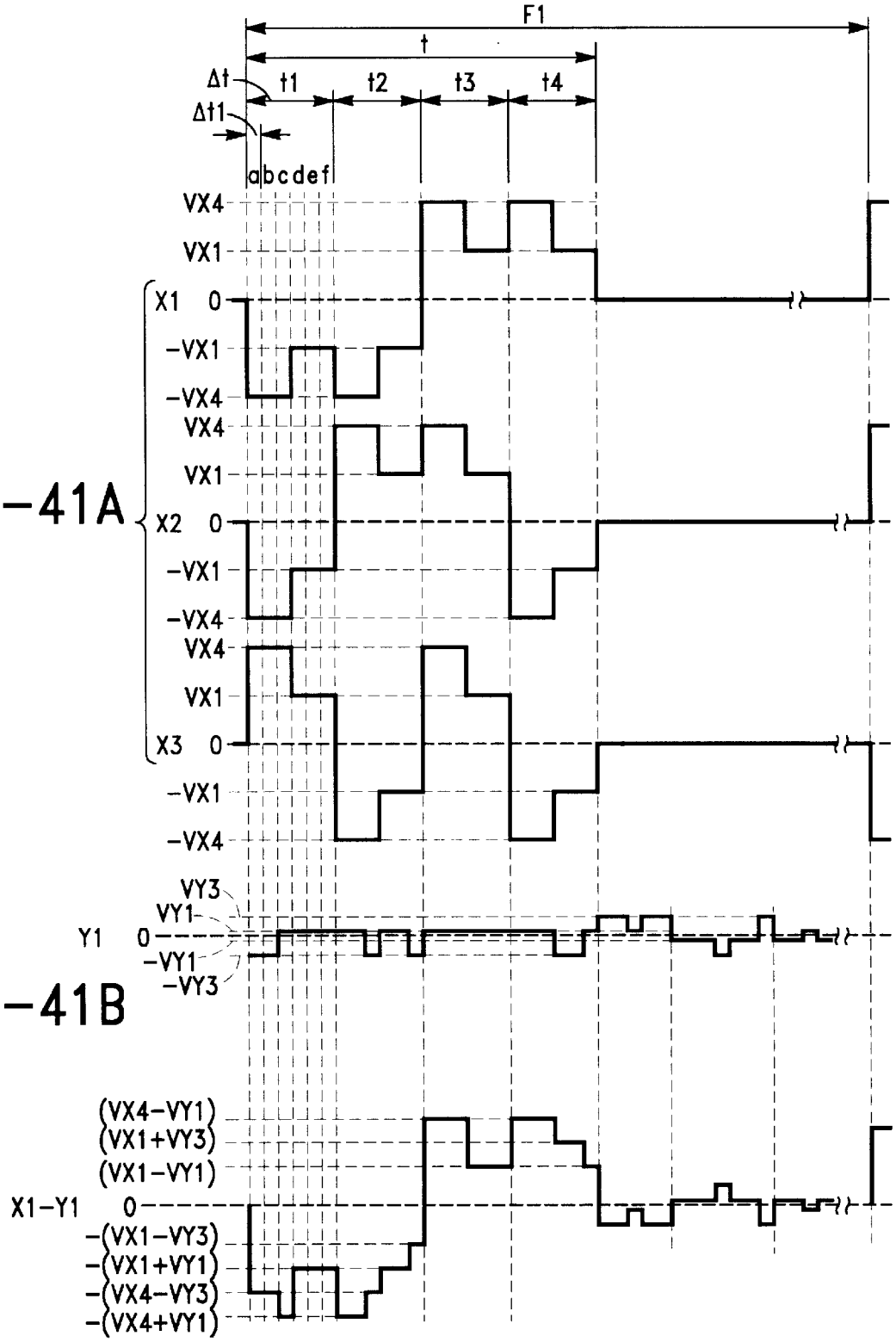
FIGS. 41A–C show the applied voltage waveforms of a twenty-first embodiment of a driving method of the liquid crystal display according to the present invention.

The twenty-first embodiment is shown in FIGS. 41A–C. In this embodiment, a desired gray scale display is achieved by appropriately combining the application time and the magnitude of the voltage applied to the column electrodes, as in the fifteenth embodiment above. The display panel drives identical to that of the fifteenth embodiment by increasing the number of voltage levels on the row electrode side instead of increasing the number of voltage levels on the column electrode side as in the sixteenth embodiment.

FIGS. 41A–C show an example in which voltage $V_{X4}$ or $-V_{X4}$ is used as the applied voltage level to each row electrode for the two highest display data bits, $V_{X1}$ or $-V_{X1}$ is applied for the two lowest bits preferably the ratio $V_{X1}:V_{X4}$ is 1:4.

The ON/OFF states of the row electrodes $X_1$, $X_2$, and $X_3$ and the display data ON/OFF states are compared bit by bit, and when the number of mismatches is 0, 1, 2, and 3, respectively, voltages $-V_{Y3}$, $-V_{Y1}$, $V_{Y1}$, and $V_{Y3}$ are applied to the column electrodes $Y_1$ . . . ; the $V_{Y1}$:$V_{Y3}$ ratio is 1:3, similarly as discussed above.

Twenty-second Embodiment

FIGS. 22A–C illustrate the twenty-second embodiment of the present invention in which the selection period, similar to the twenty-first embodiment. is divided into plural parts within a single frame F.

Figures 42A, 42B, 42C:
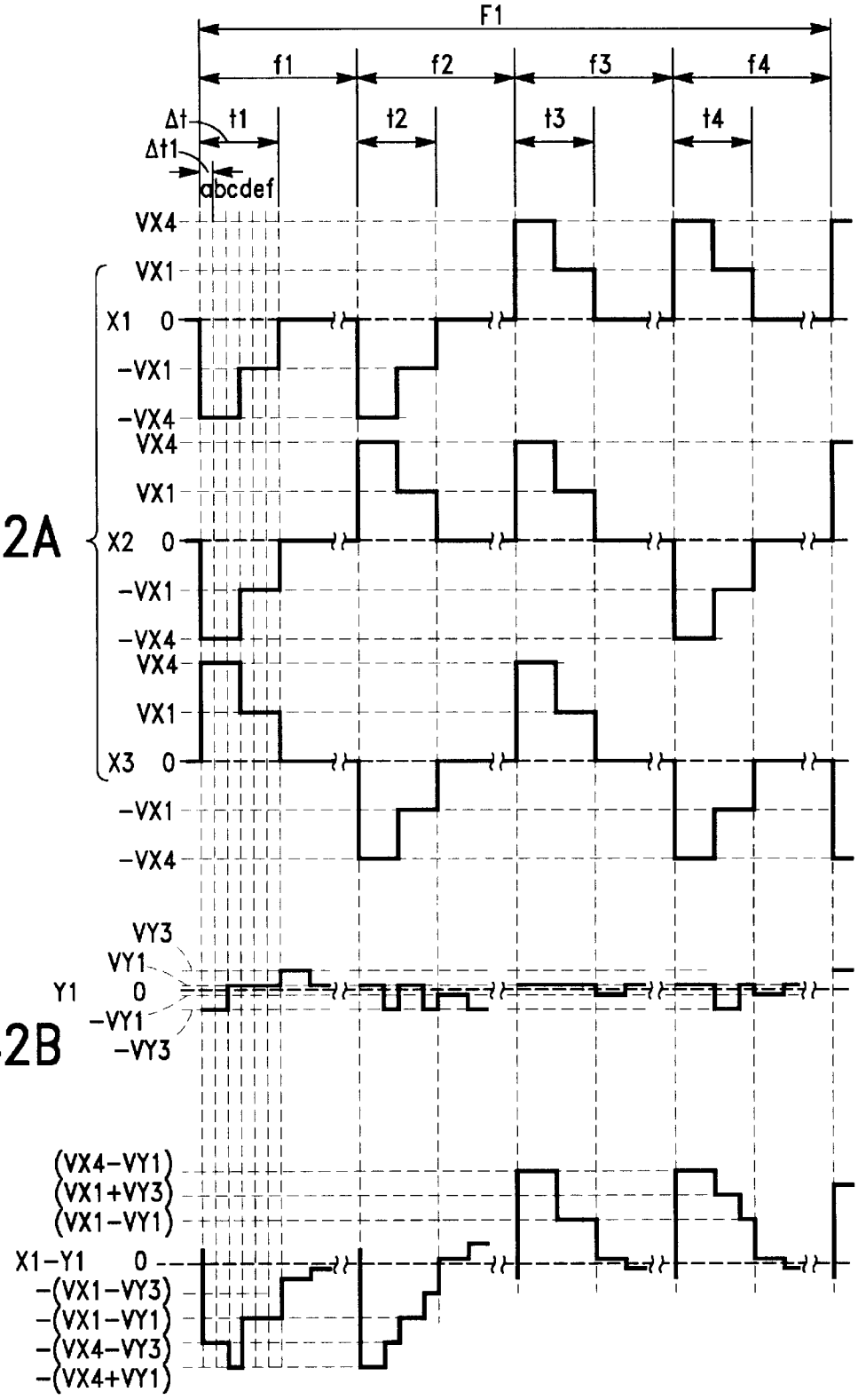
FIGS. 42A–C show the applied voltage waveforms of a twenty-second embodiment of a driving method of the liquid crystal display according to the present invention.
Figures 43A, 43B, 43C, 43D, 43E:
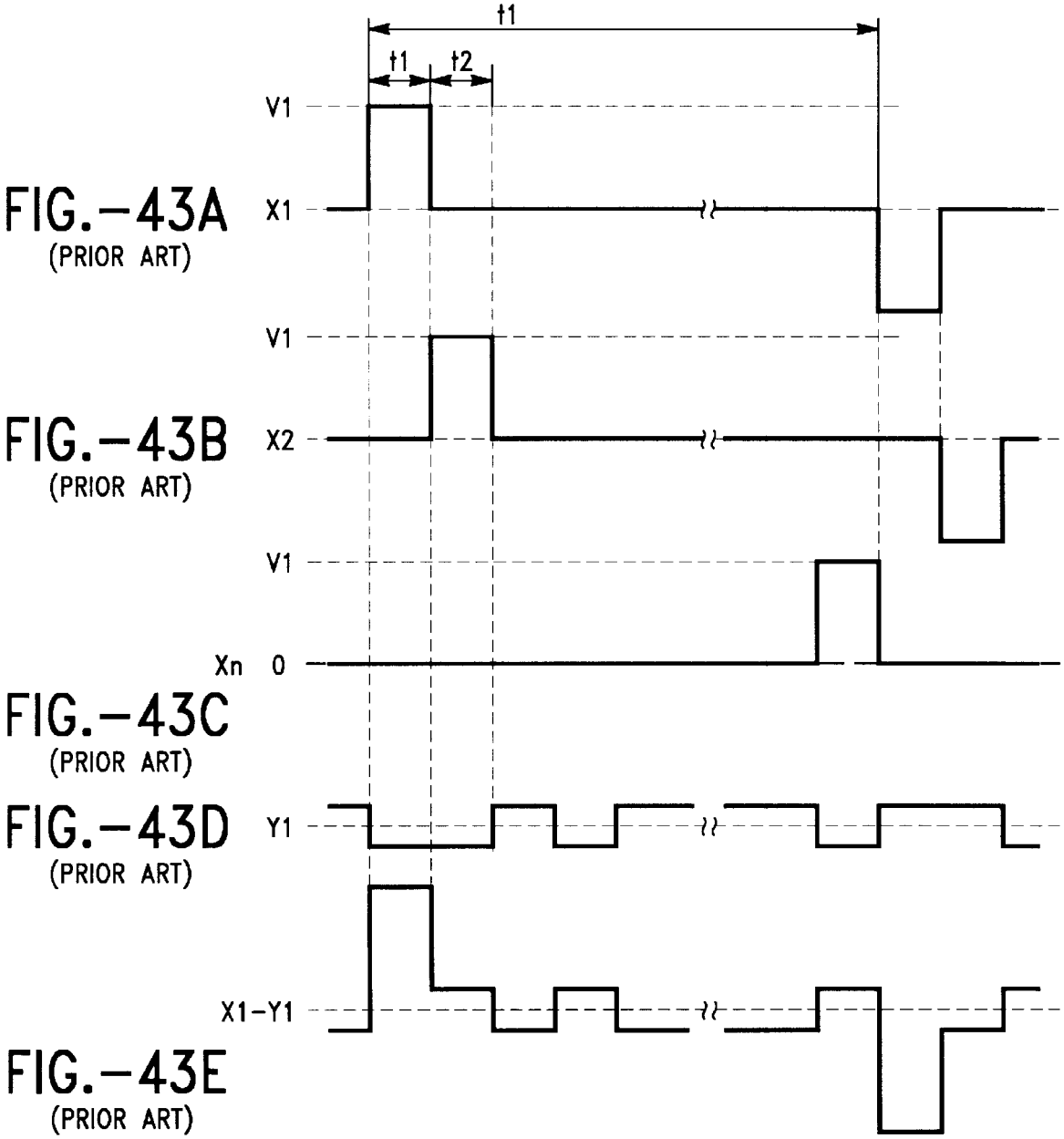
FIG.-43A (PRIOR ART)
FIG.-43B (PRIOR ART)
FIG.-43C (PRIOR ART)
FIG.-43D (PRIOR ART)
FIG.-43E (PRIOR ART)
FIGS. 43A–E show the applied voltage waveforms of a conventional driving method of a liquid crystal display.

Referring to FIGS. 42A–C the periods $t_1$–$t_4$ are separately divided into four parts in a single frame F, as in FIGS. 24A–C, one field f is defined as the selection of all row electrodes in each period, and the operation is repeated four times in one frame F. In this embodiment it is also possible to further divide and drive as in the previous embodiment.

As is readily apparent, the twenty-first embodiment can also be driven for each display data bit or can be further divided as in the twentieth embodiment shown in FIGS. 39A–C and FIGS. 40A–C.

It is to be noted that while each of the above embodiments has been described as simultaneously selecting three row electrodes, a gray scale display with the desired number of gradations is possible by simultaneously selecting two, four, or more row electrodes and applying the same concepts described above. For example, in an embodiment simultaneously selecting six row electrodes, selection periods divided into eight parts $t_1$–$t_8$ are provided in one frame period, and voltages as shown in the table below are applied in each of the selection periods $t_1$–$t_8$ of the six simultaneously selected row electrodes $X_1$–$X_6$.

| | $t_1$ | $t_2$ | $t_3$ | $t_4$ | $t_5$ | $t_6$ | $t_7$ | $t_8$ |
|---|---|---|---|---|---|---|---|---|
| $X_1$ | $V_{X1}$ | $V_{X1}$ | $V_{X1}$ | $V_{X1}$ | $-V_{X1}$ | $-V_{X1}$ | $-V_{X1}$ | $-V_{X1}$ |
| $X_2$ | $V_{X1}$ | $V_{X1}$ | $-V_{X1}$ | $-V_{X1}$ | $-V_{X1}$ | $-V_{X1}$ | $V_{X1}$ | $V_{X1}$ |
| $X_3$ | $V_{X1}$ | $V_{X1}$ | $-V_{X1}$ | $-V_{X1}$ | $V_{X1}$ | $V_{X1}$ | $-V_{X1}$ | $-V_{X1}$ |
| $X_4$ | $V_{X1}$ | $-V_{X1}$ | $-V_{X1}$ | $V_{X1}$ | $V_{X1}$ | $-V_{X1}$ | $-V_{X1}$ | $V_{X1}$ |
| $X_5$ | $V_{X1}$ | $-V_{X1}$ | $-V_{X1}$ | $V_{X1}$ | $-V_{X1}$ | $V_{X1}$ | $V_{X1}$ | $-V_{X1}$ |
| $X_6$ | $V_{X1}$ | $-V_{X1}$ | $V_{X1}$ | $-V_{X1}$ | $-V_{X1}$ | $V_{X1}$ | $-V_{X1}$ | $V_{X1}$ |

Note that 0 V is applied during the unselected period. The specified row voltage is applied to each of the row electrodes $X_1$–$X_6$ as described above, and the specified column voltage is simultaneously applied as described in the various embodiments to each of the column electrodes.

In addition, the waveform of the voltages applied to the row electrodes shall not be limited to the embodiments, and the waveforms can be changed to the waveforms as shown in FIGS. 46A and B or FIGS. 3A and B, or the pulse widths thereof can be appropriately selected or the order changed insofar as the waveforms applied to the simultaneously selected row electrodes do not become intermixed and the row electrodes can be separately driven.

The concept of simultaneously selecting plural sequential row electrodes and dividing the selection period into plural parts in one frame for liquid crystal element drive as described above can also be applied to drive liquid crystal elements using non-linear (including MIM) elements.

A drive method and display apparatus for liquid crystal elements according to the present invention as described above simultaneously selects plural sequential row electrodes, divides one selection period into plural periods, and in each of these divided selection periods applies a voltage weighted according to the desired display data to achieve a gray scale display. As a result, lengthening of the time in which the selected voltage is not applied to the pixels and a drop in contrast, flickering due to lengthening of the repeat cycle, or crosstalk due to rounding of the applied voltage waveform are prevented, and a good gray scale display can be achieved. It is also possible to reduce the number of applied voltage levels relative to the number of gradations, the drive means of the drive can be structurally simplified, and a liquid crystal element drive method and display apparatus featuring outstanding reliability and display performance can be provided by means of the invention.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A drive method for a liquid crystal device comprising the steps of:

(a) applying a scanning signal to each of a plurality of scanning electrodes comprising a selection signal during a selection period and a non-selection signal during a non-selection period; and (b) applying a data signal to each of a plurality of signal electrodes based on data representing an image having a gray scale to be displayed by the liquid crystal device;

wherein step (a) further comprises the step of:

(1) grouping the plurality of scanning electrodes into p groups, wherein p is an integer of at least two;

(2) applying the selection signal substantially simultaneously to the plurality of the scanning electrodes in one of the p groups and applying the non-selection signal substantially simultaneously to the plurality of scanning electrodes in one of the p groups immediately after applying the selection signal thereto and selecting a level of the selection signal based on an orthogonal function, wherein the selection signal is sequentially applied to succeeding groups of the scanning electrodes, wherein the non-selection signal is sequentially applied to succeeding groups of the scanning electrode groups immediately after applying the selection signal thereto, wherein each of the scanning signals has N selection periods and N non-selection periods per frame, wherein N is a integer of at least two, and applying the selection signal to each of the scanning electrodes in each of the N selection periods, and wherein the orthogonal function has information for determining a level of the selection signal; and (c) applying a weighted voltage in accordance with the display data in each of the selection periods.

2. A drive method according to claim 1, wherein a signal voltage weighted according to the desired display data is applied to respective ones of the signal electrodes to achieve a gray scale display.

3. A drive method according to claim 2, wherein the display data comprises q bits, q being a positive integer, wherein each of the N selection periods is divided into k intervals in accordance with the q bits, and wherein the signal voltage corresponding to the display data of each of the q bits is applied to the signal electrodes in each of the k intervals to achieve a gray scale display.

4. A drive method according to claim 2, wherein the display data comprises q bits, q being a positive integer, wherein each of the N selection periods is divided further into k portions, k being a positive integer greater than q, and wherein at least one of the k portions is allocated to the display data corresponding to one of the bits to reduce the number of applied voltage levels.

5. A drive method according to claim 2, wherein the N selection periods are each divided further into k portions, k being a positive integer, and wherein a voltage value of the voltages applied to the signal electrodes in the k portions are combined over a time duration to display the image having the gray scale.

6. A drive method according to claim 1, wherein the display data comprises a plurality of bits, and wherein the weighted voltage comprises a signal voltage applied to respective ones of the plurality of signal electrodes having a pulse width modulated in accordance with each of the plurality of bits to display the image with the gray scale.

7. A drive method according to claim 1, wherein the image is displayed during one frame period, and wherein a voltage applied to the signal electrodes is modulated during an interval of plural frame periods to display the image having the gray scale.

8. A drive method according to claim 1, wherein a scanning voltage weighted according to the desired display data is applied to the scanning electrodes to display the image having the gray scale.

9. A drive method according to claim 8, wherein the display data comprises q bits, q being a positive integer, each of the N selection periods is divided into k intervals in accordance with the q bits, and wherein a scanning voltage corresponding to the display data of each of the q bits is applied to the scanning electrodes in each of the k intervals to display the image having the gray scale.

10. A drive method according to claim 8, wherein the display data comprises q bits, q being a positive integer, wherein each of the N selection periods is divided into k intervals, k being a positive integer greater than q, and wherein at least one of the k intervals are allocated to the display data corresponding to one of the q bits to reduce a number of applied voltage levels.

11. A drive method according to claim 8, wherein the N selection periods are each divided into k intervals, k being a positive integer, and wherein the voltage value of the voltages applied to the scanning electrodes in the k intervals are applied for a predetermined duration to display the image having the gray scale.

12. A drive method according to any of claims 2–11, wherein the polarity of the voltages applied to the scanning electrodes is inverted in each frame.

13. A drive method according to claim 8, wherein the image is displayed during one frame period and wherein the voltages applied to the scanning electrodes are modulated during a period of plural frames to display the image having the gray scale.

14. A drive method according to claim 1, wherein a number of voltage levels applied to the signal electrodes is reduced by applying a virtual selection signal to a virtual scanning electrode.

15. A drive method according to claim 1, wherein voltage waveforms applied to each of the scanning electrodes and signal electrodes are applied in a predetermined order, wherein the predetermined order is changed within each frame period.

16. A drive method according to claim 1, wherein voltage waveforms applied to each of the scanning electrodes and signal electrodes are applied in a predetermined order, wherein the predetermined order is changed each succeeding frame period.

17. A drive method according to claim 1, wherein the order of the signal voltage waveforms applied to each of the signal electrodes is changed each frame period.

18. A drive method according to claim 1, wherein each of the N selection periods is further divided into x division periods, x being a positive integer greater than 1, wherein one field is defined as selecting all of the scanning electrodes during one division period, and wherein a frame period is defined as the selection of the scanning electrodes every x division periods.

19. A drive method according to claim 1, wherein each of the N selection periods is further divided into z division periods, z being a positive integer equal to the number of bits in the display data, wherein one field is defined as selecting all of the scanning electrodes during one division period, and wherein a frame period is defined as the selection of the scanning electrodes every z division periods.

20. A drive method according to claim 1, wherein each of the N selection periods is further divided into z division periods, z being a positive integer greater than the number of bits in the display data, wherein one field is defined as selecting all of the scanning electrodes during one division period, and wherein a frame period is defined as the selection of the scanning electrodes every z division periods.

21. A drive method according to claim 1, wherein the polarity of the voltages applied to the scanning electrodes is inverted each frame.

22. A liquid crystal display apparatus comprising:

a liquid crystal matrix panel having n scannin*g electrodes and m signal electrodes, wherein m is a positive integer and n is an integer of at least two; and a driving circuit (a) for applying a scanning signal to each of the n scanning electrodes comprising a selection signal during a selection period and a non-selection signal during a non-selection period; and (b) for applying a data signal to each of the m signal electrodes based on data representing an image having a gray scale to be displayed by the liquid crystal device;

wherein said driving circuit further:

(1) for grouping the plurality of scanning electrodes into p groups, wherein p is an integer of at least two;

(2) for applying the selection signal substantially simultaneously to the plurality of the scanning electrodes in one of the p groups and applying the non-selection signal substantially simultaneously to the plurality of scanning electrodes in one of the p groups immediately after applying the selection signal thereto and selecting a level of the selection signal based on an orthogonal function, wherein the selection signal is sequentially applied to succeeding groups of scanning electrodes, wherein the non-selection signal is sequentially applied to succeeding groups of the scanning electrode groups immediately after applying the selection signal thereto, wherein each of the scanning signals has N selection periods and N non-selection periods per frame, wherein N is an integer of at least two, and applying the selection signal to each of the scanning electrodes in each of the N selection periods, and wherein the orthogonal function has information for determining a level of the selection signal; and (3) for applying a weighted signal voltage weighted in accordance with desired display data to respective ones of said signal electrodes in each of the N selection periods to achieve a gray scale display.

23. A liquid crystal display apparatus comprising:

a liquid crystal matrix panel having n scanning electrodes and m signal electrodes, wherein m is a positive integer and n is an integer of at least two; and a driving circuit (a) for applying a scanning signal to each of the n scanning electrodes comprising a selection signal during a selection period and a non-selection signal during a non-selection period; and (b) for applying a data signal to each of the m signal electrodes based on data representing an image having a gray scale to be displayed by the liquid crystal device;

wherein said driving circuit further:

(1) for grouping the plurality of scanning electrodes into p groups, wherein p is an integer of at least two;

(2) for applying the selection signal substantially simultaneously the plurality of the scanning electrodes in one of the p groups and applying the non-selection signal substantially simultaneously to the plurality of scanning electrodes in one of the p groups immediately after applying the selection signal thereto and selecting a level of the selection signal based on an orthogonal function, wherein the selection signal is sequentially applied to succeeding groups of scanning electrodes, wherein the non-selection signal is sequentially applied to succeeding groups of the scanning electrode groups immediately after applying the selection signal thereto, wherein each of the scanning signals has N selection periods and N non-selection periods per frame, wherein N is an integer of at least two, and applying the selection signal to each of the scanning electrodes in each of the N selection periods, and wherein the orthogonal function has information for determining a level of the selection signal; and (3) for applying a weighted scanning voltage weighted in accordance with desired display data to respective ones of said scanning electrodes in each of the N selection periods to achieve a gray scale display.

* * * * *

UNITED STATES PATENT AND TRADEMARK OFFICE

CERTIFICATE OF CORRECTION

PATENT NO. : 5,877,738
DATED : March 02, 1999
INVENTOR(S) : Akihiko Ito, Et Al.

It is certified that error appears in the above-indentified patent and that said Letters Patent is hereby corrected as shown below:

Title page, item 63, Related U.S. Application Data, insert --Continuation-in-part of PCT/JP93/00604, May 10, 1993 and a-- before "Continuation-in-part".

item 30, Foreign Application Priority Data, insert --March 5, 1992 Japan 4-48743-- and --April 6, 1992 Japan 4-84007--.

item 56, References Cited, Other Publications, Page 2, first reference in the second column, change "Techniqie" to --Technique--.

Column 40, line 41, change "scannin*g" to --scanning--.

Signed and Sealed this

Twenty-sixth Day of October, 1999

*Attest:*

Q. TODD DICKINSON

*Attesting Officer*

*Acting Commissioner of Patents and Trademarks*